US005678132A

United States Patent [19]

Shiba et al.

[11] Patent Number: 5,678,132

[45] Date of Patent: Oct. 14, 1997

[54] IMAGE DENSITY DETECTION ADJUSTMENT DEVICE

[75] Inventors: Hiroshi Shiba, Yokohama; Hiroshi Mano, Tokyo; Fumihiro Ueno, Yokohama, all of Japan

[73] Assignee: Canon Kabushiki Kaisha, Tokyo, Japan

[21] Appl. No.: 428,432

[22] Filed: Apr. 25, 1995

[30] Foreign Application Priority Data

| | | | |
|---|---|---|---|
| Apr. 26, 1994 | [JP] | Japan | 6-088518 |
| Dec. 28, 1994 | [JP] | Japan | 6-329113 |
| Mar. 22, 1995 | [JP] | Japan | 7-062630 |

[51] Int. Cl.[6] ..... G03G 21/00

[52] U.S. Cl. ..... 399/59; 399/60; 399/74

[58] Field of Search ..... 355/246, 208; 399/59, 60, 72, 74, 64

[56] References Cited

U.S. PATENT DOCUMENTS

| | | | |
|---|---|---|---|
| 5,140,349 | 8/1992 | Abe et al. | 346/160 |
| 5,146,273 | 9/1992 | Yamada | 355/208 |
| 5,166,730 | 11/1992 | Urabe | 355/208 |
| 5,497,221 | 3/1996 | Takemoto | 355/246 |
| 5,568,234 | 10/1996 | Shiba | 399/59 |

*Primary Examiner*—Nestor R. Ramirez

*Attorney, Agent, or Firm*—Fitzpatrick, Cella, Harper & Scinto

[57] ABSTRACT

An image forming apparatus forms a patch image on a recording medium, irradiates the patch image formed on the recording medium with light, and detects a quantity of light reflected by the patch image and outputs a first detection signal. The apparatus detects a quantity of light emitted by a light emission source and outputs a second detection signal, and amplifies the first detection signal in accordance with a first amplification gain and outputs a first amplified signal. The apparatus amplifies the second detection signal in accordance with a second amplification gain and outputs a second amplified signal, and controls image forming conditions based on the first amplified signal or the second amplified signal. An adjustment mode is executed prior to controlling the image forming conditions, and the first amplification gain is controlled when the patch image is formed with black toner, and the second amplification gain is controlled when the patch image is formed with color toner.

12 Claims, 40 Drawing Sheets

| FIG. 31A | FIG. 31B |
|---|---|

| FIG. 38A | FIG. 38B |
|---|---|

IMAGE DENSITY DETECTION ADJUSTMENT DEVICE

BACKGROUND OF THE INVENTION

1. Field of the Invention

The present invention relates to a density control device adapted for use in an image forming apparatus and a density control method therefor.

2. Related Background Art

Image density control is known to be required generally in a color image forming apparatus. In such color image forming apparatus, a color image is obtained by formation, on a recording sheet, of superposed images of plural colors through repetition, by plural times, of a process of forming an image on a photosensitive drum through the steps of charging, exposure and development and then transferring thus formed image onto the recording sheet.

Such color image forming apparatus will be explained in the following, with reference to the attached drawings.

FIG. 21 is a cross-sectional view of a conventional color image forming apparatus, wherein provided are a photosensitive drum 1 and a roller charger 3. In addition there are provided, to the right of the photosensitive drum 1, developing cartridges 4*a*, 4*b*, 4*c*, 4*d* which are supported by a cylindrical rotary support member having a rotary shaft 9 and each of which integrally incorporates toner, a toner container and developing means for effecting the image development.

The developing cartridges 4*a*, 4*b*, 4*c*, 4*d* respectively contain yellow toner, magenta toner, cyan toner and black toner. Also to the left of the photosensitive drum 1 there is provided a transfer roller 10 serving to transfer a toner image on the photosensitive drum 1 onto a transfer sheet.

In the above-explained configuration, the photosensitive drum 1 is driven, by unrepresented drive means, in a direction indicated by an arrow, with a peripheral speed for example of 100 mm/sec.

In the upper part of the apparatus, an exposure device is constituted by a laser diode 11, a polygon mirror 13 rotated at a high speed by a high-speed motor 12, a lens 14 and a mirror 15.

The charging roller 3, receiving a DC voltage of −700 V superposed with an AC peak-to-peak voltage ($V_{p-p}$) of −1500 V and a frequency of 700 Hz, uniformly charges the photosensitive drum 1 to a voltage of −700 V.

When a signal for magenta image information, for example, is entered into the aforementioned laser diode 11, it emits light with a corresponding intensity. The emitted laser light irradiates the photosensitive drum 1 through an optical path 16, and the potential of the irradiated portion on the photosensitive drum 1 varies to about −100 V. In this manner an electrostatic image corresponding to magenta color is formed on the photosensitive drum 1. As the photosensitive drum 1 rotates in the direction indicated by the arrow, the latent image is rendered visible by the developing cartridge 4*a*.

Subsequently, the obtained visible image is transferred onto a transfer sheet wound on the transfer drum 10. In more details, a transfer sheet is fed by a pick-up roller 18 from a sheet cassette 17 in synchronization with the image formation on the photosensitive drum 1, and is supported on the transfer drum by a gripper 22, and the toner image on the photosensitive drum 1 is transferred onto the transfer sheet by a voltage applied between the photosensitive drum 1 and the transfer drum 10. In this manner a magenta image is transferred onto the transfer sheet.

Toner images of plural colors can be formed on the transfer sheet by repeating the above-explained process also for cyan, yellow and black colors.

The transfer sheet bearing the formed color image is peeled off from the transfer roller 10 by means of a separation charger 2 and a separation finger 24 and is subjected to fusion fixation of the toner by a known heat-pressure fixing device 25, whereby a color image is obtained. On the other hand, the toner remaining on the photosensitive drum 1 after transfer is removed by a fur brush (not shown) and a cleaning device 26 composed for example of a blade.

Now there will be explained, with reference to FIG. 22, density control in such conventional color image forming apparatus. Referring to FIG. 22, a density sensor 50 irradiates a toner image (patch), formed on the transfer drum 10, with light, then measures the quantities of the reflected light and the light from the light source, and releases the reflected light quantity or the light quantity from the light source respectively if the reflectance of the patch is high or low. An unrepresented CPU, anticipating the output of the density sensor in advance, fetches the output data in a range corresponding to the anticipated value and effects calculation of the density and control of the developing bias.

In such conventional configuration, however, the detection signal of the density sensor involves fluctuation resulting, for example, from the characteristics of the light-emitting element. For this reason, in the above-mentioned patch measurement, there may result an error because of an overflow of the range of measurement in the data fetching to the CPU.

Also the output of the sensor may become very small because the reflectance of toner varies from color to color. For this reason exact detection data cannot be obtained because of an enhanced error in the A/D conversion at the data fetching into the CPU, and, in the density conversion, the CPU has to depend on approximated calculations as logarithmic processing cannot be utilized.

SUMMARY OF THE INVENTION

An object of the present invention is to provide a density Control device not associated with the above-mentioned drawbacks and a method therefor.

Another object of the present invention is to provide a density control device capable of precise patch measurement for density control, and a method therefor.

Still another object of the present invention is to provide a density control device capable of preventing deterioration in the precision of density control, resulting for example from fluctuation in the characteristics of the light-emitting element or smear on an image bearing member (carrier) or a sensor employed in the density measurement, and a method therefor.

Still another object of the present invention is to provide a density control device capable of preventing deterioration in the precision of density control resulting from variations in the environmental conditions, and a method therefor.

Still another object of the present invention is to provide a density control device capable of precise density control by eliminating the influence of edge effect resulting in an electrophotographic process, and a method therefor.

Still other objects of the present invention, and the features thereof, will become fully apparent from the following detailed description, to be taken in conjunction with the attached drawings, and from the appended claims.

DETAILED DESCRIPTION OF THE PREFERRED EMBODIMENTS

Now the present invention will be clarified in detail by preferred embodiments thereof shown in the attached drawings.

[1st Embodiment]

Figure 1:
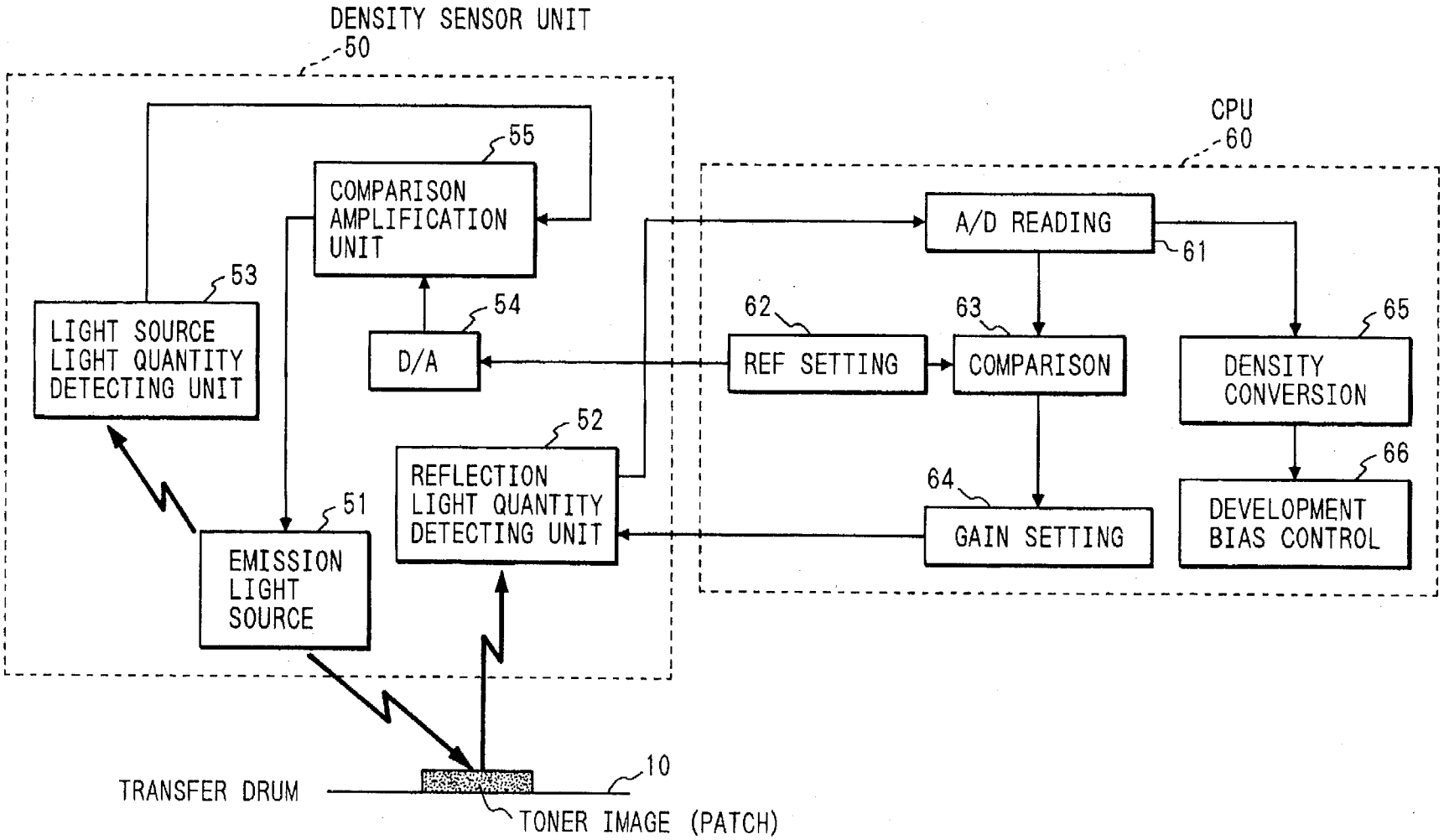
FIG. 1 is a block diagram showing the configuration of an embodiment of the present invention.

FIG. 1 is a view showing the configuration of a first embodiment of the present invention.

Referring to FIG. 1, there is provided a density sensor unit 50 for irradiating a toner image (hereinafter called "patch") formed on the transfer drum 10 with light and sending the quantity of the reflected light therefrom to a CPU 60 which serves to control the developing bias by processing the signal from the density sensor unit 50.

In the density sensor unit 50 there are provided a light source 51 for the density sensor, composed in the present embodiment of an infrared semiconductor laser (infrared LED), and a reflected light quantity detecting unit 52 for detecting the quantity of the reflected light from the patch by an incorporated photosensor element and then converting the detected light quantity to an electrical signal and amplifying the electrical signal by an incorporated light quantity detecting gain amplifier to a signal level set by a gain setting unit 64 of the CPU 60.

A source light quantity detecting unit 53 monitors the light from the light source 51, detects the quantity of the light emitted from the light source 51 by an incorporated photosensor element and then converts the detected light quantity to an electrical signal and amplifies the electrical signal by an incorporated light quantity detecting gain amplifier to a predetermined signal level. There is also provided a D/A converter 54 for converting the digital signal from the CPU 60 into an analog signal for supply to a comparison-amplifier unit 55, which compares the signal from the source light quantity detecting unit 53 with the value set by the D/A converter 54 in order to control the light source 51 in such a manner that the signal becomes equal to the value set by the D/A converter 54.

In the CPU 60, there are provided an A/D reading unit 61 for converting the analog output signal from the density sensor unit 50 into a digital signal; a REF setting unit 62 for setting, in the D/A converter 54 of the density sensor unit 50, a suitable set value corresponding to the formed patch; and a comparator unit 63 for measuring the density of the background of the transfer drum, constituting a reference in the fluctuation adjustment mode to be explained later, and for comparing the digital value from the A/D reading unit 61 with a predicted voltage of the reference background at the set value given by the REF setting unit 62.

A gain setting unit 64 regulates the light quantity detecting gain amplifier in the reflected light quantity detecting unit 52 so as to compress or expand the digital value to the predicted voltage, in case the measured value is observed to fluctuate with respect to the predicted voltage of the reference background in the comparison by the comparator unit 63. A density conversion unit 65 calculates the density of the patch from the output signal of the density sensor unit 50. A developing bias control unit 66 controls an unrepresented developing unit, with respect to the developing bias determined by the density control of the density conversion unit 65.

Figure 21:
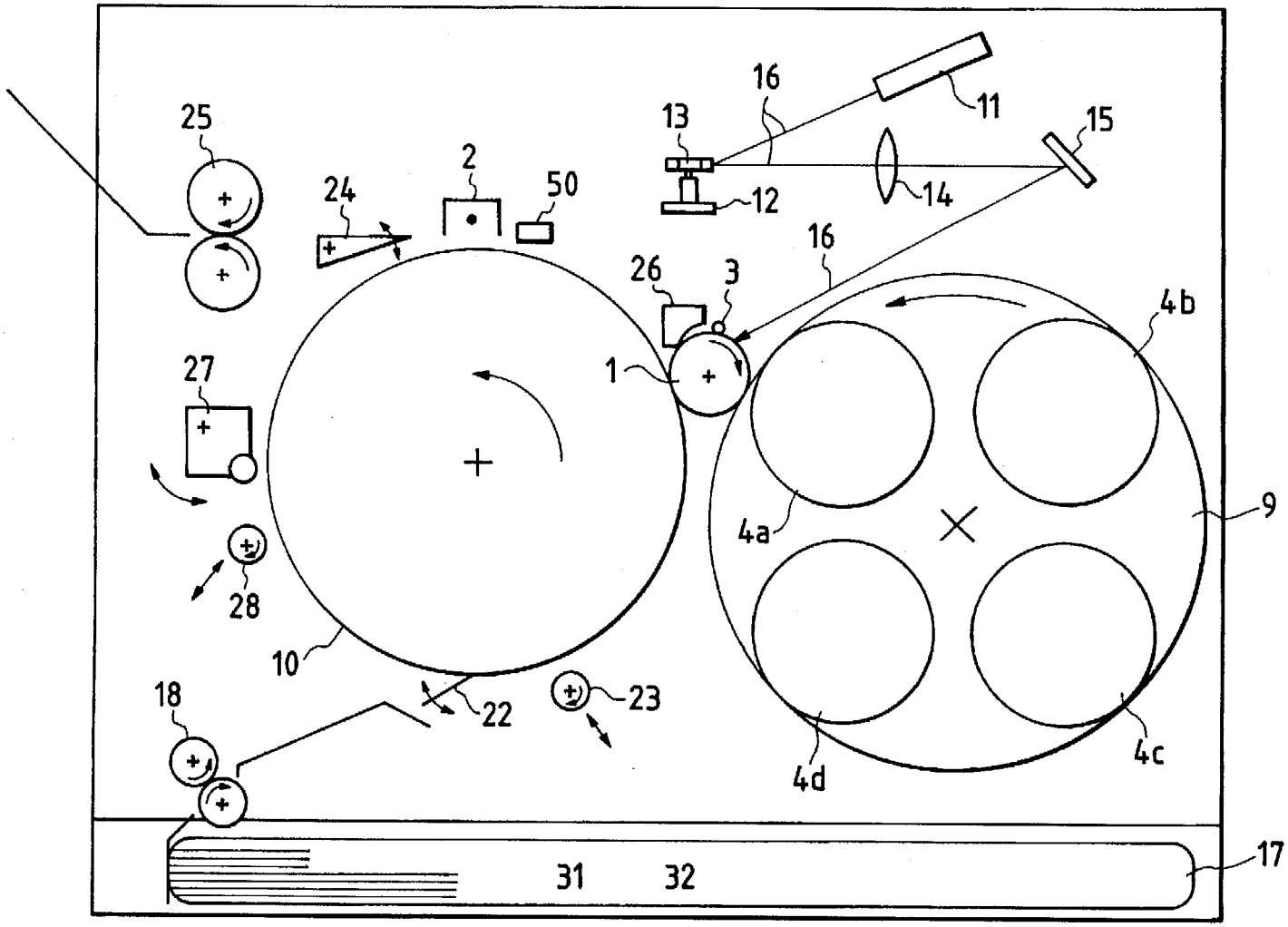
FIG. 21 is a cross-sectional view of a color image forming apparatus in which the density control device is applicable.
Figure 22:
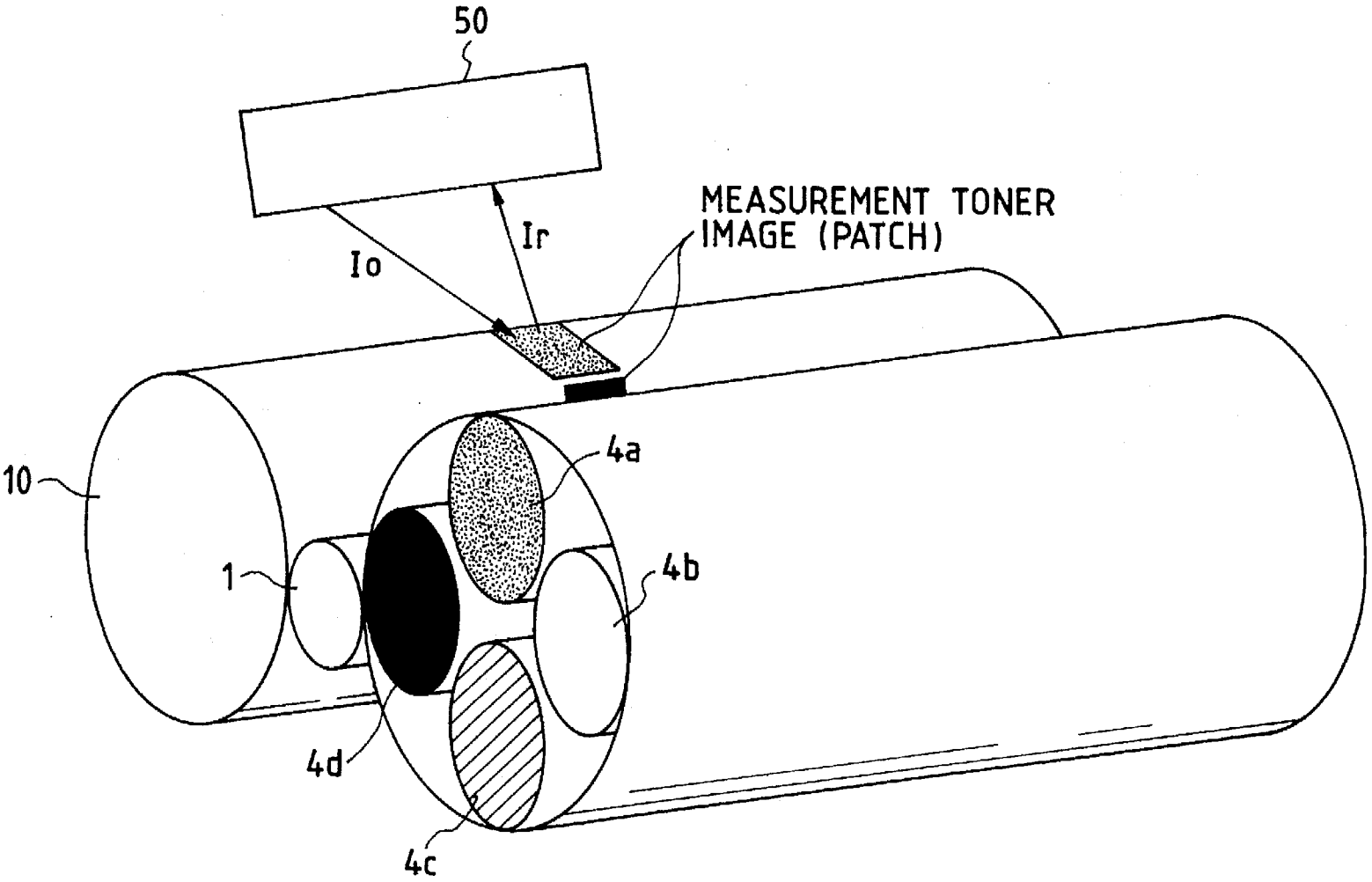
FIG. 22 is a view showing a density sensor unit and related components of the density control device in the color image forming apparatus.

The density control device of the present embodiment, having the above-explained configuration, is applicable for example in an image forming apparatus as shown in FIG. 21. The density sensor unit 50, for measuring the patch on the transfer drum 10, may be so positioned as shown in FIG. 21.

Figure 2:
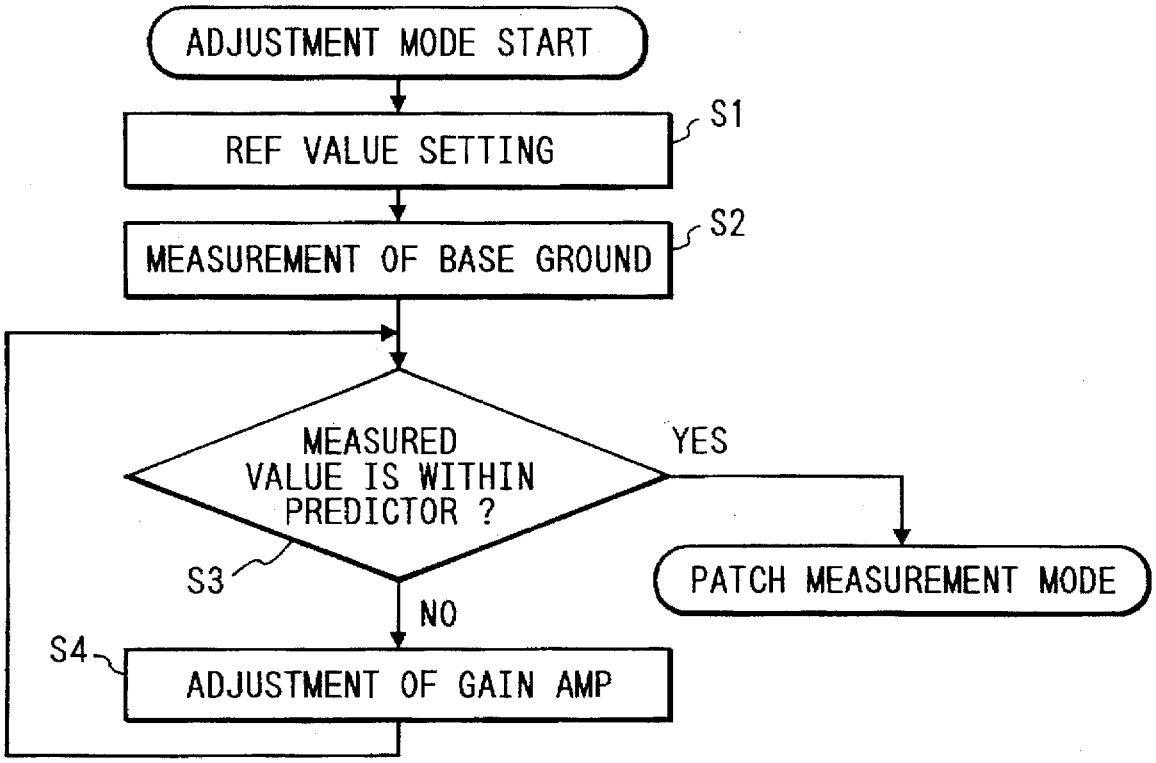
FIG. 2 is a flow chart showing the control sequence of said embodiment.

In the following there will be explained, with reference to a flow chart shown in FIG. 2, the control sequence of the present embodiment of the above-explained configuration in a fluctuation adjustment mode, to be conducted prior to the execution of a patch measurement mode for density control.

In the present embodiment, the fluctuation adjustment mode is started prior to the execution of the patch measurement mode. When the fluctuation adjustment mode is started, the control sequence of the CPU 60 proceeds as shown in FIG. 2. In this state the CPU 60 holds, in advance, a predicted value of the detection level of the reference background in an unrepresented memory, and, in a step S1, the CPU 60 calculates a reference value capable of providing an optimum output amplitude, according to the held predicted value of the detection level of the reference background, and sets the reference value in the reference setting unit 62.

In a next step S2, the CPU 60 measures the reference background and receives an output signal from the reflected light quantity detecting unit 52 of the density sensor unit 50. In a next step S3, the comparator unit 63 compares the received output signal with the reference value set in the preceding step S1, and discriminates whether the output signal is within the predicted range of the CPU. If the detection signal is not within the predicted range (if the received output signal is larger than the set reference value), the light quantity detecting amplifier in the reflected light quantity detecting unit 52 has to be adjusted in order to avoid detection error in the patch measurement mode. Thus, if the detection signal is not positioned within the predicted range, the sequence proceeds to a step S4 to vary the set value of the gain setting unit 64 thereby controlling the amplification gain of the light quantity detecting amplifier of the reflected light quantity detecting unit 52 in such a manner that the detection signal becomes contained within the predicted range. Then the sequence returns to the step S3, and the adjustment of the light quantity detecting amplifier is continued until the measured value of the reference background becomes positioned within the predicted range. The patch measurement mode is started when the measured value is positioned within the predicted range.

Figure 3:
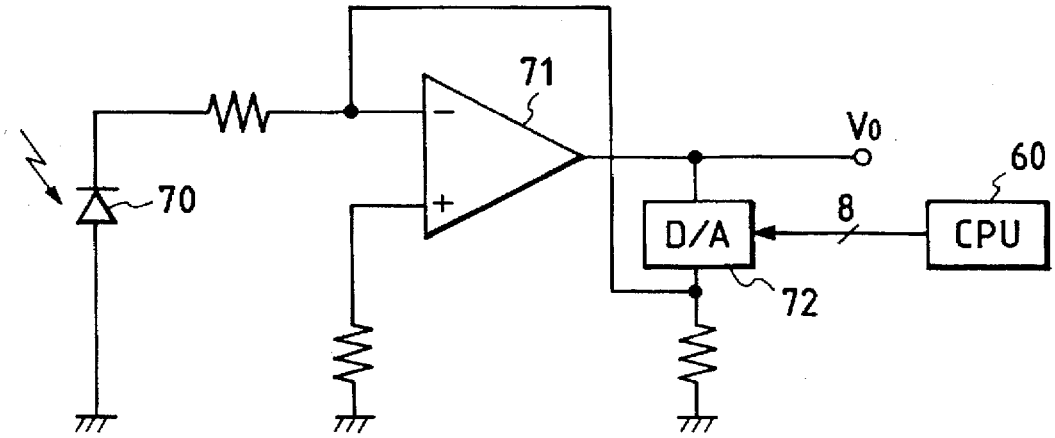
FIG. 3 is a circuit diagram showing the details of a light quantity detecting unit shown in FIG. 1.

FIG. 3 shows the detailed structure of the light quality detecting amplifier of the reflected light quantity detecting unit 52, shown in FIG. 1.

In FIG. 3, there are provided a photosensor element 70 for receiving the reflected light from the transfer drum 10; a light quantity detecting gain amplifier 71 for amplifying the electrical signal from the photosensor element 70; and a D/A converter 72 for converting a digital gain adjustment signal, supplied from the gain setting unit 64 of the CPU 60, into an analog signal. The D/A converter 72 adjusts the gain of the amplifier 71 according to the set value, in such a manner that the measured value obtained from the photosensor element 71 is located within the predicted range, and sends an output signal Vo to the CPU 60.

Also instead of the above-explained adjustment by the CPU 60, there may be utilized manual adjustment by a variable resistor provided in the reflected light quantity detecting unit 56.

In the present embodiment, as explained in the foregoing, the direct adjustment of the gain of the light quantity detecting gain amplifier 71 by the CPU 60 provides correction, in advance, of the fluctuation in the output of the density sensor, resulting for example from the characteristics of the light-emitting element of the light source 51, in the density control of the color image forming apparatus. Also in case the output of the density sensor is lowered for example by the smear on the photosensitive drum of the image forming apparatus, stable density control can always be attained by matching the output level with the reference value.

[2nd Embodiment]

In the foregoing embodiment, the gain setting in the gain setting unit 64 is conducted according to the result of comparison in the comparator circuit 63 shown in FIG. 1, thereby adjusting the output signal level of the density sensor unit 50. However, the present invention is not limited to the foregoing embodiment, and, instead of the configuration for preventing the fluctuation in the output of the density sensor, caused for example by the characteristics of the light-emitting element, through gain adjustment of the light quantity detecting gain amplifier 71 of the reflected light quantity detecting unit 52 in the density sensor unit 50, there may also be adopted control of the emission light quantity of the light-emitting element of the light source 51 for achieving similar output signal control. A second embodiment of the present invention, having such configuration, is illustrated in FIG. 4.

Figure 4:
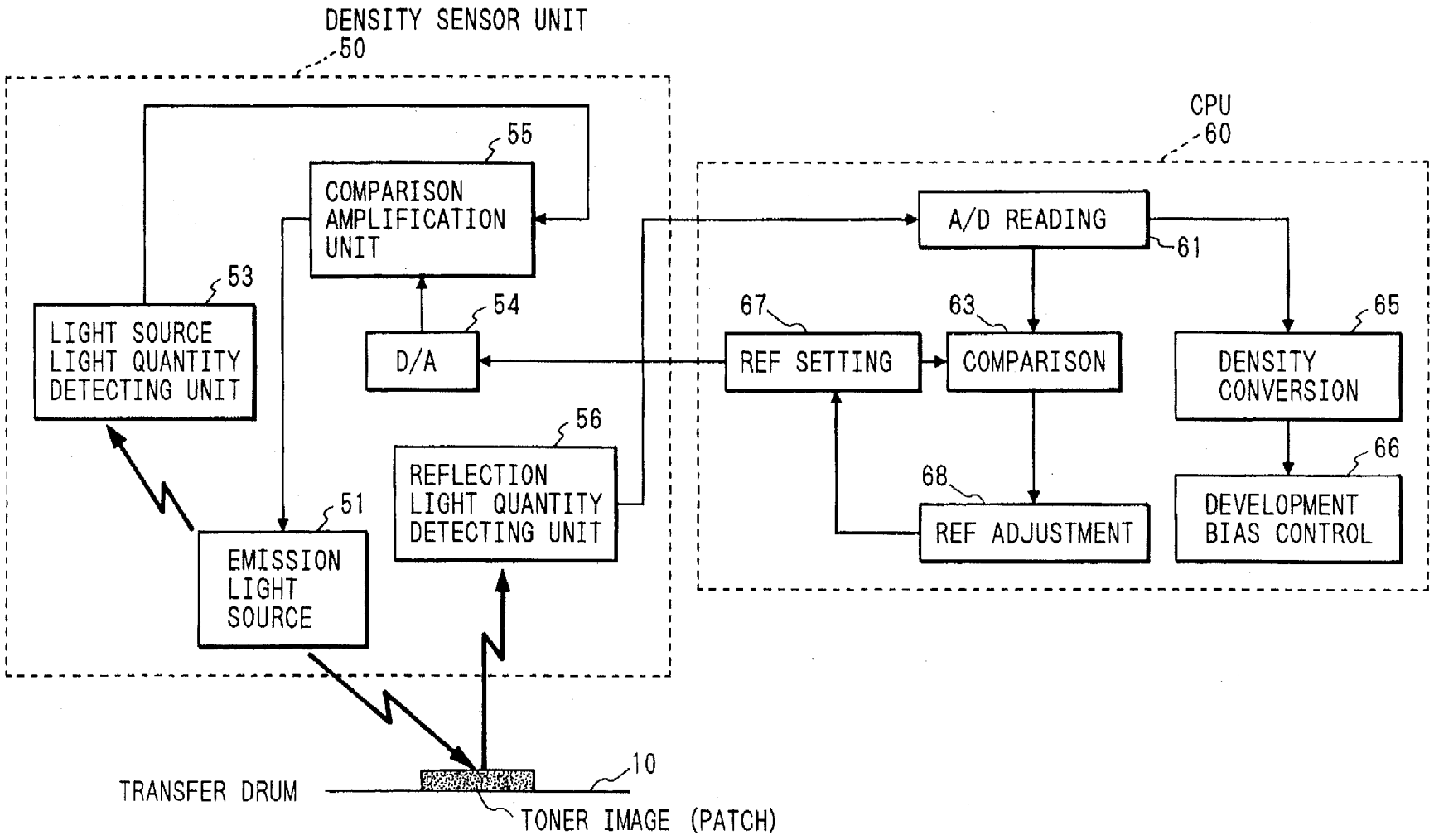
FIG. 4 is a block diagram of a second embodiment of the present invention.

In FIG. 4, components equivalent to those shown in FIG. 1 are represented by corresponding numbers and will not be explained further. In comparison with the configuration shown in FIG. 1, that in FIG. 4 is different in the structure of the reflected light quantity detecting unit 56 of the density sensor unit 50, and in that of a reference setting unit 67 and a reference adjustment unit 68 of the CPU 60. In contrast to the configuration shown in FIG. 1, the reflected light quantity detecting unit 56 of the density sensor unit 50 of the present 2nd embodiment does not effect gain adjustment under the control of the CPU 60 but amplifies the detection signal from the photosensor element with a predetermined gain.

In the 2nd embodiment, the comparator circuit 63 compares the measured value with the set value, and, if the measured value is larger, the set value for the reference setting unit 67 is so varied as to increase the set value of the reference setting unit 67. Then the set value of the reference setting unit 67 is supplied to the D/A converter 54 so as to decrease the amplification gain of the comparator-amplifier unit 55 to reduce the light emission intensity of the light source, thereby maintaining the measured value within the predetermined range.

As explained in the foregoing, the 2nd embodiment can achieve effects similar to those of the 1st embodiment, and the configuration of the reflected light quantity detecing unit 56 of the density sensor unit 50 can be simplified.

As explained in the foregoing, the 2nd embodiment can maintain the measured value within the predicted range by the adjustment of the light emission intensity through the adjustment of the predicted set value of the light quantity, instead of the adjustment of the gain amplifier. In this manner there can be achieved effects similar to those in the 1st embodiment, and the configuration of the reflected light quantity detecting unit 56 of the density sensor unit 50 can be simplified.

[3rd Embodiment]

In the foregoing embodiments, the output signal from the reflected light quantity detecting unit 52 or 56 is received by the CPU 60. However the present invention is not limited to such embodiments, but similar effects can be attained also by fetching the detection signal from the source light quantity detecting unit. A 3rd embodiment of the present invention, in which the detection signal is fetched from the source light quantity detecting unit, will be explained in the following.

Figure 5:
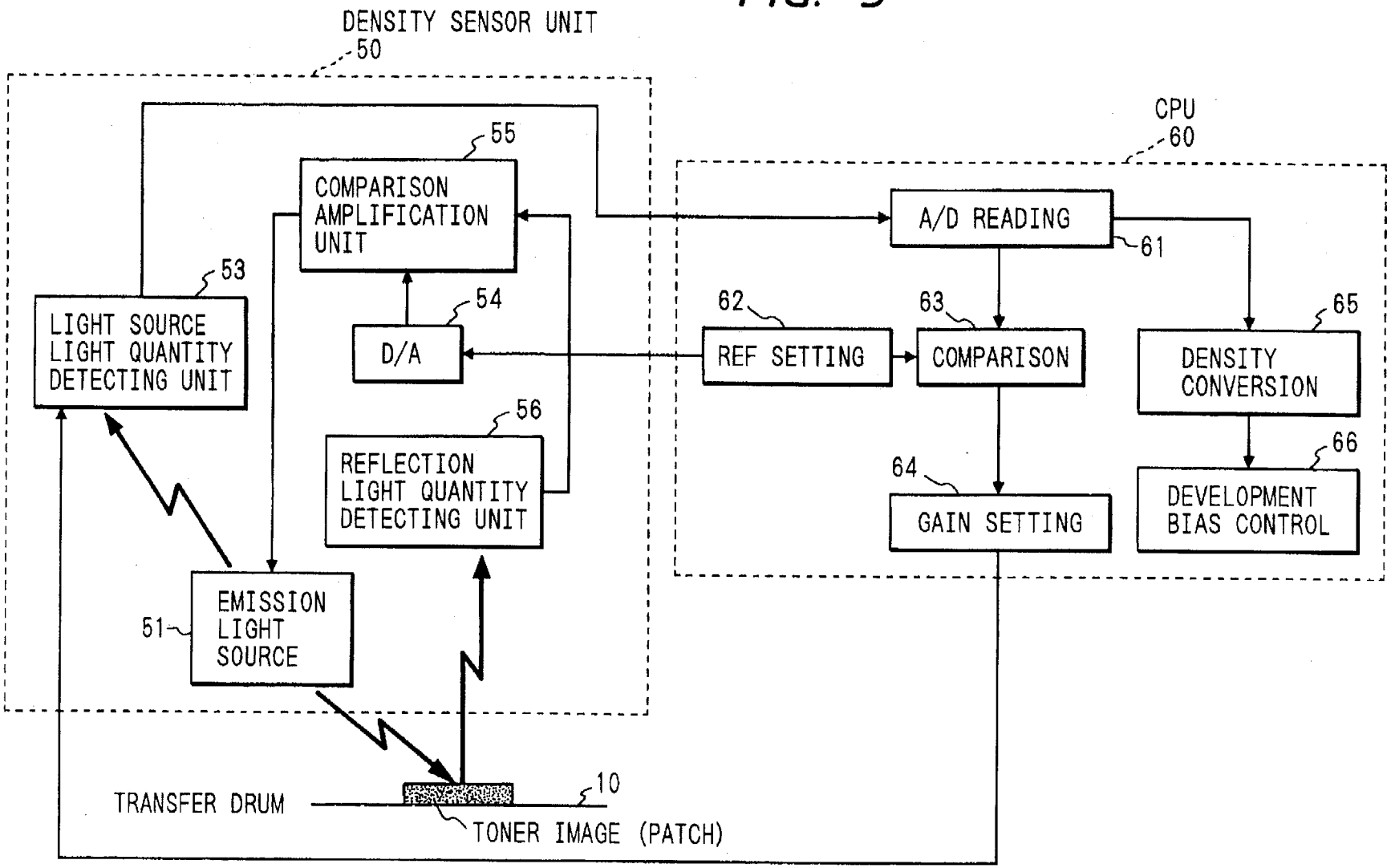
FIG. 5 is a block diagram of a third embodiment of the present Invention.

In FIG. 5 showing the configuration of a 3rd embodiment of the present invention, components equivalent to those in FIGS. 1 and 4 are represented by corresponding numbers and will not be explained further. In the 3rd embodiment, the set value of the gain setting unit 64 in the CPU 60 is supplied to the source light quantity detecting unit 53, which is constructed as shown in FIG. 3 and of which output. signal is supplied to the CPU 60.

In the configuration shown in FIG. 5, the comparison-amplifier unit 55 compares the value set by the D/A converter 54 with the signal from the reflected light quantity detecting unit 56 and controls the light source 51 in such a manner that the detection signal from the reflected light quantity detecting unit 56 becomes equal to the set value of the D/A converter 54, and the light emission quantity is detected by the source light quantity detecting unit 53 and released as the output signal when the detection signal becomes equal to the set value.

Thus, in the fluctuation adjustment mode of the 3rd embodiment, based on the above-explained configuration, the output signal from the source light quantity detecting unit 53 is compared with the predicted set value, and, if the output signal is not contained within the predicted range, the gain of the source light quantity detecting gain amplifier is adjusted by the gain setting unit 64 whereby there can be suppressed the error in measurement, resulting from fluctuation. It is thus rendered possible, as in the foregoing 1st and 2nd embodiments, to correct and resolve, in advance, the error in measurement, resulting from the fluctuation in the measured density in the image forming process.

[4th Embodiment]

In the 3rd embodiment explained above, the output signal level of the density sensor unit 50 is adjusted by the gain setting of the gain setting unit 64, based on the result of comparison by the comparator circuit 63 shown in FIG. 5. However the present invention is not limited to the foregoing embodiment, but, instead of the configuration for preventing the fluctuation in the light emission intensity and in the density sensor output resulting for example from the characteristics of the light-emitting element through the gain adjustment of the light quantity detecting gain amplifier of the source light quantity detecting unit 53 in the density sensor unit 50, there may be adopted the control of the light emission quantity of the light source 51 for attaining similar output signal control. A 4th embodiment of the present invention, constructed in the above-explained manner, is illustrated in FIG. 6.

Figure 6:
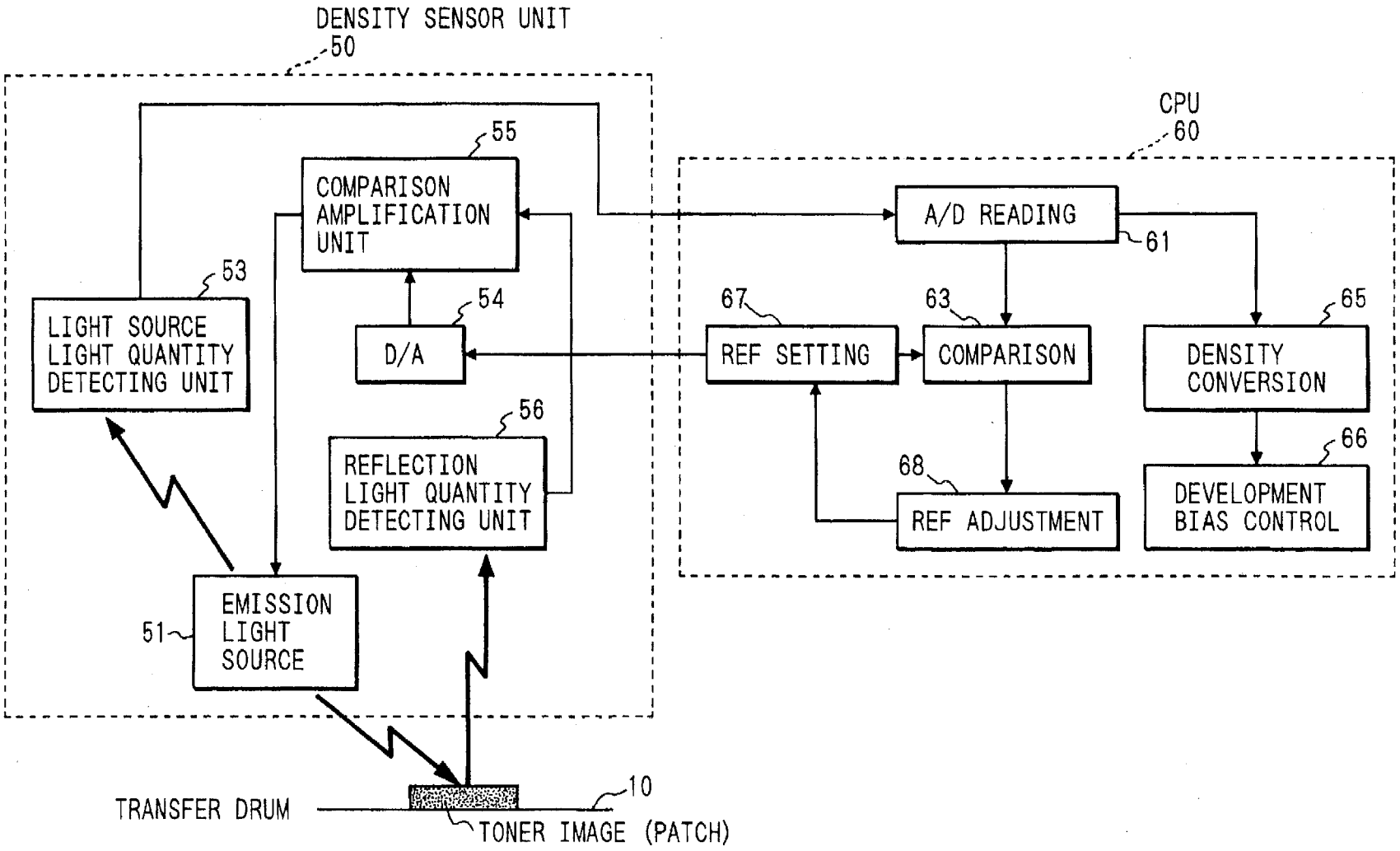
FIG. 6 is a block diagram of a fourth embodiment of the present invention.

In FIG. 6, components equivalent to those in the foregoing 3rd embodiment shown in FIG. 5 are represented by corresponding numbers and will not be explained further. In the configuration shown in FIG. 6, since the output signal adjustment by the CPU 60 is not required, the source light quantity detecting unit in the density sensor unit 50 is so constructed as not to effect particular gain adjustment by the CPU 60 but to amplify the detection signal from the photosensor element with a preset gain. Consequently the source light quantity detecting unit 53 can be constructed similarly as that shown in FIG. 1, but the reference setting unit 67 and the reference adjustment unit 68 of the CPU 60 are constructed differently.

In this 4th embodiment, the comparator circuit 63 compares the detection signal of the source light quantity detecting unit 53 with the set value, and varies the set value of the reference adjustment unit 68 in such a manner that the detection signal becomes equal to the set value, while the set value of the reference setting unit 67 is supplied to the D/A converter 54 to control the amplification gain of the comparison-amplifier unit 55, whereby the output signal is maintained within the predetermined range.

As explained in the foregoing, the 4th embodiment adjusts the predicted value for the detection signal, thereby adjusting the light emission quantity and thus maintaining the measured value within the predicted range. There can thus be attained effects similar to those in the 1st embodiment and the configuration of the source light quantity detecting unit of the density sensor unit 50 can be simplified.

[5th Embodiment]

In the foregoing there have been explained configurations in which the gain adjustment for avoiding fluctuation is executed either in the reflected light quantity detecting unit or in the source light quantity detecting unit. However the present invention is not limited to such embodiments, but such gain adjustment may be made selectively by both units. A 5th embodiment of the present invention, constructed as explained above, will be explained in the following.

Figure 7:
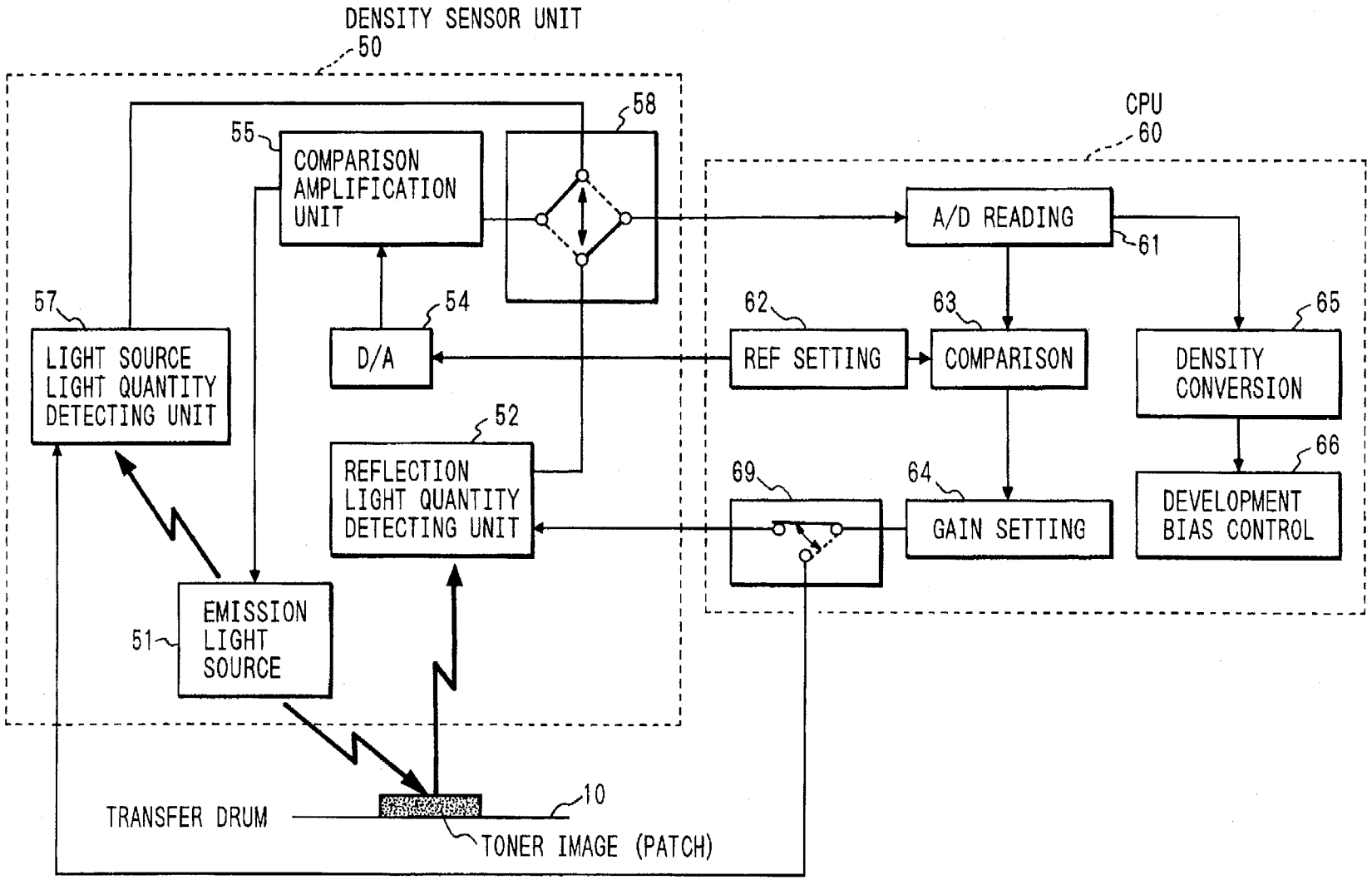
FIG. 7 is a block diagram of a fifth embodiment of the present invention.

FIG. 7 shows the configuration of the 5th embodiment of the present invention, wherein components equivalent to those in the foregoing embodiments are represented by corresponding numbers and will not be explained further. In FIG. 7, there is provided monitor switching means 58 which is composed for example of an analog switch and of which four terminals are connected to the reflected light quantity detecting unit 52, the comparison-amplifier unit 55, the source light quantity detecting unit 57 and the A/D reading unit 61. The switch selects either a state in which the source light quantity detecting unit 57 is connected to the comparison-amplifier unit 55 and the reflected light detecting unit 52 is connected with the AID reading unit 61, or another state in which the reflected light quantity detecting unit 52 is connected with the comparison-amplifier unit 55 and the source light quantity detecting unit 57 is connected with the sensor output to the CPU 60.

A selector switch 69 is connected to the reflected light quantity detecting unit 52 to adjust the gain of the reflected light quantity detecting gain amplifier in a state in which the reflected light quantity detecting unit 52 is connected to the A/D reading unit 61 by the above-mentioned monitor switch means 58. Also in a state in which the source light quantity detecting unit 57 is connected to the A/D reading unit 61 by the monitor switch means 58, the selector switch 69 is connected to the source light quantity detecting unit 57 to adjust the gain of the source light quantity detecting gain amplifier. The selector switch 69 may also be provided in the density sensor unit 50, instead of being provided in the CPU 60 as shown in FIG. 7, with the identical effects.

It is also possible, as already explained in the foregoing 1st to 4th embodiments, to adjust the set value of the reference setting unit 62 instead of the gain adjustment of the light quantity detecting gain amplifier, or to effect manual adjustment by a variable resistor attached to the light quantity detecting gain amplifier.

In the 5th embodiment, the output signal amplitude becomes larger if the sensor output is obtained from the source light quantity detecting unit 57 when the toner image (patch) to be measured is formed with the Bk (black) toner, or if the sensor output is obtained from the reflected light quantity detecting unit 52 when the patch is formed with the color (Y, M or C) toner. Consequently the influence of the fluctuation in the signal value becomes larger when the output signal amplitude is larger. It is therefore possible also to shift the switch 69 so as to adjust the source light quantity detecting gain amplifier for the Bk (black) toner, and to adjust the reflected light quantity detecting gain amplifier for the color (Y, M or C) toner.

In the 1st to 5th embodiments explained in the foregoing, in the density detection of the color image forming apparatus, fluctuation in the output of the density sensor can be prevented, resulting for example from the characteristics of the light-emitting element, through the adjustment of the light quantity detecting gain amplifier. Also in case the density sensor output is lowered for example by the smear on the photosensitive drum, stable density control can be always attained by matching the output level with the reference value in advance.

[6th Embodiment]

In the following there will be explained a 6th embodiment of the present invention with reference to FIGS. 8 and 9 which show the configuration of the 6th embodiment and which differs only in the state of monitor switching means 156.

Figure 8:
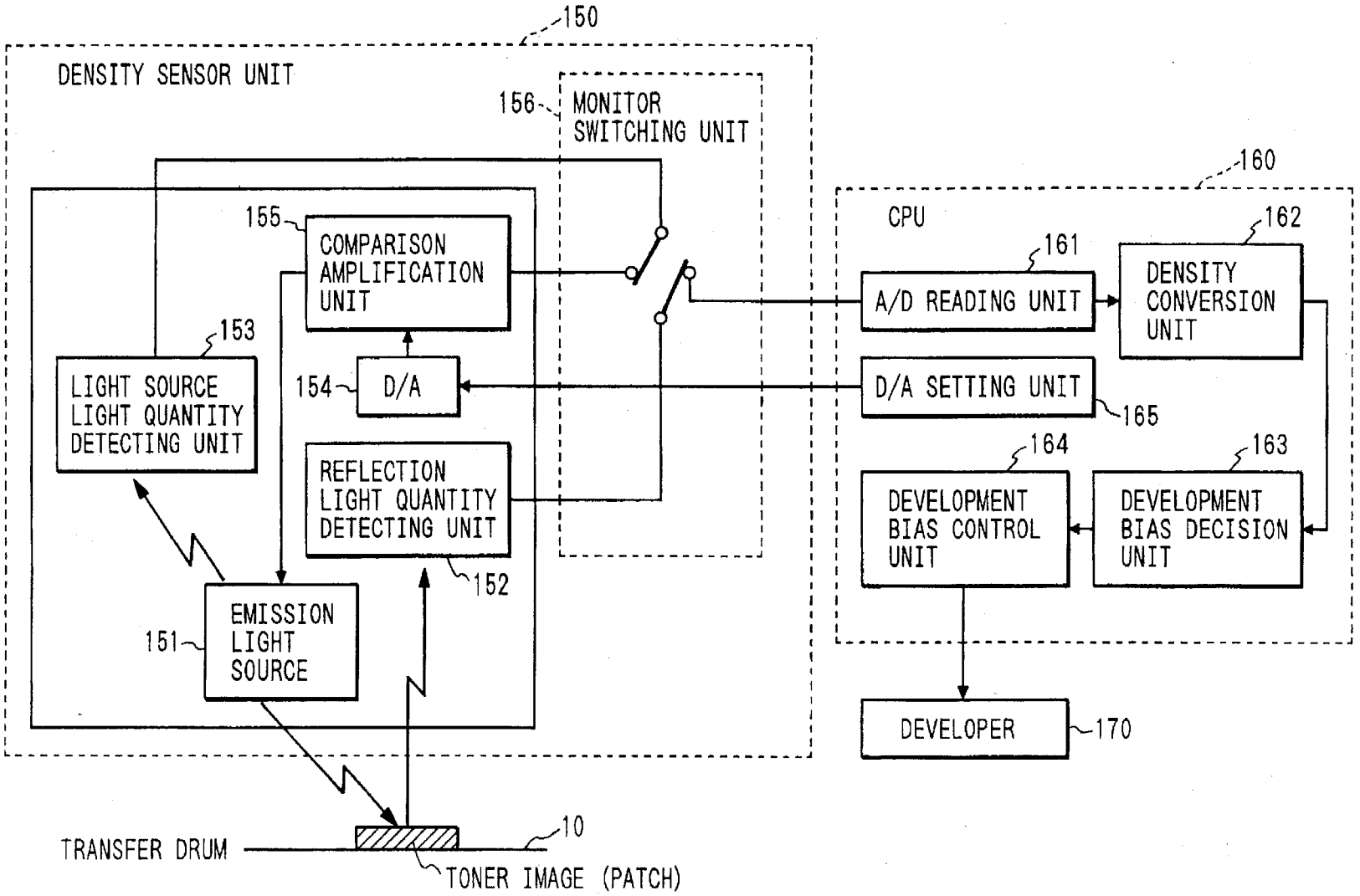
FIGS. 8 and 9 are block diagrams of a sixth embodiment of the present invention.
Figure 9:
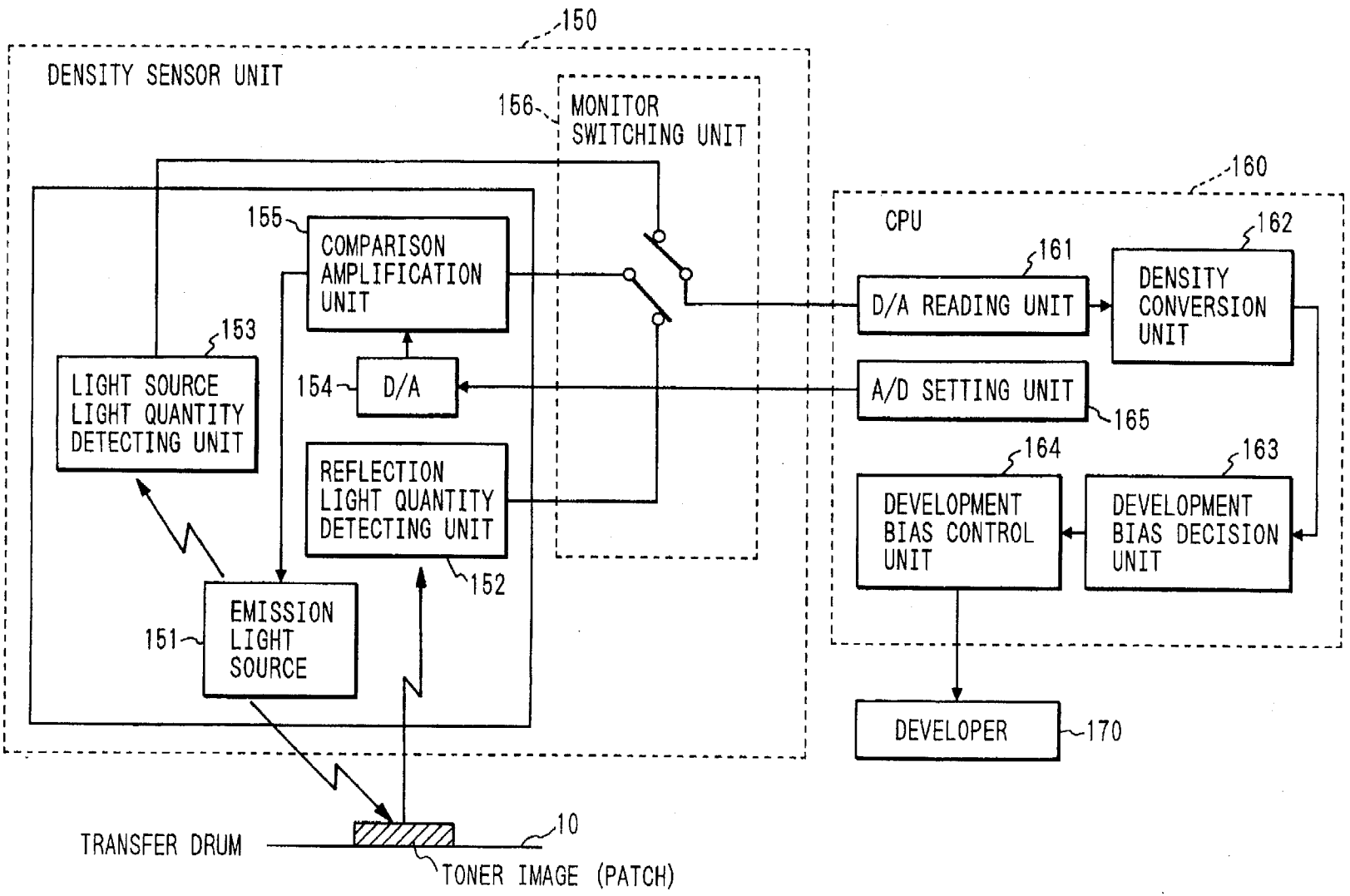

Referring to FIGS. 8 and 9, a density sensor unit 150 irradiates a patch, formed on the transfer drum 10, with light and provides a CPU 160 with a signal indicating the reflected light quantity or the source light quantity.

In the density sensor unit 150 there are provided an infrared LED 151 constituting the light source of the density sensor 150; a reflected light quantity detecting unit 152; a source light quantity detecting unit 153 for monitoring the light from the infrared LED; a D/A converter 154; and a comparator-amplifier unit 155.

Monitor switching means 156, composed for example of an analog switch, selects either a state in which the reflected light quantity detecting unit 152 is connected to the CPU 160 and the source light quantity detecting unit 153 is connected to the comparison-amplifier unit 155, or another state in which the reflected light quantity detecting unit 152 is connected to the comparison-amplifier unit 155 and the source light quantity detecting unit 153 is connected to the CPU 160. In the connection state shown in FIG. 8, the comparison-amplifier unit 155 compares the set value of the D/A converter 154 and the detection signal from the source light quantity detecting unit 153 and controls the light source 151 in such a manner that the detection signal becomes equal to the set value of the D/A converter 154. On the other hand, in the connection state shown in FIG. 9, the comparison-amplifier unit 155 compares the set value of the D/A converter 154 with the detection signal from the reflected light quantity detecting unit 152 and controls the light source 151 in such a manner that the detection signal becomes equal to the set value of the D/A converter 154.

A CPU 160 determines the developing bias by processing the signal from the density sensor unit 150.

In the CPU 160, there are provided an A/D reading unit 161 for converting the analog signal from the density sensor unit 150 into a digital signal; a density conversion unit 162 for calculating the density from the A/D-converted output signal; a developing bias determining unit 163 which determines the developing bias based on the density data and which stores optimum developing bias values for the reference densities; and a developing bias control unit 164 for controlling the developing unit 170 according to thus determined developing bias.

Now the density control in the 6th embodiment will be explained with reference to FIG. 10, which is a flow chart showing the control sequence of the 6th embodiment of the above-explained configuration.

At first a step S11 discriminates whether the patch to be measured is composed of color toner, or whether the detection signal of the reflected light quantity detecting unit 152 has a high level, indicating a high reflectance of the toner. In case the patch is formed with color toner, or the detection signal of the reflected light quantity detecting unit 152 exceeds a predetermined threshold value, indicating a high reflectance of the toner, a step S12 selects the reflected light quantity detecting method, whereupon the monitor switching means 156 is set at the state shown in FIG. 8 in which the reflected light quantity detecting unit 152 is connected to the sensor output and the source light quantity detecting unit 153 is connected to the comparator amplifier unit 155.

In a next step S13, the CPU 160 determines the density of the patch to be formed, then sets the light emission intensity in a D/A setting unit 165 according to thus determined density, and activates the light source 151 with a predetermined intensity. Then a step S14 starts the patch measurement, a step S15 reads the detection signal from the reflected light quantity detecting unit 152, and a step S16 calculates the density value of the patch by a process for color toner data in density conversion unit 162.

In a next step S17, the developing bias decision unit 163 determines the optimum developing bias from the calculated density value, and, in a step S18, the developing bias control unit 164 controls the developing unit 170 according to thus determined bias.

On the other hand, if the step S11 identifies that the patch is composed of black toner or the reflectance of toner is low, the sequence proceeds to a step S20 to select the source light quantity detecting method, whereupon the monitor selecting means 156 is set at the state shown in FIG. 9 in which the reflected light quantity detecting unit 152 is connected to the comparison-amplifier unit 155 and the source light quantity detecting unit 153 is connected to the sensor output. Then a step S21 sets the light emission intensity in the D/A setting unit 165 so as to obtain a voltage of the reflected light quantity corresponding to the predetermined patch density; and activates the light source 151 with the predetermined intensity.

A next step S22 starts the patch measurement, then a step S23 read the detection signal from the source light quantity detecting unit 153, and a step S24 detects the light quantity of the light source at the patch measurement and effects the processing for black toner data in the density conversion unit 162 of the CPU 160, thereby calculating the density value of the patch. Subsequently the sequence proceeds to the steps S17 and S18 for determining the optimum developing bias from said density value and controlling the developing unit.

Figure 11:
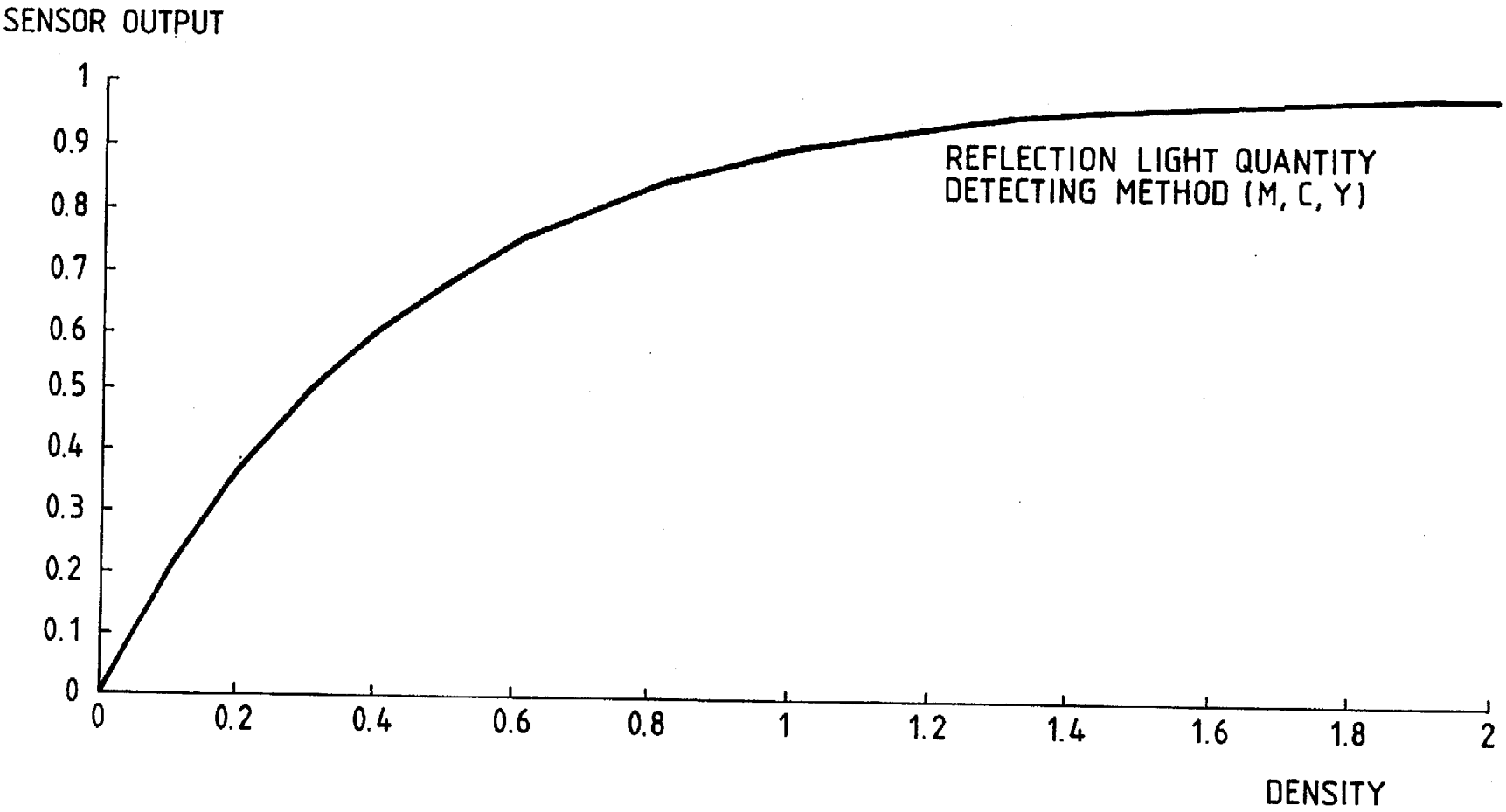
FIGS. 11 and 12 are charts showing the output of a density sensor in the reflected light quantity detecting method employed in the sixth embodiment.
Figure 12:
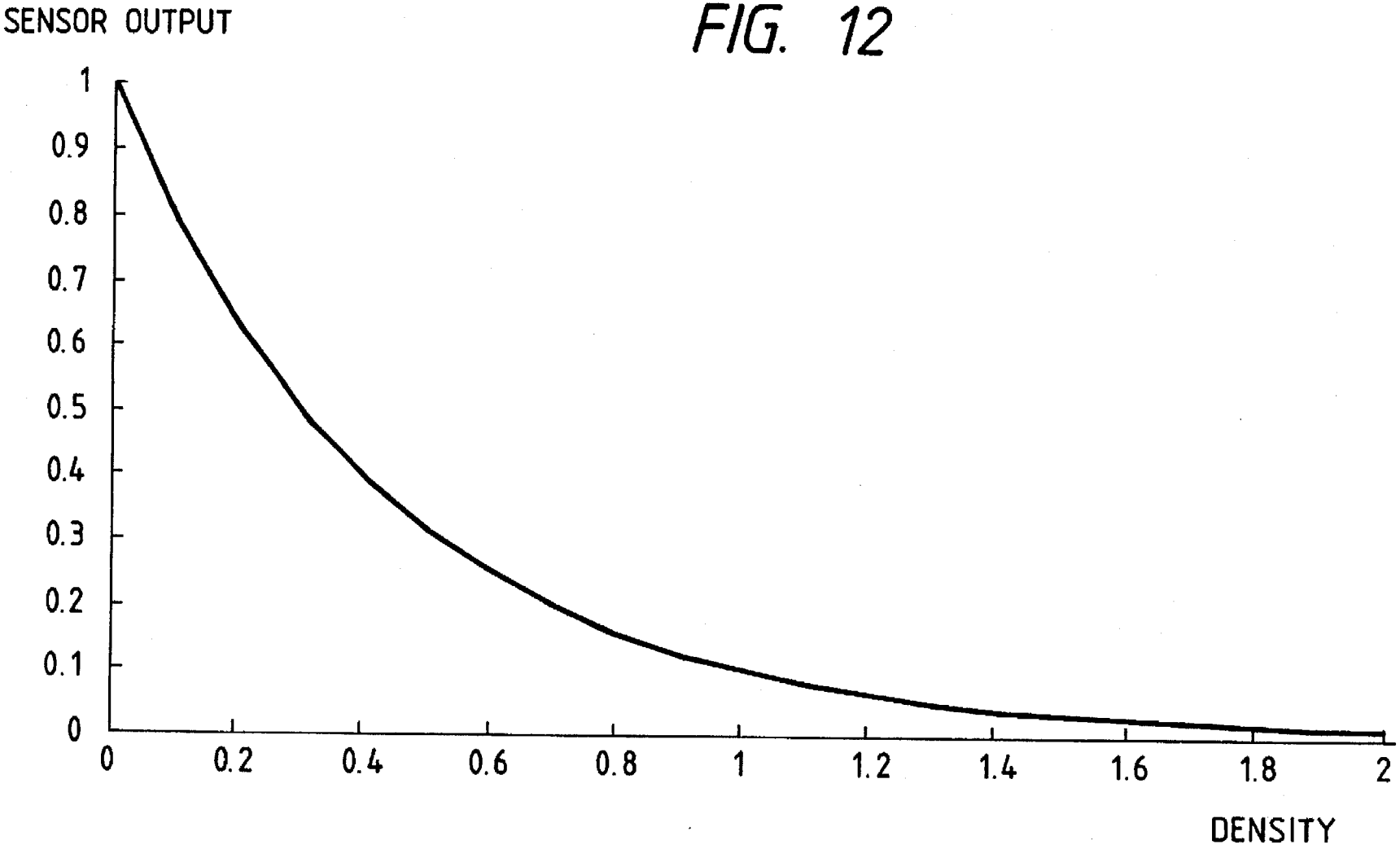

FIG. 11 shows the relationship between the measured density of the color toner and the sensor output, in case the detection signal of the reflected light quantity detecting unit 152 is selected as the sensor output. A high sensor output can be obtained in the infrared region as the color toner is reflective in that region. On the other hand, FIG. 12 shows the relationship between the measured density of black toner and the sensor output. A high-level sensor output can be obtained when the measured density is low. More specifically, as shown in FIG. 12, such sensor output is effective in a region of a higher reflectance, for example in a density region from 0 to 0.7, because the black toner absorbs the infrared light.

Thus, in the 6th embodiment, a high sensor output can be obtained by the use of the reflected light quantity detecting method in case the color toner, showing high reflectivity, is employed.

On the other hand, in case the black toner, showing low reflectivity, is employed, the reflected light quantity can be controlled constant by the use of the source light quantity detecting method.

Figure 13:
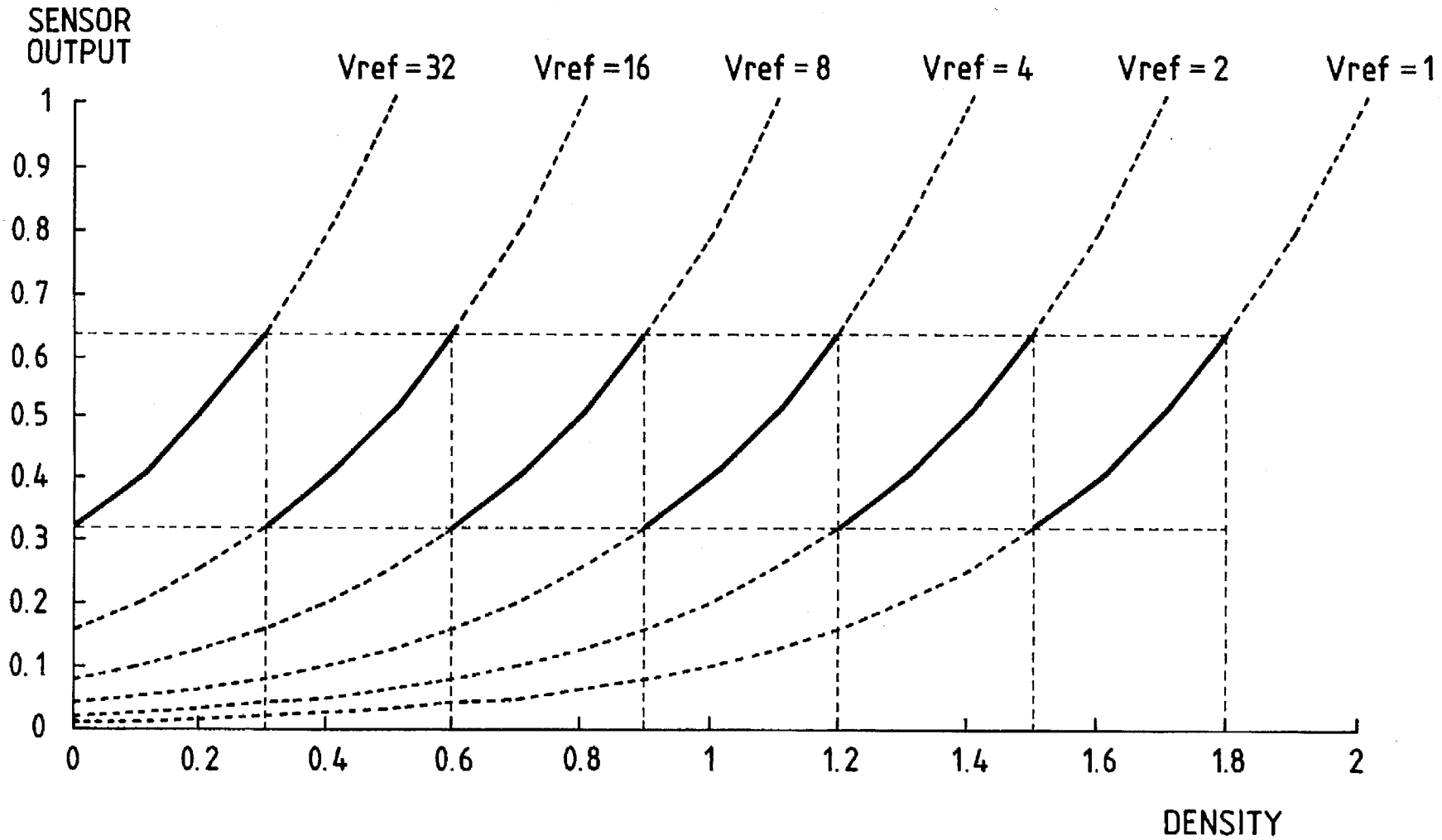
FIG. 13 is a chart showing the output of a density sensor in the source light quantity detecting method employed in the sixth embodiment.

FIG. 13 shows the relationship between the measured density of the black toner and the sensor output, in case the detection signal of the source light quantity detecting unit 153 is selected as the sensor output. In such case, as the circuit is so controlled as to maintain the reflected light quantity constant, the emission light quantity increases with the increase in the toner density. Consequently the sensor output increases with the increase in the toner density. In FIG. 13, the voltage Vref corresponding to the reflected light quantity can be set variably by the D/A converter 154, so that there can be attained an advantage of obtaining a same sensor output level in any density region.

In the following there will be explained the methods of calculating the density from the color toner data and black toner data, and determining the developing bias from the calculated density.

At first there will be explained the method of calculation.

Definition of Density

The density D of a light reflecting member in a reflective optical system can be generally defined by the following equation (A), for an incident light intensity Io from a light source and a reflected light intensity Ir from the light reflecting member (for example patch) irradiated by the incident light:

$$D=-\log_{10}(Ir/Io) \quad (A)$$

This equation (A) can be developed into an equation (1) to be explained later, and the density of the black toner can be given by an equation (6) to be explained later.

Also the equation (A) can be developed to provide the following equation (B):

$$(Ir/Io)=10^{-D} \quad (B)$$

which defines the absorbance of the light reflecting member as a function of the indicent light Io and the reflected light Ir and is used in case the reflecting member is strongly absorptive, such as the black toner.

On the other hand, since the color toner is reflective, and since the reflectance of a light reflecting member satisfies a relation:

$$(\text{reflectance})+(\text{absorbance})=1$$

the following equation is given for the color toner corresponding to the equation (B):

$$(Ir/Io)=1-10^{-D} \quad (C)$$

which can be considered as a variation of an equation (7) to be explained later. Thus the density of the color toner is given by an equation (14) to be explained later.

In the following there will be explained the method of determining the developing bias from the calculated density.

Figure 23:
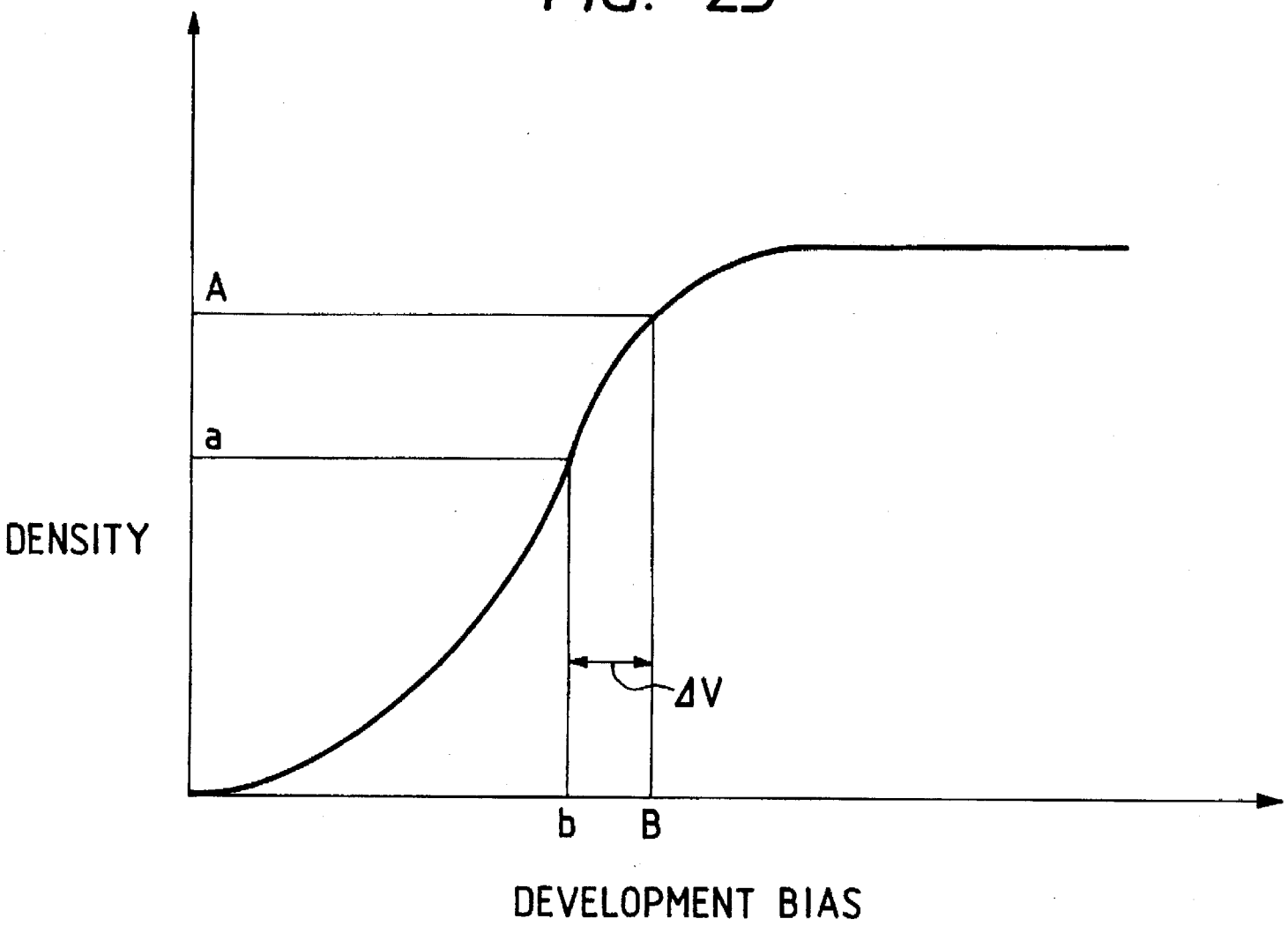
FIG. 23 is a chart showing a developing bias-density table in the seventh embodiment.

The CPU of the present embodiment stores, in advance, a (developing bias)–(density) relationship as shown in FIG. 23 in the form of a table. In case the CPU intends to form a patch with a density A but the density of the formed patch read by the density sensor is a, the CPU judges that the anticipated density A has been changed to a and increases the developing bias by ΔV for correcting the difference.

The selected developing bias determines the toner supply amount in the developing unit, and the image development on the image bearing member is conducted with such toner supply amount to achieve a desired control.

In the present embodiment, as explained in the foregoing, density measurement can always be achieved with an optimum method, enabling to provide a high sensor output, in any density region, so that a very high precision can be attained in the density measurement.

[7th Embodiment]

The color image forming apparatus explained in the foregoing is susceptible to differing environmental conditions, particularly humidity, resulting in fluctuation in output image density or in the reproducibility of tonal rendition. One of the causes for such phenomena is the dependence of transfer characteristics on humidity. For obtaining a constant transfer current, the transfer bias voltage has to be varied within a range from 2,000 to 4,000 V, and a 7th embodiment of the present invention, incorporating such improvement will be explained in the following.

Figure 14:
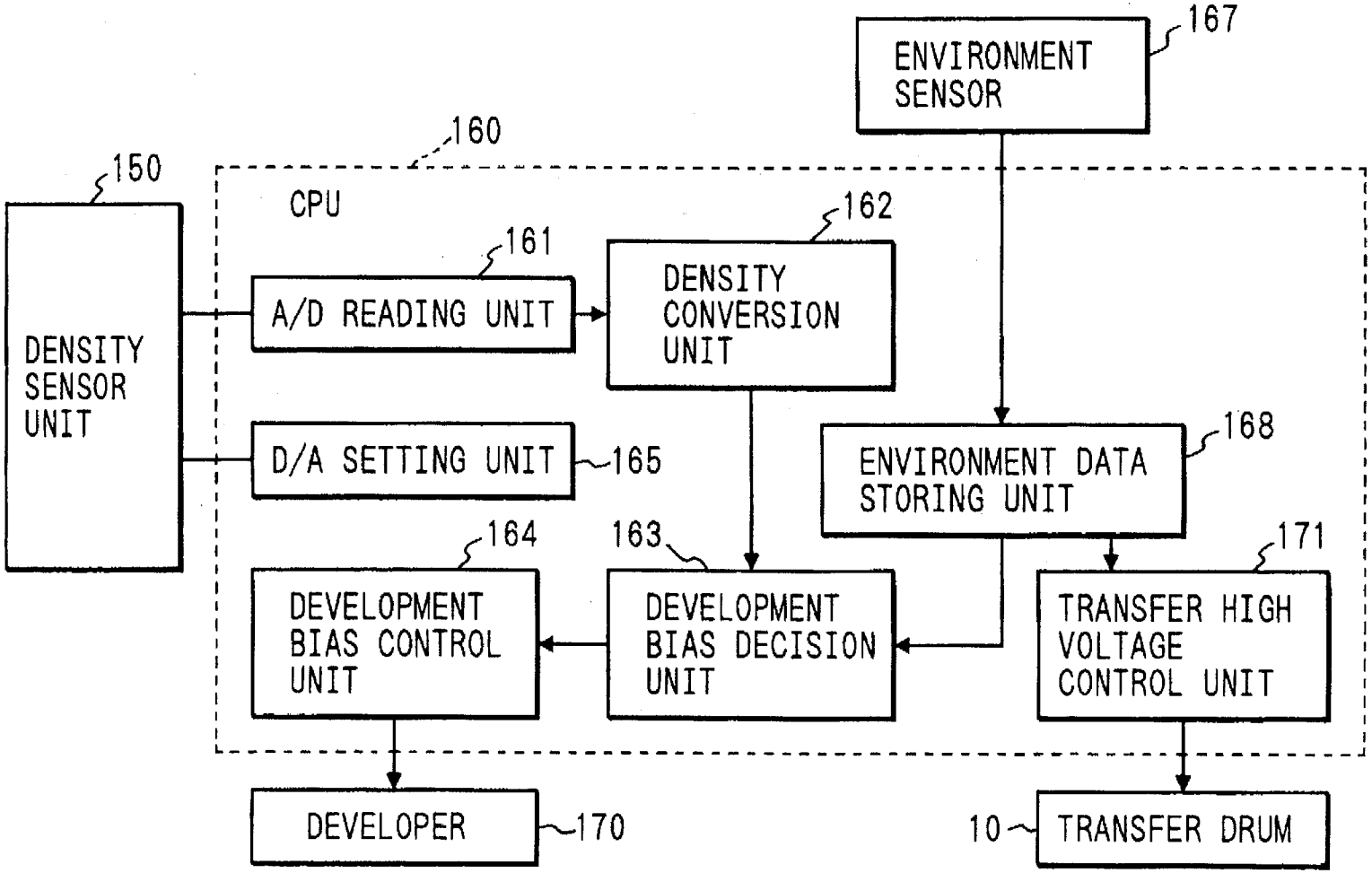
FIG. 14 is a block diagram of a seventh embodiment of the present invention.

FIG. 14 is a block diagram showing the configuration of the 7th embodiment, wherein components equivalent to those in the 6th embodiments are represented by corresponding numbers and will not be explained further.

In FIG. 14, an environment sensor 167 detects the humidity of paper in the apparatus and the surface humidity of the transfer drum. An environment data storing unit 168 stores, in advance, data on at least three situations, i.e. a high temperature-high humidity situation, a normal temperature-normal humidity situation, and a low temperature-low humidity situation, and determines the developing bias, in each of such situations, according to a characteristic curve representing the relationship between the density and the optimum developing bias. A transfer high voltage control unit 172 controls the transfer drum 10 according to the data from the environment data storing unit 168.

Figure 10:
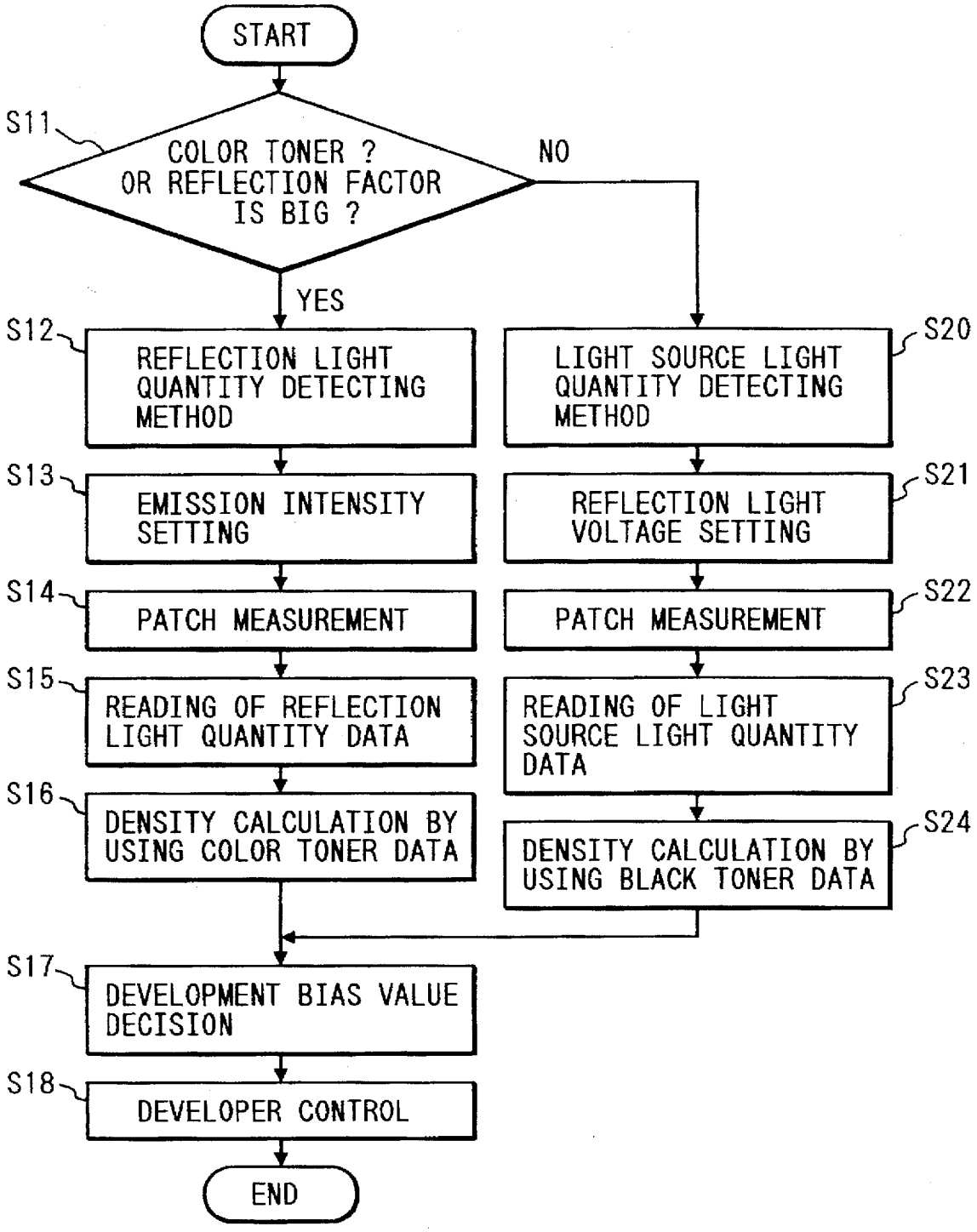
FIG. 10 is a flow chart showing the control sequence of the sixth embodiment.
Figure 15:
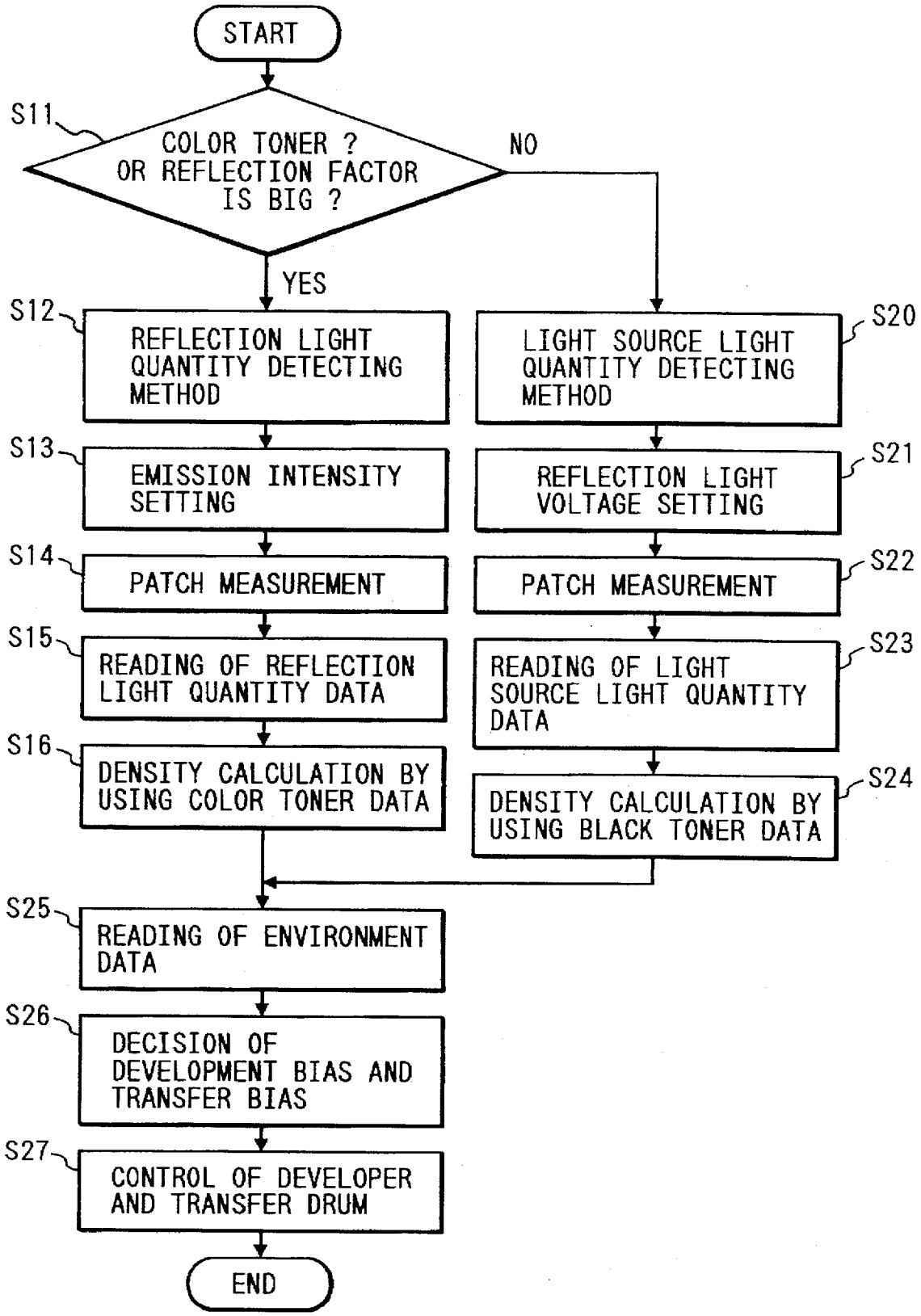
FIG. 15 is a flow chart showing the control sequence of the seventh embodiment.

In the following there will be explained the control sequence of the 7th embodiment of the above-explained configuration, with reference to a flow chart shown in FIG. 15, in which steps same as those of the 6th embodiment in FIG. 10 are represented by same numbers and will not be explained further. In the present 7th embodiment, the control sequence proceeds to a step S25 after the step S16 or S24.

After the density calculation of the color toner patch or the black toner patch, the CPU 160, in the step S25, fetches the environmental data by the environment sensor 167 and determines, in a subsequent step S26, the optimum developing bias and transfer bias under the fetched environmental conditions, by referring to the data stored in the environment data storing unit 168 based on the environmental data detected by the environment sensor 167.

A next step S27 controls the bias voltages of the developing unit 170 and the transfer drum 10, according to the optimum developing bias and transfer bias determined in the step S27.

Figure 24:
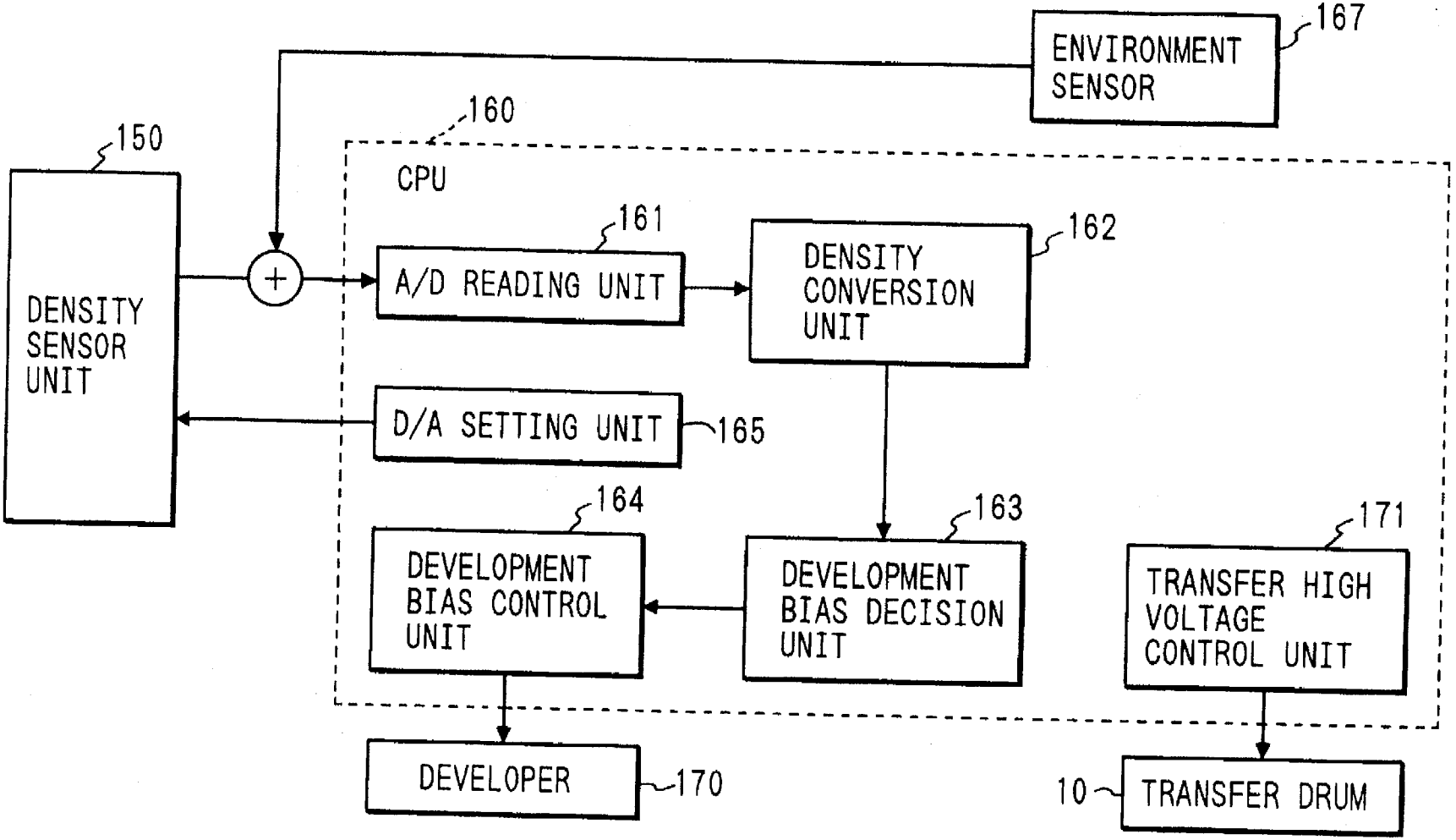
FIG. 24 is a block diagram showing a variation of the seventh embodiment.
Figure 25:
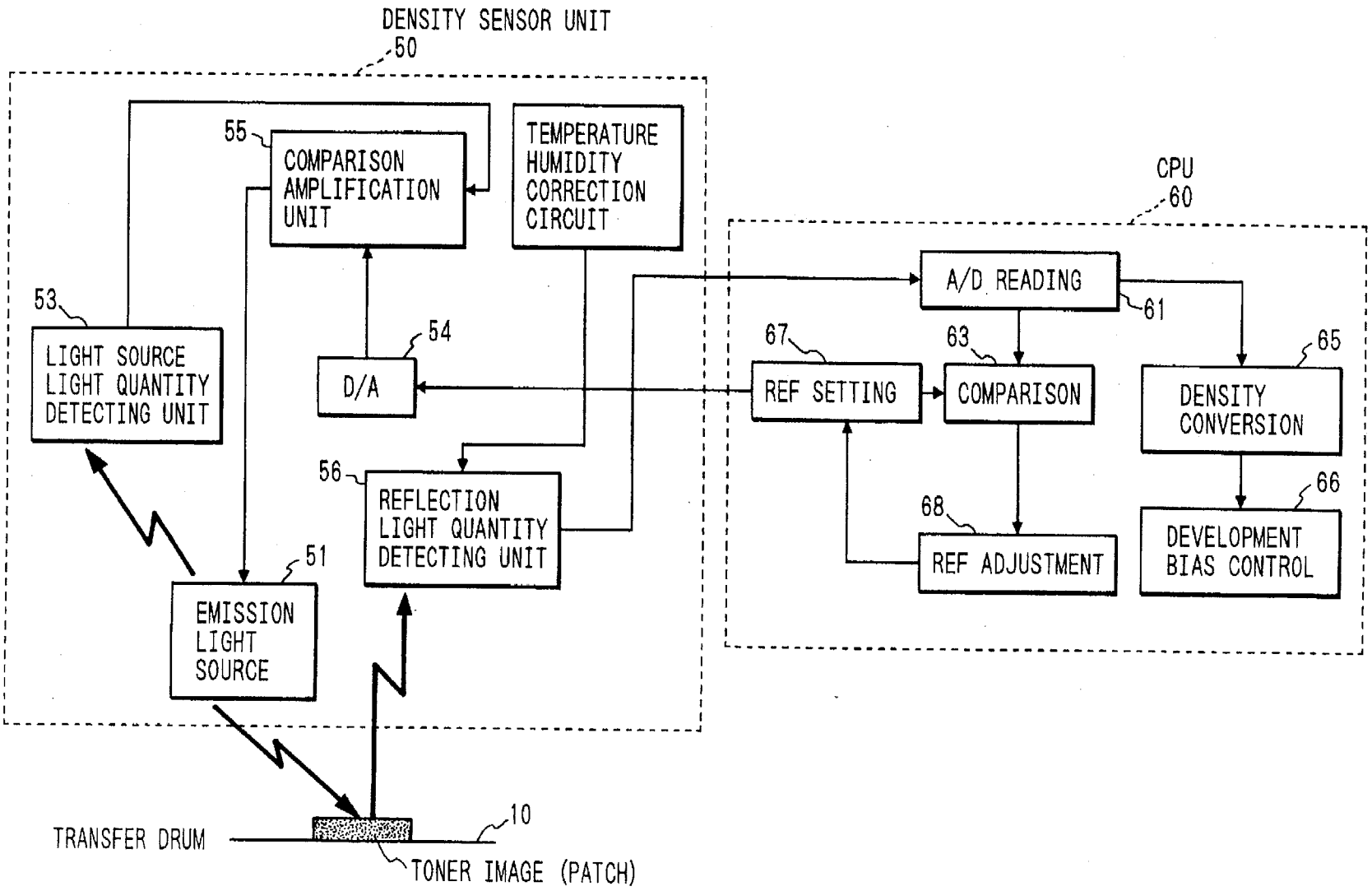
FIG. 25 is a block diagram showing another variation of the seventh embodiment.

Specific examples of the configuration of the 7th embodiment are shown in FIGS. 24 and 25. In a configuration shown in FIG. 24, the information from the environment sensor is given to the output signal of the density sensor whereby the variation in the output of the density sensor, resulting from a variation in the environmental conditions, can be compensated without storage of the environmental data in the CPU.

Also a similar effect can be attained by a configuration shown in FIG. 25, in which a temperature-humidity correcting circuit is incorporated in the density sensor and connected to the sensor output for achieving output correction.

As explained in the foregoing, the 7th embodiment can achieve density control usable even under the presence of a variation in the environmental conditions. The process of the 7th embodiment is adaptable, as shown in FIG. 15, to either of the reflected light quantity detecting method and the source light quantity detecting method as employed in the 6th embodiment.

[8th Embodiment]

Figure 16:
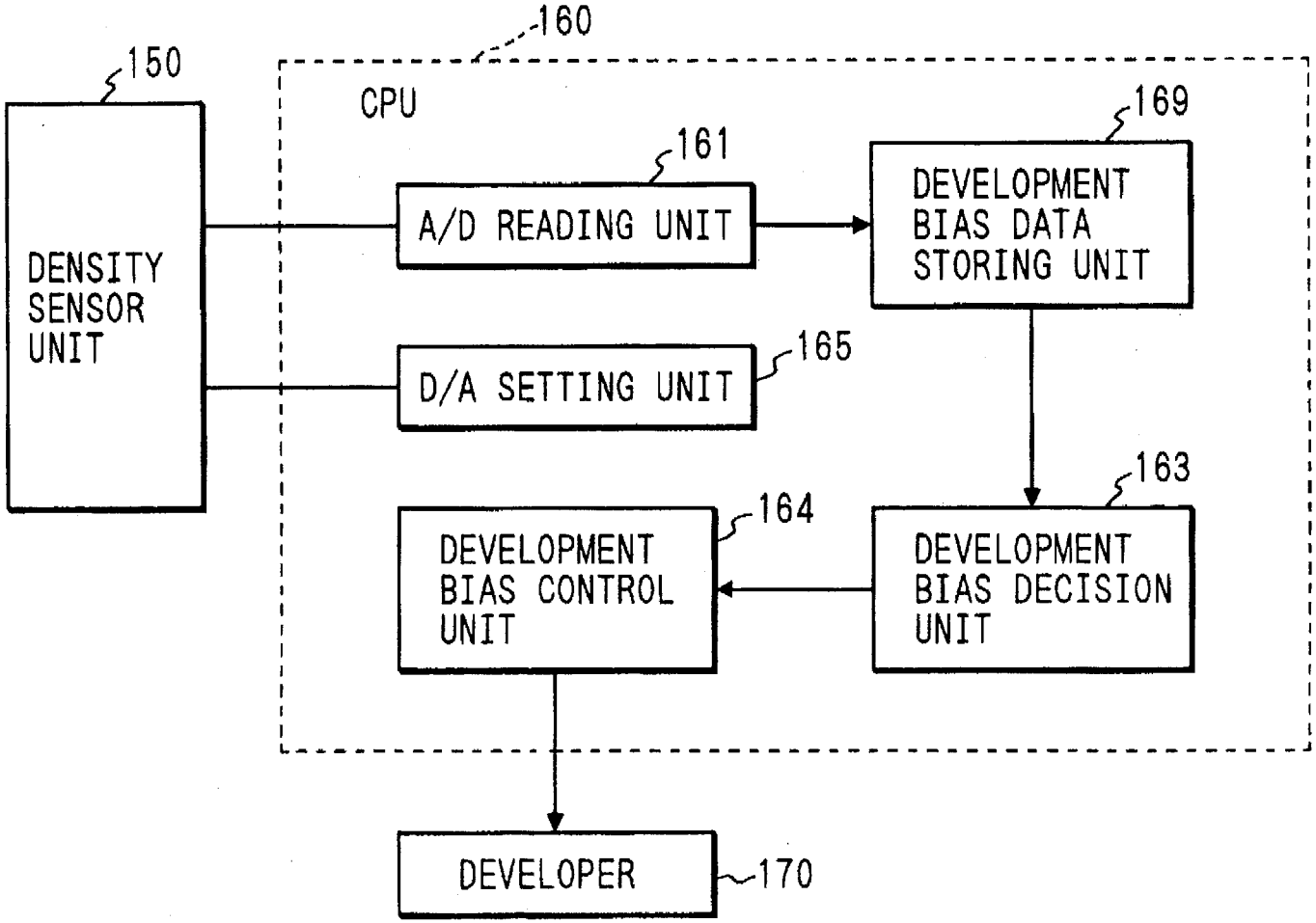
FIG. 16 is a block diagram of an eighth embodiment of the present invention.

FIG. 16 shows the configuration of an 8th embodiment of the present invention, wherein components equivalent to those in the foregoing embodiments are represented by corresponding numbers and will not be explained further.

Developing bias data storing unit 169 stores in advance, in the form of a table, the optimum developing bias values corresponding to the output values of the density sensor 150 at the A/D reading unit 161. A developing bias decision unit 163 determines the developing bias value, referring to the table stored in said developing bias data storing unit 169. Such configuration allows to control the developing bias without density conversion.

Figure 17:
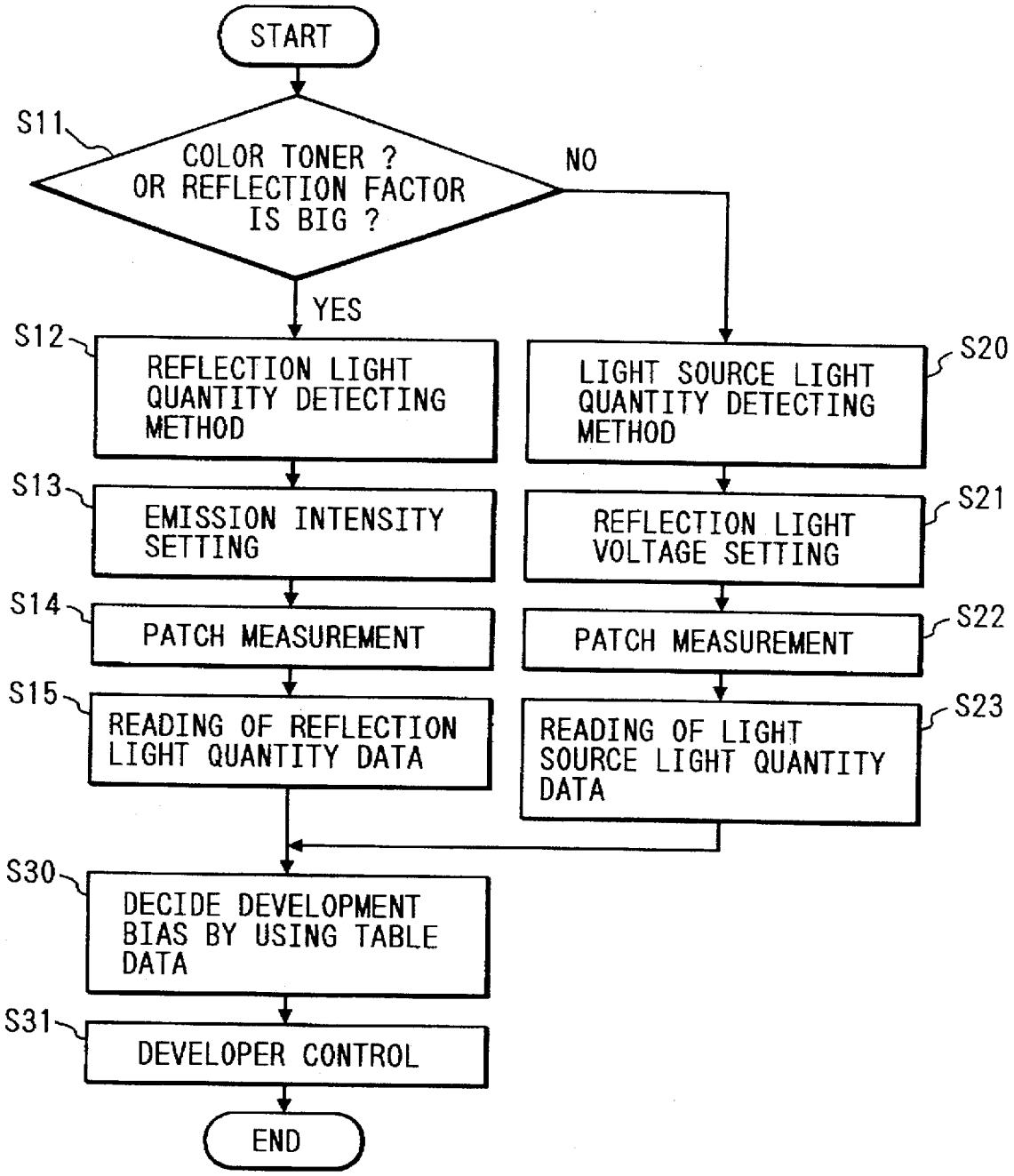
FIG. 17 is a flow chart showing the control sequence of the eighth embodiment.

The density control sequence of the 8th embodiment of the above-explained configuration will be explained in the following, with reference to a flow chart shown in FIG. 17, wherein steps same as those in FIG. 10 are represented by same numbers and will not be explained further. In the 8th embodiment, the control sequence proceeds to a step S30 from the step S15 or S23.

In the 8th embodiment, the CPU 160 holds a table of the optimum developing bias values in the developing bias data storing unit 169, and effects patch measurement by the density sensor unit 150 in the steps S14 and S22 and fetching the detection data in the CPU 160 in the steps S15 and S23. A next step S30 determines the developing bias by referring to the optimum developing bias values in the developing bias data storing unit 169, and the developing unit 170 is controlled with the developing bias determined in the step S30.

Also in this 8th embodiment, there may be provided the environment sensor 167, the environment data storage unit 168 and the transfer high voltage control unit 171 as in the 7th embodiment. In such case the developing bias data storage means 169 holds table corresponding to the aforementioned three situations, for determining the developing bias.

As explained in the foregoing, the present embodiment enables adaptation to various situations simply by a variation in the registered content of the table, without density calculation. For example the fluctuation in the characteristics among different apparatus can be suitably compensated by a variation in the registered content of the table.

[9th Embodiment]

Figure 18:
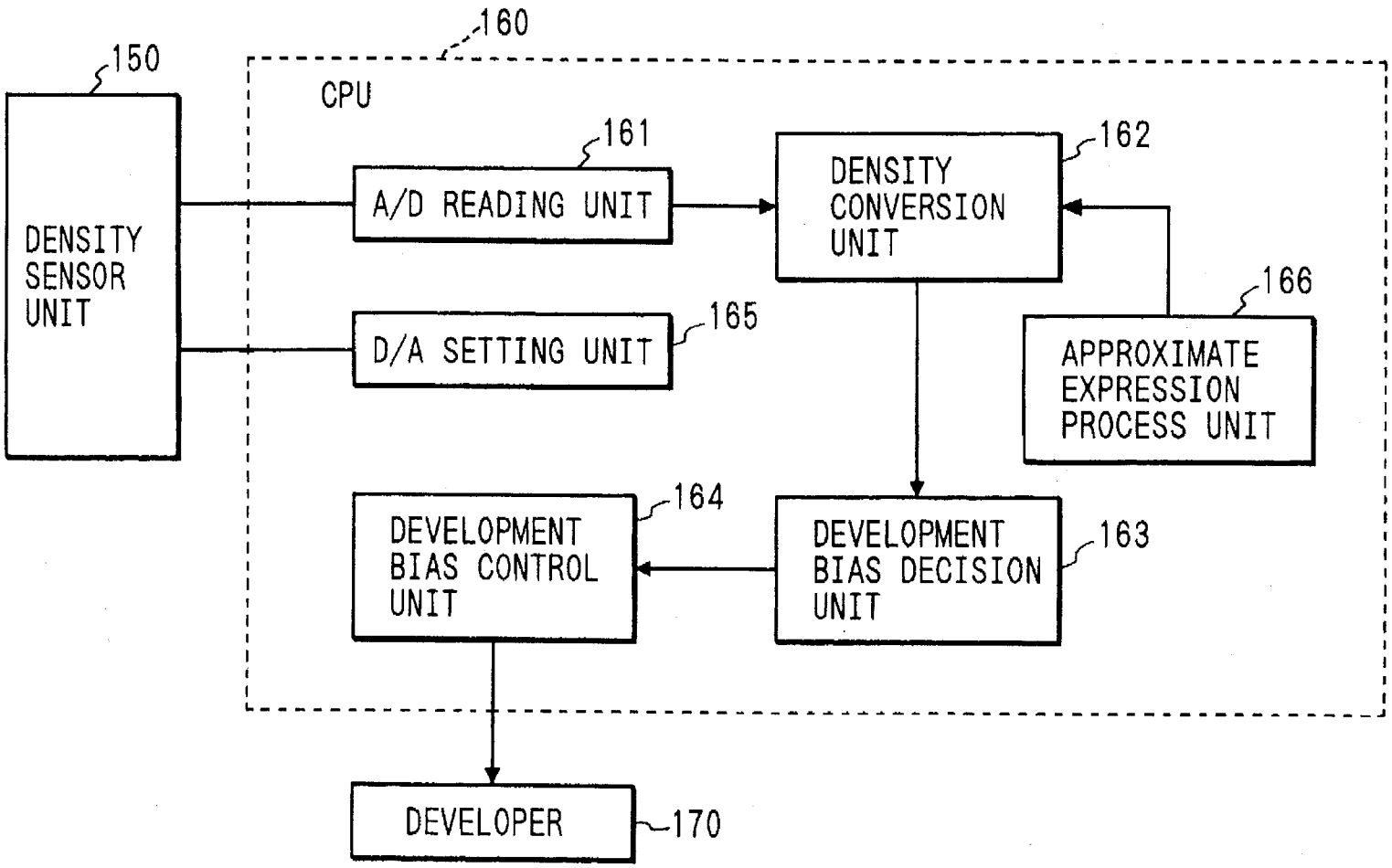
FIG. 18 is a block diagram of a ninth embodiment of the present invention.

FIG. 18 shows the configuration of a 9th embodiment of the present invention, wherein components equivalent to those in the foregoing embodiments are represented by corresponding numbers and will not be explained further. In FIG. 18, an approximation expression process unit 166 calculates the density value by an approximation utilizing McLaurin's development in the density conversion.

In the following there will be explained the details of the density conversion process of the density conversion unit 162, utilizing the approximation expression process unit 166 of the 9th embodiment.

[1] Case with Black Toner

As explained in the foregoing, the black toner shows absorption in the infrared region.

When the background (density Du) of the transfer drum, without patch formation, is irradiated with an incident light intensity $I_{o1}$ and a reflected light intensity $I_{r1}$ is obtained, there stands a relation:

$$I_{r1}=I_{o1}\times 10^{-Du} \tag{1}$$

Also when a patch of a density Dp, formed on the background of a density Du, is irradiated with an incident light intensity $I_{o2}$ and a reflected light intensity $I_{r2}$ is obtained, there stands a relation:

$$I_{r2}=I_{o2}\times 10^{-(kDp+Du)} \tag{2}$$

wherein k is a proportion coefficient. From the equations (1) and (2), the voltages $R_{ref1}$, $V_{ref2}$ corresponding to the reflected lights are given by:

$$V_{ref1}=I_{o1}\times 10^{-Du} \tag{3}$$

$$V_{ref2}=I_{o2}\times 10^{-(kDp+Du)} \tag{4}$$

Consequently, by driving the equation (4) by (3), there is obtained:

$$\frac{V_{ref2}}{V_{ref1}}=\frac{I_{o2}\times 10^{-(kDp+Du)}}{I_{o1}\times 10^{-Du}} \tag{5}$$

and the patch density Dp can be given by:

$$Dp=\frac{1}{k}\times \mathrm{LOG}\left(\frac{I_{o2}}{I_{o1}}\times\frac{V_{ref1}}{V_{ref2}}\right) \tag{6}$$

[2] Case with Color Toner

As explained in the foregoing, the color toner is reflective in the infrared region. As in the case of black toner, when the background of the transfer drum, without patch formation, is irradiated with an incident light intensity $I_{o1}$ and a reflected light intensity $I_{r1}$ is obtained, there stands a relation:

$$I_{r1}=I_{o1}\times(1-10^{-Du}) \tag{7}$$

By defining the reflectance Ru of the background by:

$$10^{-Ru}=1-10^{-Du} \tag{8}$$

there stands a relation:

$$I_{r1}=I_{o1}\times 10^{-Du} \tag{9}$$

Also when a patch of a density Dp, formed on the background of the density Du, is irradiated with an incident light intensity $I_{o2}$ with a reflected light intensity $I_{r2}$, there stands a relation:

$$I_{r2}=I_{r2}\times\{1-10^{-kDp}(1-10^{-Du})\}=I_{r2}\times\{1-10^{-(kDp+Ru)}\} \tag{10}$$

wherein k is a proportion coefficient. From the foregoing equations, the voltages $V_{ref1}$, $V_{ref2}$ corresponding to the reflected lights are given by:

$$V_{ref1}=I_{o1}\times 10^{-Ru} \tag{11}$$

$$V_{ref2}=I_{o2}\times\{1-10^{-(kDp+Ru)}\} \tag{12}$$

By substituting the equation (11) into (12), there is obtained:

$$\frac{V_{ref2}}{I_{o2}}=\left\{1-\frac{V_{ref1}}{I_{o1}}\times 10-kDp\right\} \tag{13}$$

from which the density Dp can be represented by:

$$Dp=\frac{1}{k}\times \mathrm{LOG}\frac{I_{o1}(I_{o2}-V_{ref2})}{I_{o2}\times V_{ref1}} \tag{14}$$

For handling the black toner and the color toner in unified manner, the toner density Dp is defined as follows:

$$Dp=-k\times \mathrm{LOG}_{10}\frac{B}{A} \tag{15}$$

This equation (15) can be deformed as:

$$Dp=-k\times \mathrm{LOG}_{10}\left(1+\frac{B-A}{A}\right) \tag{16}$$

By substituting $1/\mathrm{LOG}_e 10=0.434$, $(B-A)/A=x$ and $Dp=f(x)$:

$$f(x)=-0.434\times k\times \mathrm{LOG}_e(1+x) \tag{17}$$

By applying McLaurin development to LOG(1+x) in the equation (17), there can be obtained:

$$f(x)\cong -0.434\times k\times\left(x-\frac{1}{2}x^2+\frac{1}{3}x^3-\frac{1}{4}x^4\ldots\right) \tag{18}$$

Figure 19:
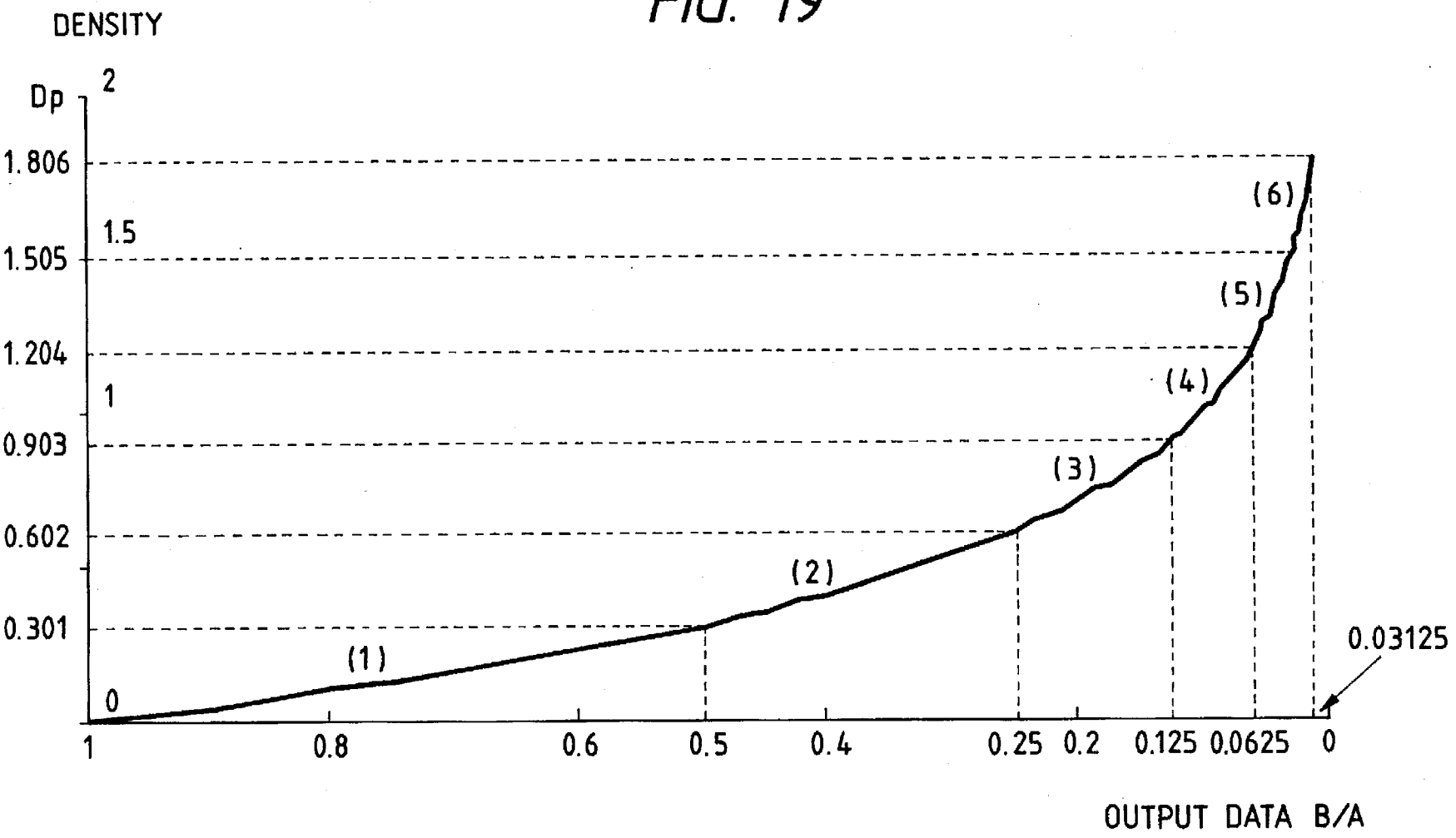
FIG. 19 is a chart showing an approximation curve employed in the ninth embodiment.

FIG. 19 shows a curve corresponding to the equation (15).

If a precision of two digits below the decimal point is required for the density value, the approximation by the equation (18) is only applicable to a range (1) ($0.5\leqq B/A\leqq 1$) in FIG. 19. Outside the range ($0.5\leqq B/A\leqq 1$), by doubling the value of B/A, data in a range (2) ($0.25\leqq B/A\leqq 0.5$) can be brought into the range (1), in which the approximation (18) is applicable.

However, since B/A is doubled, the calculated result has to be eventually divided by two, or subtracted by $\mathrm{LOG}_e 2$ in the logarithmic calculation. Consequently the approximation in the range (2) can be represented by:

$$\begin{aligned} f_2(x) &\cong -0.434k\left(-\mathrm{LOG}_e 2+x-\frac{1}{2}x^2+\frac{1}{3}x^3-\frac{1}{4}x^4\ldots\right) \\ &\cong -0.434k\left(x-\frac{1}{2}x^2+\frac{1}{3}x^3-\frac{1}{4}x^4\ldots\right)+0.301 \end{aligned} \tag{19}$$

Also outside the range (2), by multiplying B/A by 4, data in a range (3) ($0.125\leqq B/A\leqq 0.25$) can be brought into the range (1).

In this case, since B/A is multiplied by 4, the calculated result has to be eventually divided by 4, or subtracted by $\mathrm{LOG}_e 4$ in the logarithmic calculation. Consequently the approximation in the range (3) can be represented by:

$$\begin{aligned} f_2(x) &\cong -0.434k\left(-\mathrm{LOG}_e 4+x-\frac{1}{2}x^2+\frac{1}{3}x^3-\frac{1}{4}x^4\ldots\right) \\ &\cong -0.434k\left(x-\frac{1}{2}x^2+\frac{1}{3}x^3-\frac{1}{4}x^4\ldots\right)+0.602 \end{aligned} \tag{20}$$

Similar equations can also be obtained for the ranges (4) to (6), as summarized in the following:

Range (1): D=f(x)

Range (2): D=f2(x)=f(x)+0.301

Range (3): D=f3(x)=f(x)+0.602

Range (4): D=f4(x)=f(x)+0.903

Range (5): D=f5(x)=f(x)+1.204

Range (6): D=f6(x)=f(x)+1.505

In the density calculation according to these approximations, if a precision for example of D±0.05 is required, the function f(x) can be used up to the 4th-order term.

Figure 20:
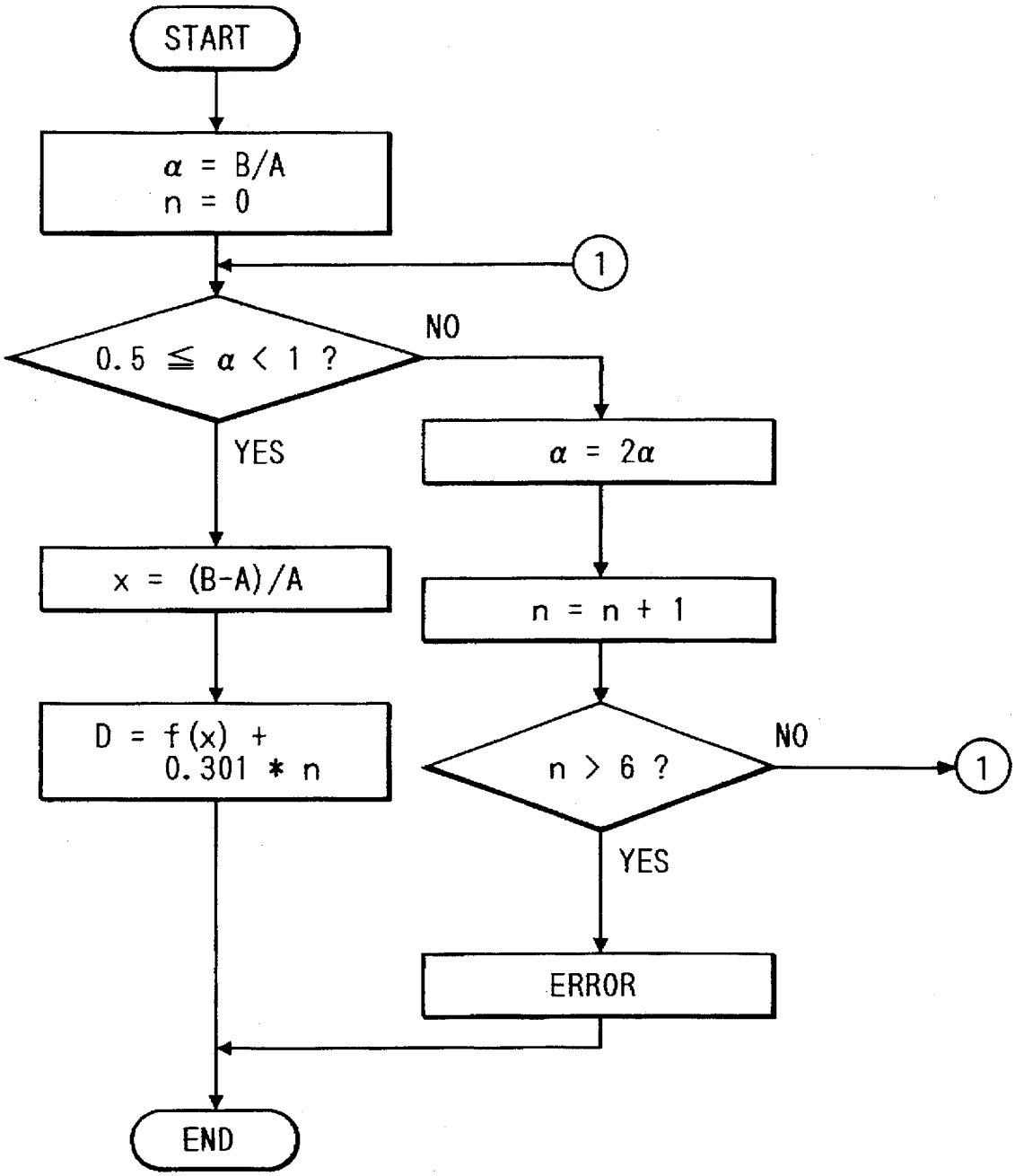
FIG. 20 is a flow chart showing the control sequence of the ninth embodiment.

FIG. 20 is a flow chart showing the above-explained calculation process.

The foregoing 9th embodiment has explained the approximation in the ranges (1) to (6), covering a density range from 0 to 1.8, but the approximation is also possible above the density level 1.8 by continuing a similar process.

The present invention is applicable to a system consisting of plural equipment or an apparatus consisting of a single equipment.

Also the present invention is naturally applicable in a case where the present invention is achieved by the supply of a program to a system or an apparatus.

[10th Embodiment]

Figure 26:
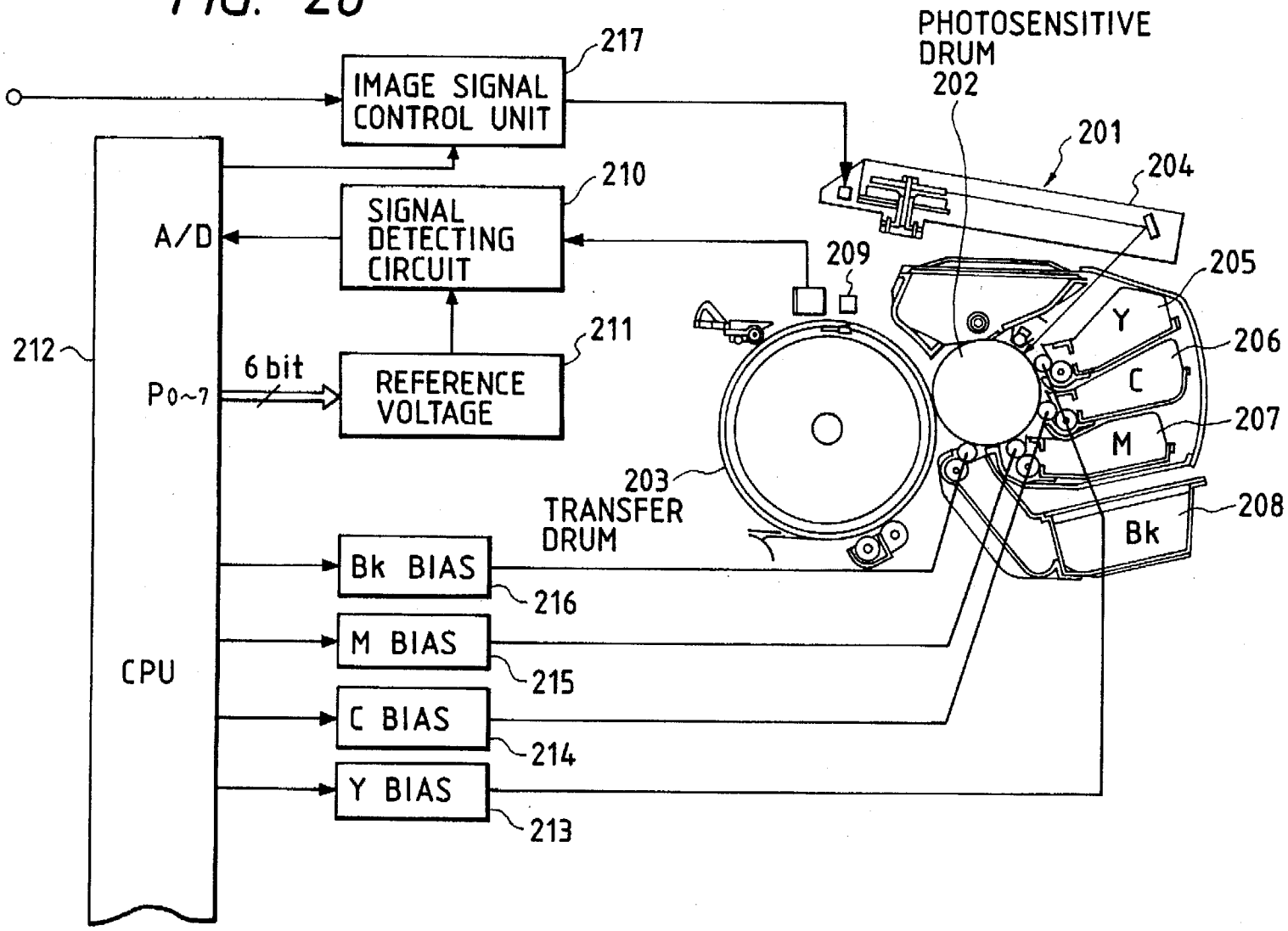
FIG. 26 is a view showing the system configuration of a tenth embodiment of the present invention.

FIG. 26 shows the configuration of an image recording apparatus embodying the present invention and a density control device incorporated therein.

In FIG. 26 there are shown a color image forming unit 201 of an electrophotographic process; a photosensitive drum 202 for forming an electrostatic latent image by receiving a laser beam; a transfer drum 203 for transferring an image, developed from the latent image, onto a recording sheet; a laser scanning unit 204 for emitting a laser beam modulated with image signals; a developing unit 205 for yellow toner, for developing a yellow latent image; a developing unit 206 for cyan toner; a developing unit 207 for magenta toner; a developing unit 208 for black toner; a density sensor unit 209 for detecting the density of the image formed on the transfer drum; a detection circuit 210 for the signal of the density sensor; a reference voltage circuit 211 for supplying the signal detection circuit 210 with a reference voltage; a CPU 212 for controlling the entire apparatus; a developing bias source 213 for the yellow developing unit; a developing bias source 214 for the cyan developing unit; a developing bias source 215 for the magenta developing unit; and a developing bias source 216 for the black developing unit.

In the following explained is the function of the image recording apparatus explained above.

The photosensitive drum 202 of the color image forming unit 201 is at first charged by an unrepresented charger, and a latent image is formed on the photosensitive drum 202 by the laser light emitted by the laser scanning unit 204. For example, when a latent image is formed corresponding to the yellow image, a developing bias is applied to the yellow developing unit 205 whereby the latent image is rendered visible by the yellow toner. The visible toner image is attracted by a high voltage, applied to the transfer drum 203, and is transferred from the photosensitive drum 202 to the transfer drum 203. The above-explained process is repeated for different colors (yellow Y; magenta M; cyan C; and black Bk) whereby a full-color image is formed on the transfer drum 203. The full-color image is subsequently transferred onto a recording sheet (not shown), then fixed on the sheet and released as a print.

As will be apparent from the foregoing description, the printing sequence in the image recording apparatus is independent for each color, so that the toner density for each color can be detected by measuring the image on the photosensitive drum 202 or on the transfer drum 203 by means of the density sensor 209. A toner mix providing optimum image quality can be realized by controlling the recording conditions (developing bias in this case) for each recording process, based on the result of the detection.

For this purpose, in the present embodiment, the toner image transferred to the transfer drum 203 is measured by a reflected light quantity measuring system involving the density sensor 209, and the developing bias voltage for each color is controlled according to the detected light quantity, thereby constantly stabilizing the toner density of each color.

Figure 27:
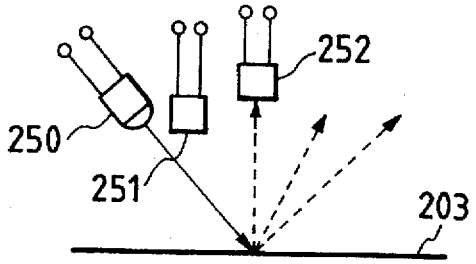
FIG. 27 is a view showing the configuration of a density sensor unit.

In the following the details of the density sensor unit 209 will be explained with reference to FIG. 27, showing the structure of the reflected light detecting unit therein. There are provided a light source 250; a photosensor element 251 positioned close to the light source 250 so as to receive a part of the light therefrom; and a photosensor element 252 for receiving the reflected light from the transfer drum 203.

The light emitted from the light source 250 irradiates the transfer drum 203 and is partly received by the photosensor element 251. When a toner image on the transfer drum 203 is irradiated with light, there results reflected light having a level proportional to the density of the toner image, and the reflected light reaches the photosensor element 252. The density measurement is conducted by amplifying and checking the detection signal released from the photosensor element 252. The detected light quantity corresponding to a toner image density "1" is only about 1/64 of that corresponding to a toner image density "8". Thus, if the detected light quantity is photoelectrically converted and amplified to a maximum signal voltage of 5 V, the signal corresponding to the density "1" only has a level of ca. 78 mV, which is considerably low for ordinary electric circuits and is therefore easily affected by noises. Also, as shown in FIG. 26, the circuit board bearing the density sensor 29 has to be positioned distant from the sequence control board, bearing the CPU 212 etc., because the measurement is conducted at a point close to the surface of the transfer drum 203 and immediately after the toner transfer from the photosensitive drum 202. For this reason, the following points are taken into consideration in designing the circuit board for the density sensor 209;

1) The detection current of the photosensor element 251 is made large, in order to alleviate the influence of the dark current generated in the photosensor element 252 composed for example of a PIN photodiode;

2) As the recorded density is represented by the logarithm of the detection current, it can be detected with a constant precision (error) regardless of the magnitude of density, by fixing the circuit gain (detected value/Δ in density);

3) The density sensor 209 can be easily smeared because of its positioning, so that its detection value is made correctable even when it is smeared.

Figure 28:
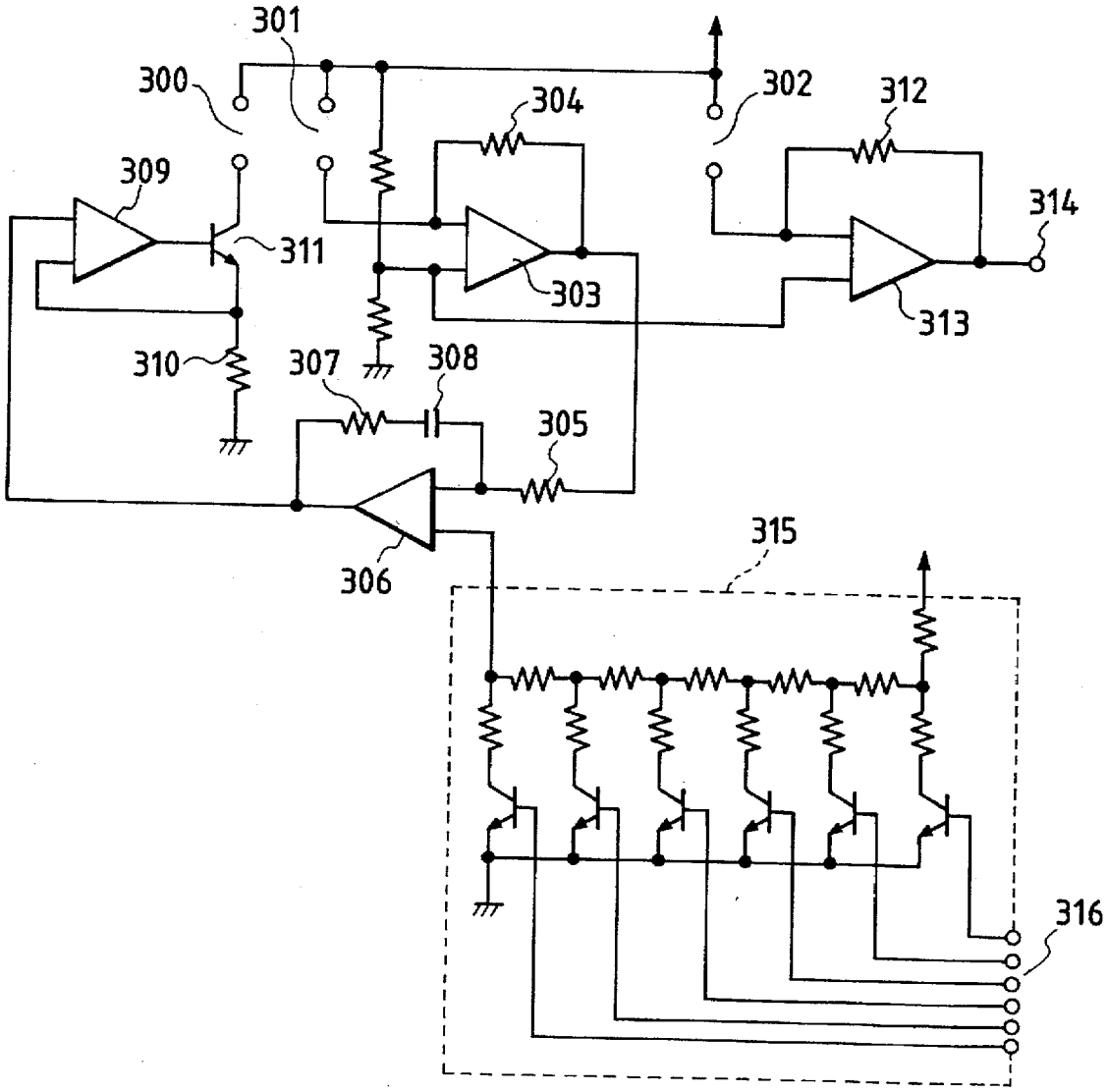
FIG. 28 is a circuit diagram of a sensor signal processing unit.

The structure of the density sensor 209 incorporating the above-mentioned factors is shown in FIG. 28, which shows terminals 300 for a diode constituting the light source 250; terminals 301 for a PIN photodiode for monitoring the light source 250; terminals 302 for a reflected light measuring diode (photosensor element 252); a voltage-current converting amplifier 303 for voltage conversion of the current entered from the diode terminals 301 in cooperation with a resistor 304; a comparator-amplifier 305–308; a voltage-current converting circuit 309–311 for controlling the light source current in response to the output of the comparator-amplifier 306; a voltage-current converting circuit 312, 313 for voltage conversion of the current from the terminals of the reflected light measuring diode; an output terminal 314 of the present sensor circuit board; a D/A converter 315 composed of plural ladder resistors and plural switching elements; and input terminals 316 for the code signals from the CPU.

Functions of the above-explained circuit will be explained in the following.

For satisfying the three considerations for the density sensor explained above, the circuit shown in FIG. 28 is so designed as to:

1) control the light quantity of the light source by continuous feedback of the detected current and to detect the light quantity of the light source;

2) constitute the feedback unit on the sensor circuit board and to provide the circuit board with a reference voltage from the outside in order to fix the circuit gain (detected value/Δ density); and 3) turn on the light source only at the measurement, since the input-output relationship is fixed by the function of the feedback unit, thereby extending the service life of the LED.

The photocurrent corresponding to the reflected light enters from the terminals 301 and is supplied to the negative terminal of the voltage-current converting amplifier 303, which generates a voltage equal to the product of the input current and the resistor 304. The voltage corresponding to the reflected light is given to the comparator-amplifier 306 for effecting phase correction and amplification. In this state the reference voltage side of the amplifier receives an analog value converted from a code signal received from the unrepresented sequence control circuit board, and the analog value is taken as the reference voltage for the comparison.

The output obtained as the result of comparison with the reference voltage is converted into a current by the voltage-current converting circuit 309–311, for driving the light source 250.

Through the functions explained above, the circuit effects control in such a manner that the magnitude of the photocurrent corresponding to the reflected light becomes always equal to the value of the code signal supplied from the sequence control circuit board. The light source current enters the circuit through the terminals 302 and is converted into a voltage by the current-voltage converting circuit 312, 313.

More specifically, the magnitude of the photovoltage corresponding to the reflected light is designated in advance by a digital code from the sequence control circuit board and the light quantity of the light source is monitored, so that the detection level becomes equal to the reference value (designated by the digital code) multiplied by the reciprocal of the reflectance. For this reason the light quantity of the light source can be detected with a high S/N ratio.

Now there will be explained the sequence of density measurement by the above-explained sensor.

Figure 29:
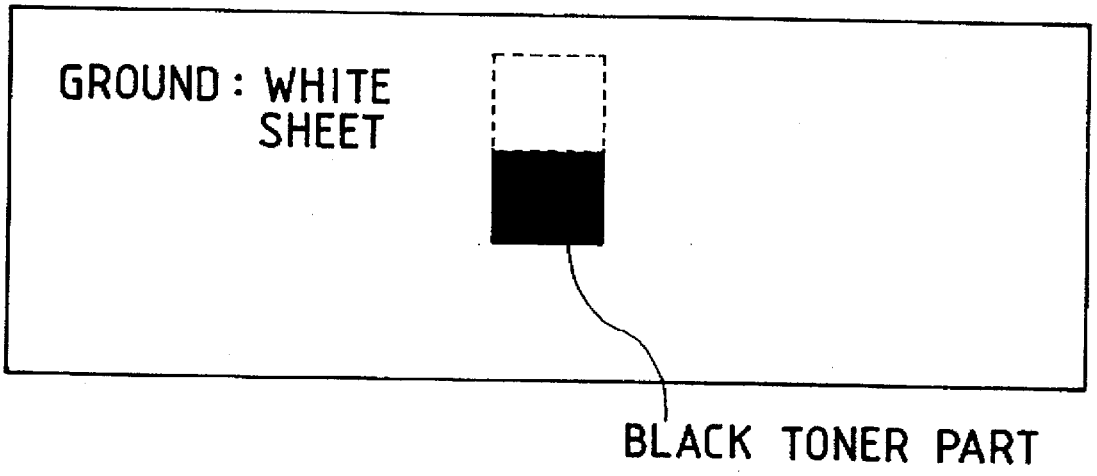
FIGS. 29 and 30 are views showing a patch.
Figure 30:
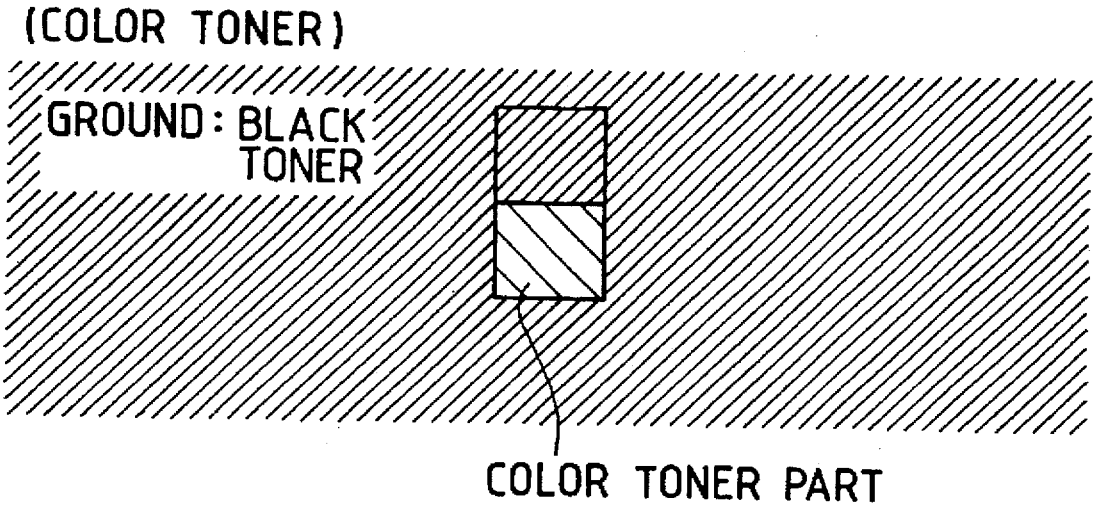

FIGS. 29 and 30 schematically show examples of the image (patch) to be formed on the transfer drum 203 for correcting the recorded density, prior to the image recording operation. In the light emission region of ca. 800–1000 nm of the LED, the black toner area of the patch shown in FIG. 29 is absorptive, while the color toner area of the patch shown in FIG. 30 is reflective. Consequently there are employed different backgrounds for the measurement of black toner and color toner. More specifically, the contrast of detection can be improved by employing a highly reflective white background (background of the transfer drum) for the black toner and a dark background (a black toner image) for the color toner.

Figures 31, 31A:
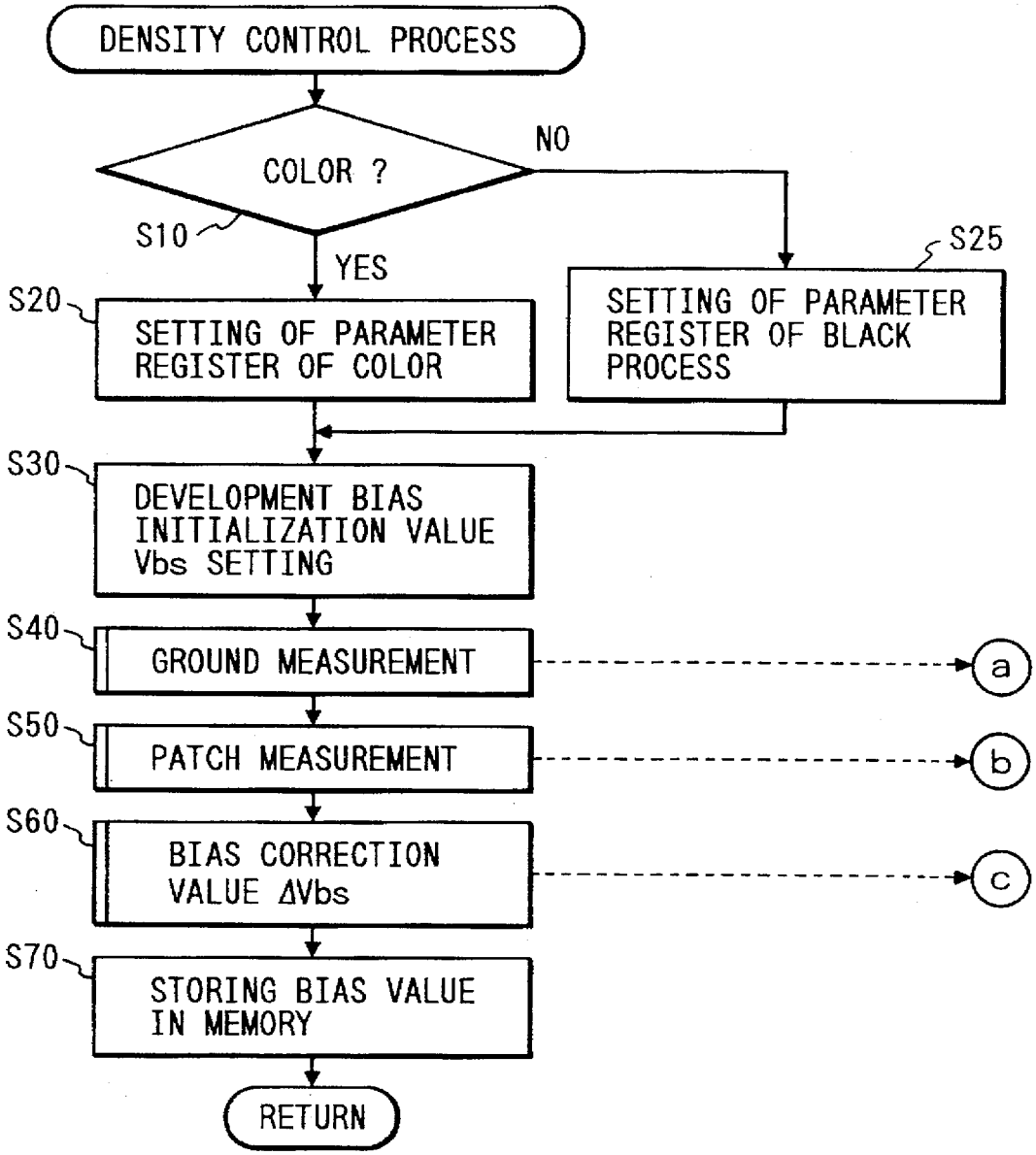
FIG. 31 which is composed of FIGS. 31A and 31B are flow charts showing the control sequence of the tenth embodiment.
Figure 31B:
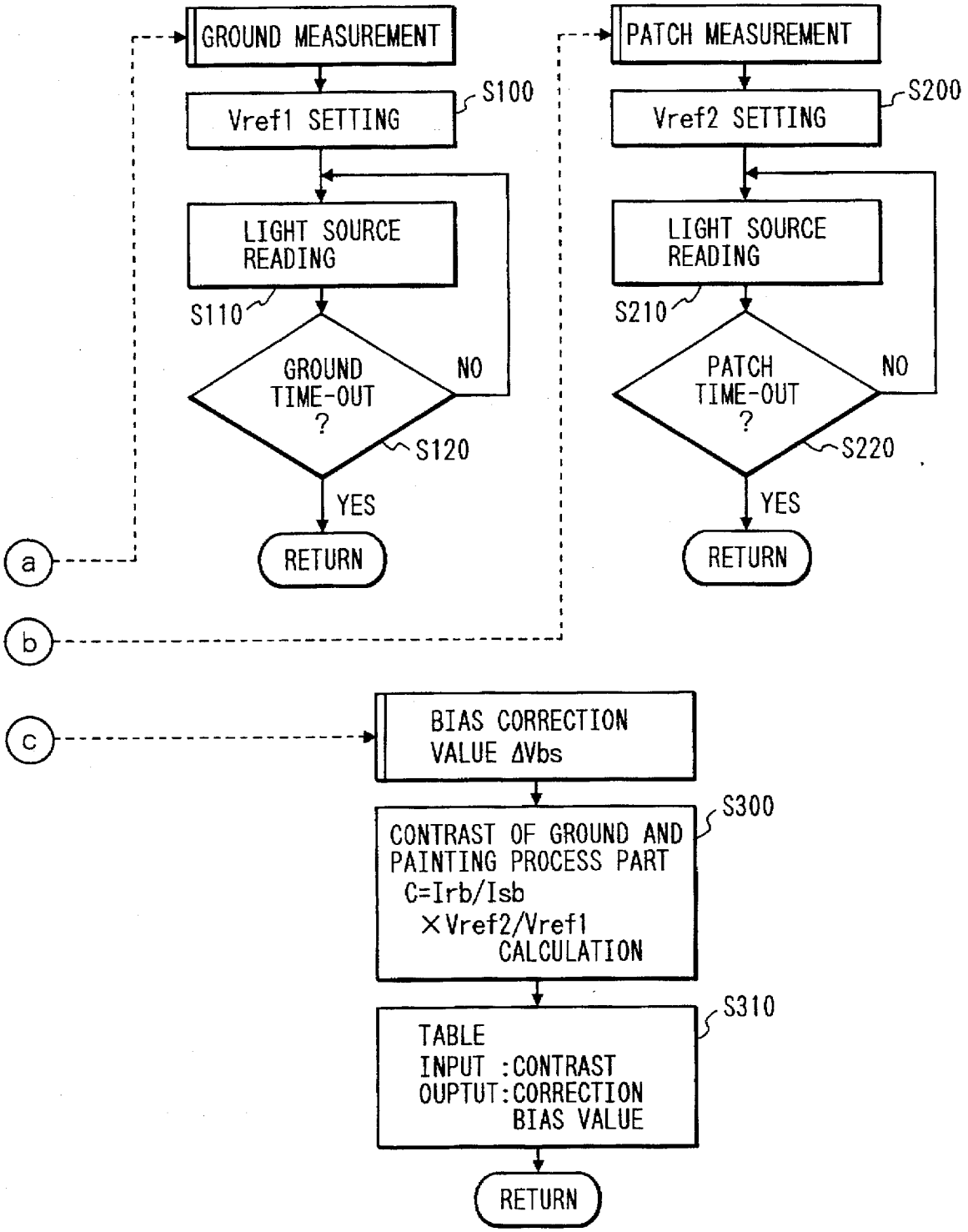

FIGS. 31A and 31B show the sequence of density control corresponding to the black-and-white and color recording. The CPU executing the control, upon entering the density control process, sets a color measuring parameter in case of color process or a black measuring parameter in case of black-and-white process, in a register (steps S20, S25). Then the CPU sets the developing bias at a sampling value Vbs and starts the printing process (step S30). In case of black process, a background area without toner deposition and then a solid black area are provided along the rotating direction of the transfer durm (cf. FIG. 29). The density sensor 209 at first measures the background, by setting a background reference voltage $V_{ref1}$ corresponding to a high reflectance. In response, by the feedback function explained in the foregoing, the light from the light source 250 is intensified by the reciprocal of the reflectance, and the corresponding intensity $I_{rb}$ is read (step S30; steps S100–S120).

Then, at the timing of measurement of the solid black patch, the density sensor 209 sets a reference voltage $V_{ref2}$ corresponding to a low reflectance, and the intensity $I_{sb}$ of the light source is similarly read (step S50; steps S200–S220). Following relations stand among $V_{ref1}$, $I_{rb}$, $V_{ref2}$, $I_{sb}$, background density Du and solid black density Dt. The signal detected at the background in the source light quantity detecting method is represented by:

$$I_{rb}=V_{ref1}/10^{-(Du)} \tag{21}$$

Also the signal detected at the solid black area is represented by:

$$I_{sb}=V_{ref2}/10^{-(Du+Dt)} \tag{22}$$

There are thus obtained signals, each corresponding to the reciprocal of the reflectance, multiplied by the reference voltage. Thus the contrast of the solid black area with respect to the background can be determined from the foregoing two equations in the following manner:

$$\begin{aligned}\text{Contrast} &= 10^{(Dt+Du)}-10^{(Du)} \\ &= (I_{rb}/V_{ref1})/(I_{sb}/V_{ref2}) \\ &= I_{rb}/I_{sb}\times V_{ref2}/V_{ref1}\end{aligned} \tag{23}$$

Also the difference in density can be represented by:

$$\Delta D=\log(I_{rb}/I_{sb})-\log(V_{ref1}/V_{ref2}) \tag{24}$$

Figure 32:
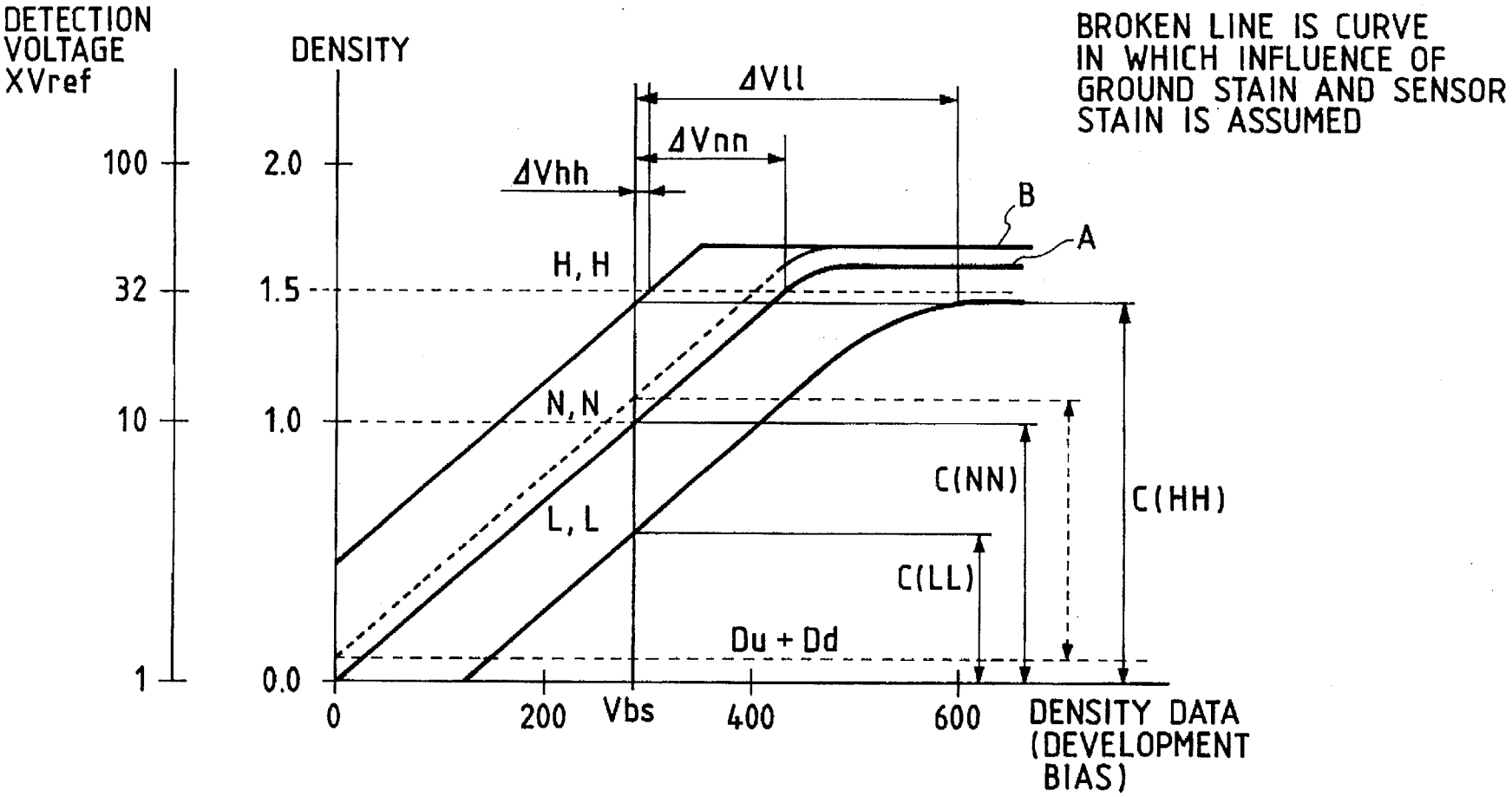
FIG. 32 to 33F are charts for explaining the density process for black toner.
Figure 33A:
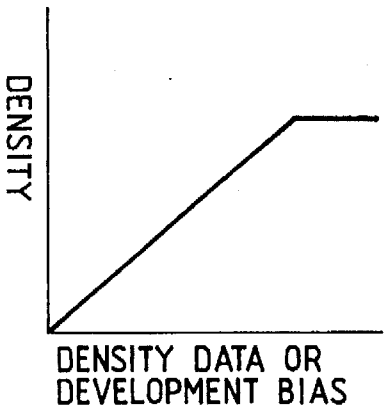
Figure 33B:
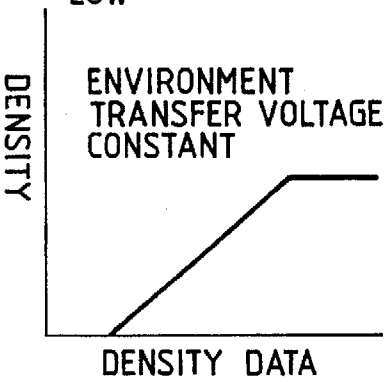
Figure 33C:
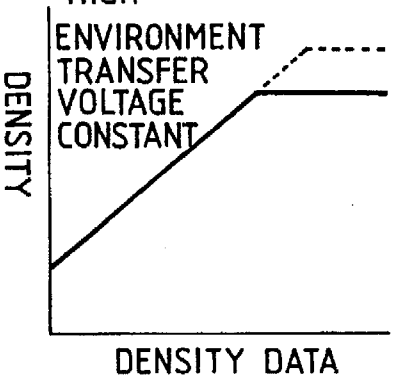
Figure 33D:
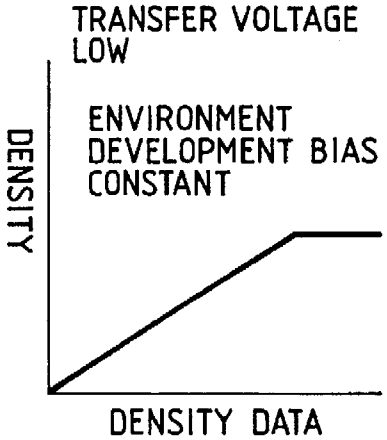
Figure 33E:
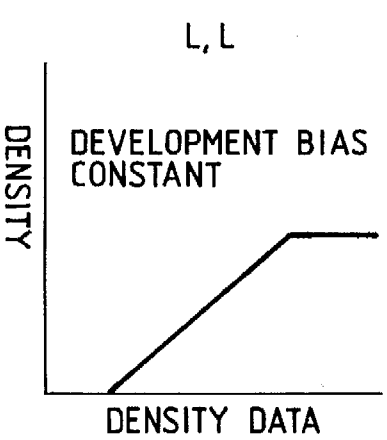
Figure 33F:
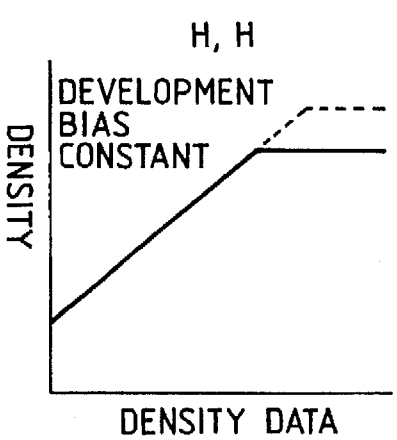

In the present embodiment, the contrast can be determined from this equation. FIG. 32 shows the relationship between the contrast and developing bias which is a control parameter. In FIG. 32, the abscissa indicates the developing bias while the ordinate indicates the density or the sensor output, and a curve A shows a representative model of the developing characteristics at normal temperature and normal humidity.

Also an upper curve B, at the higher density side, represents characteristics under a high temperature-high humidity condition, and a lower curve C, at the lower density side, represents characteristics under a low temperature-low humidity condition.

Also FIGS. 33A to 33F show representative models of variation in the image density characteristics caused by a change in the developing bias, and by a change in the environmental conditions. As will be apparent from these charts, the influence of change in the environmental conditions is equivalent to that of variation in the developing bias, so that the density can be corrected by the developing bias. In FIG. 32, the detected level corresponding to the initially set developing bias Vbs is represented as C(LL) for the low temperature-low humidity condition, C(NN) for the normal temperature-normal humidity condition, or C(HH) for the high temperature-high humidity condition. The increment to the initial developing bias Vbs, corresponding to the ideal developing bias (for example a developing bias providing a density of 1.6), with respect to the contrast of the background to the solid black determined as explained above, is stored in advance in the CPU in the form of a table or a calculating equation, such as ΔV(LL) for the low temperature-low humidity condition, ΔV(NN) for the normal temperature-normal humidity condition, or ΔV(HH) for the high temperature-high humidity condition. Then the bias value (or corrective increment ΔVbs) is determined in response to the contrast determined for the initial developing bias Vbs, and the obtained result is stored in a memory (step S60 and steps S300–S310 in FIGS. 31A and 31B). In the ordinary printing sequence, the above-mentioned corrective increment ΔVbs is used for correcting the developing bias, whereby stable density control can be always achieved without the influence of variation in the environmental conditions.

In the foregoing, the process has been explained in case of use of black toner. On the other hand, as already explained before, the color toner is reflective in the spectral region of ca. 800 to 1000 nm.

Thus, the signal detected in the background is represented by:

$$I_{rb}=V_{ref1}/(1-10^{-(Du)}) \tag{25}$$

On the other hand, in the solid color patch, there is obtained a signal:

$$I_{sb}=V_{ref2}/(1-10^{-(Dt+Du)}) \tag{26}$$

In this manner there are obtained signals, each equal to the reference voltage multiplied by the reciprocal of the reflectance. Thus the contrast of the patch to the background can be determined from these two equations as follows:

$$\text{Contrast}=(I_{rb}/I_{sb})\times(I_{sb}-V_{ref2})/(I_{rb}-V_{ref1}) \quad (27)$$

Figure 34:
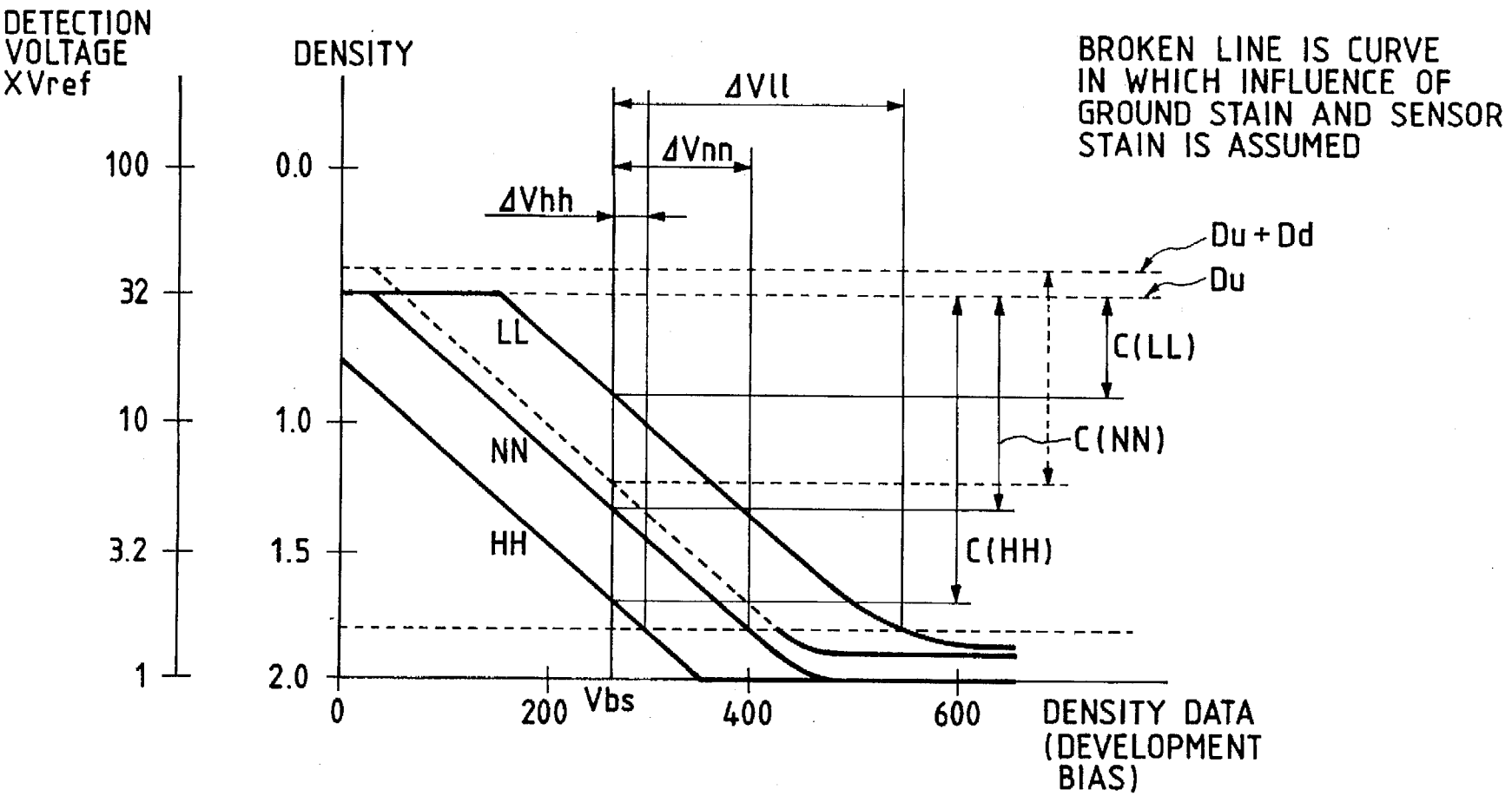
FIG. 34 is a chart for explaining the density process for color toner.

Consequently, in case of color toner, the relationship between the density and the developing bias is sloped, as shown in FIG. 34, inversely to that in FIG. 32. The working principle in FIG. 34 is same as that for the black toner, but the reference density is positioned at the side of a lower reflectance, or of a higher detection voltage. Consequently the contrast is represented by a value relative to the background density Du. Other parts of the process will not be explained as they are similar to those in case of the black toner.

In the following there will be explained correction for the smear on the sensor, which provides an influence similar to that caused by the reflectance. More specifically, the sensor output decreases in proportion to the loss of the light quantity caused by the smear on the sensor.

Consequently, by representing the smear on the sensor by Dd in the foregoing equation (25), the signal detected in the background area is represented by:

$$I_{rb}=V_{ref1}/10^{-(Du+Dd)} \quad (28)$$

Also in the solid black area there is obtained:

$$I_{sb}=V_{ref2}/10^{-(Dt+Du+Dd)} \quad (29)$$

Thus the contrast determined from the foregoing two equations is represented by:

$$\text{Contrast}=10^{(Dt+Du+Dd)}-10^{(Du+Dd)}=(I_{rb}/V_{ref1})/(I_{sb}/V_{ref2})=I_{rb}/I_{sb}\times V_{ref2}/V_{ref1} \quad (30)$$

Also the difference in density can be represented as:

$$\Delta D=\log(I_{rb}/I_{sb})-\log(V_{ref1}/V_{ref2}) \quad (31)$$

The smear Dd of the sensor can be cancelled by the subtraction of the exponents of the foregoing two equations. Thus, suitable selection of $V_{ref2}/V_{ref1}$ enables voltage detection without an overflow of the range when the output of the light quantity detecting photosensor element 250 is fetched in the CPU, also without a loss in the S/N ratio at a low signal level, and minimizing the influence of the dark current of the photosensor element.

[11th Embodiment]

Figure 35:
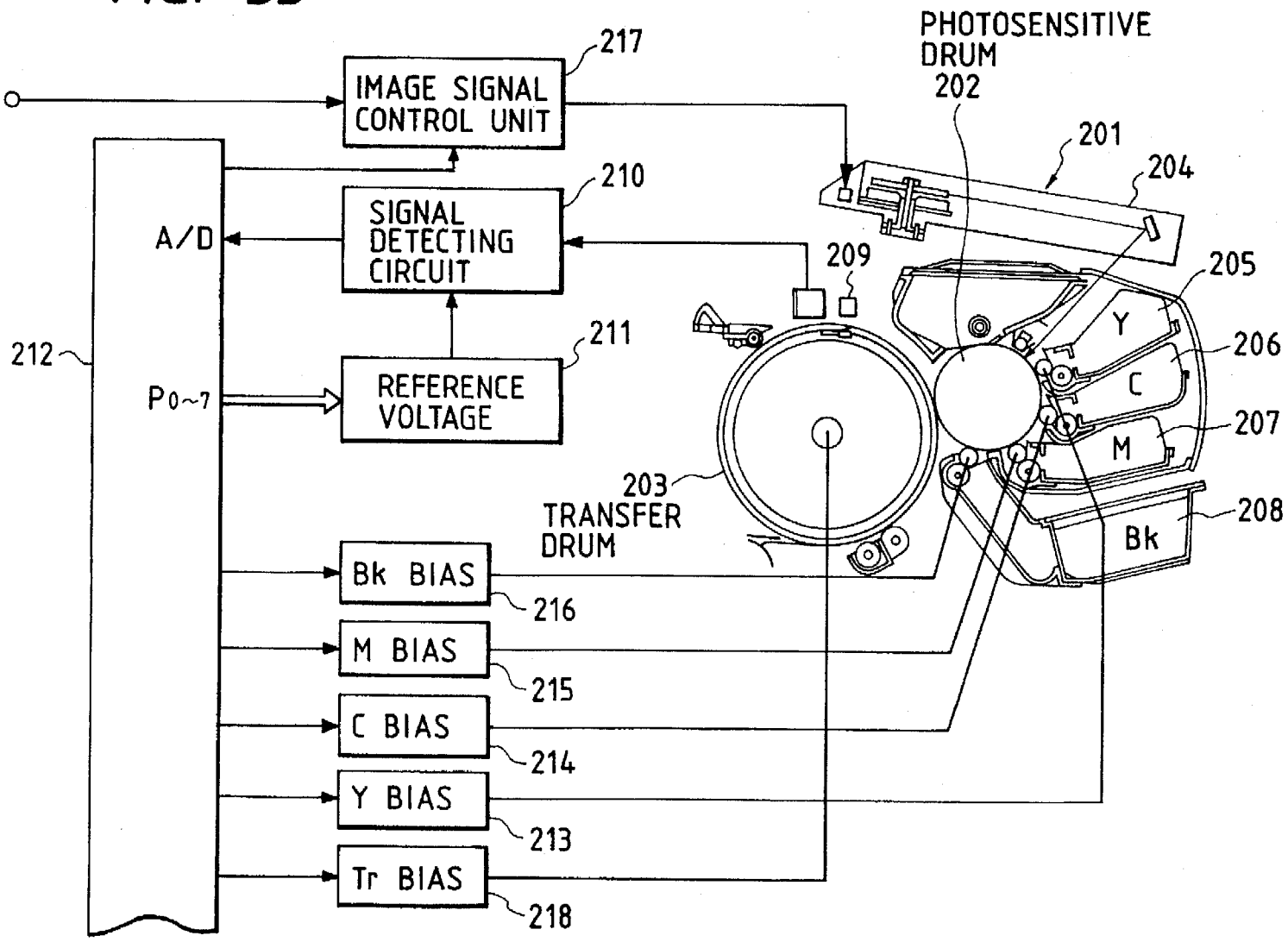
FIG. 35 is a view showing the system configuration of an eleventh embodiment of the present invention.

FIG. 35 shows the system configuration of an 11th embodiment, wherein components equivalent to those in FIG. 26 are represented by corresponding numbers and will not be explained further.

In FIG. 35, there is provided a transfer high voltage unit 218 for the transfer drum. As to the influence of the environmental variations on the toner density, there are already known, under the high temperature-high humidity conduction, a variation in the resistance to the high voltage and a variation in the tribocharging voltage of toner at the image development, and, under the low temperature-low humidity condition, a loss in the transfer efficiency. It is also conceived to elevate the transfer high voltage even under normal condition, but it is already known that an unnecessarily high voltage with respect to the environmental condition of the apparatus results in a significant loss in the transfer efficiency due to the penetration phenomenon of the toner charge.

Figure 36:
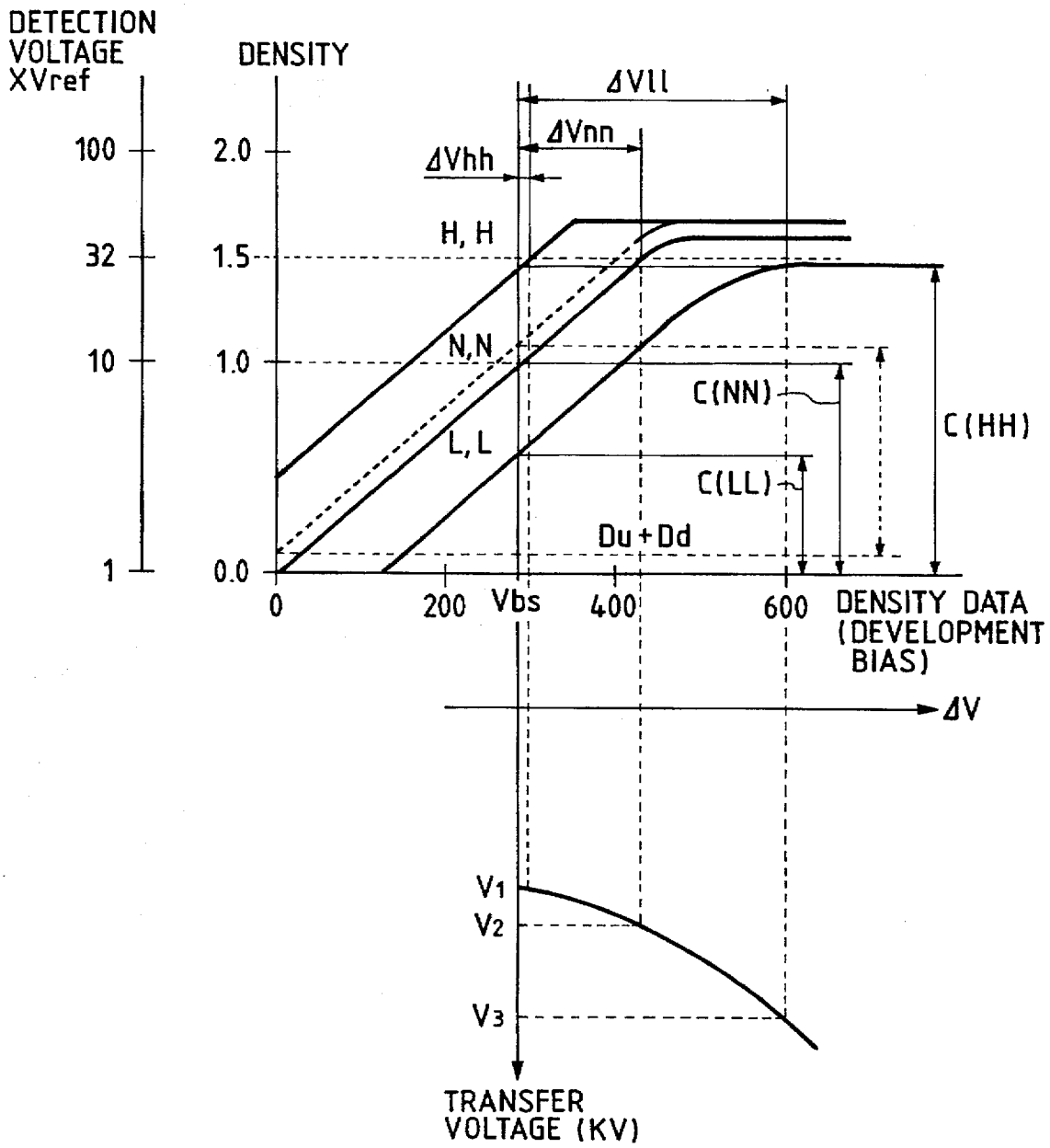
FIG. 36 is a chart for explaining density correction.

Therefore, the image quality is ensured by a change in the developing bias up to a contrast input of C(NN) obtained under the normal temperature, and, in response to an input exceeding C(NN), in combination with the variation in the developing bias, the transfer voltage is varied as V1–V3 as shown in FIG. 36 according to the variation in the developing bias or in the contrast value. In this manner density control of a high precision is rendered possible.

Figure 37:
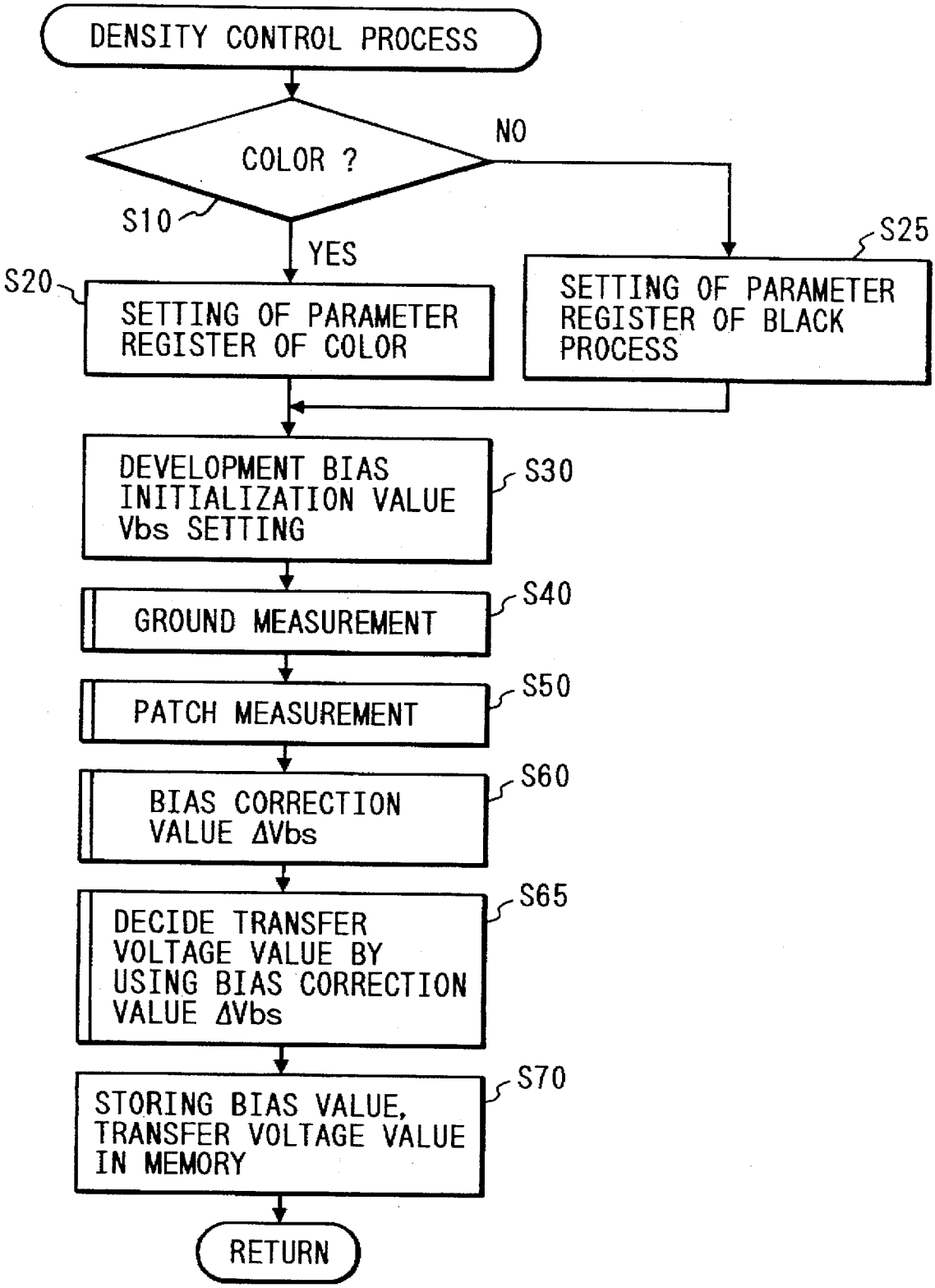
FIG. 37 is a flow chart showing the control sequence of the eleventh embodiment.

For avoiding the loss of the transfer efficiency, the 11th embodiment contains, in addition to the process shown in FIGS. 31A and 31B, a step S65 in FIG. 37 elevating the transfer voltage together with the developing bias thereby attracting the toner from the photosensitive drum to the transfer drum with a higher efficiency in case the contrast exceeds a predetermined value.

[12th Embodiment]

In system configuration, the 12th embodiment can be same as the 10th embodiment.

Figures 38, 38A:
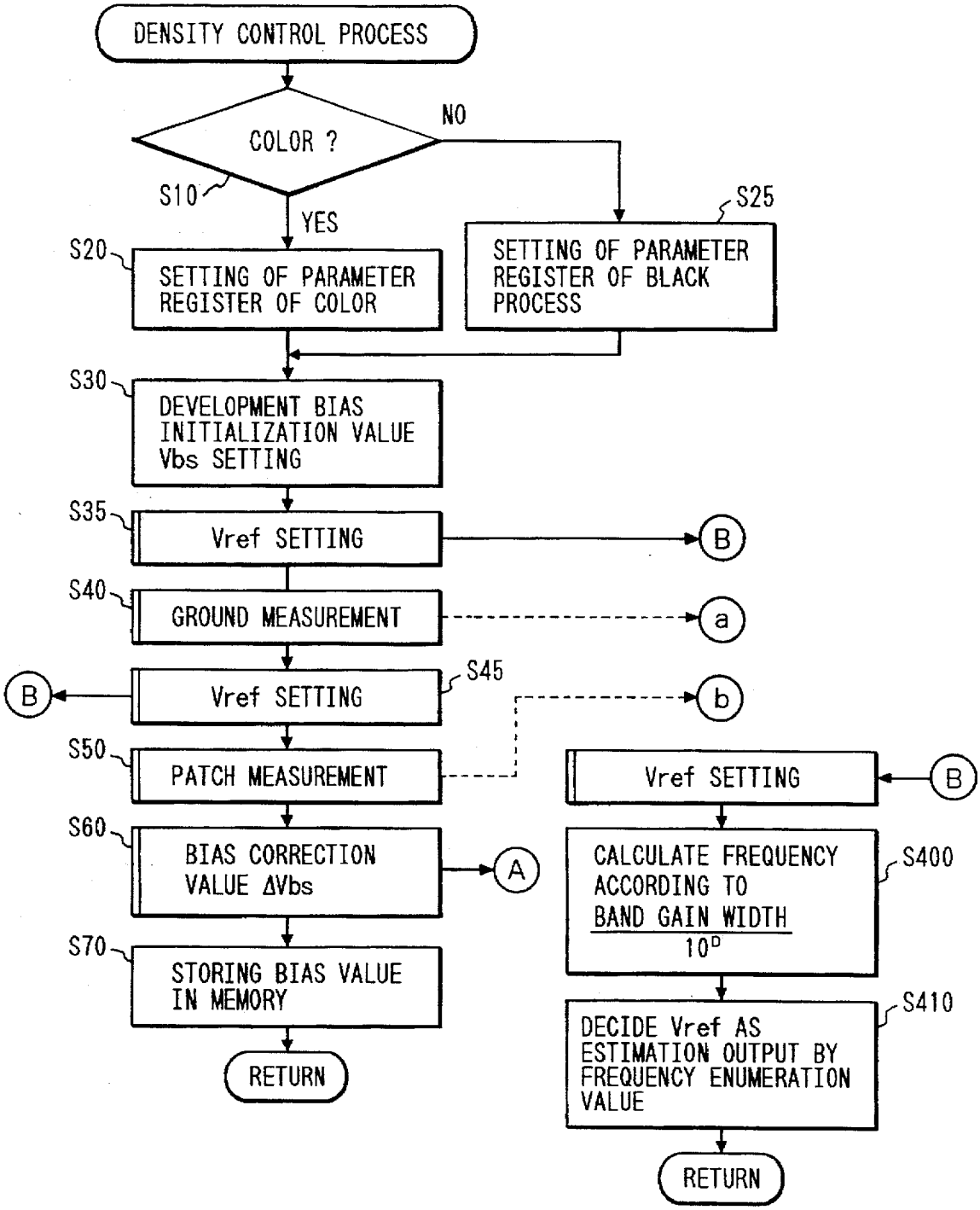
FIG. 38 which is composed of FIGS. 38A and 38B are flow charts showing the control sequence of a twelfth embodiment of the present invention.
Figure 38B:
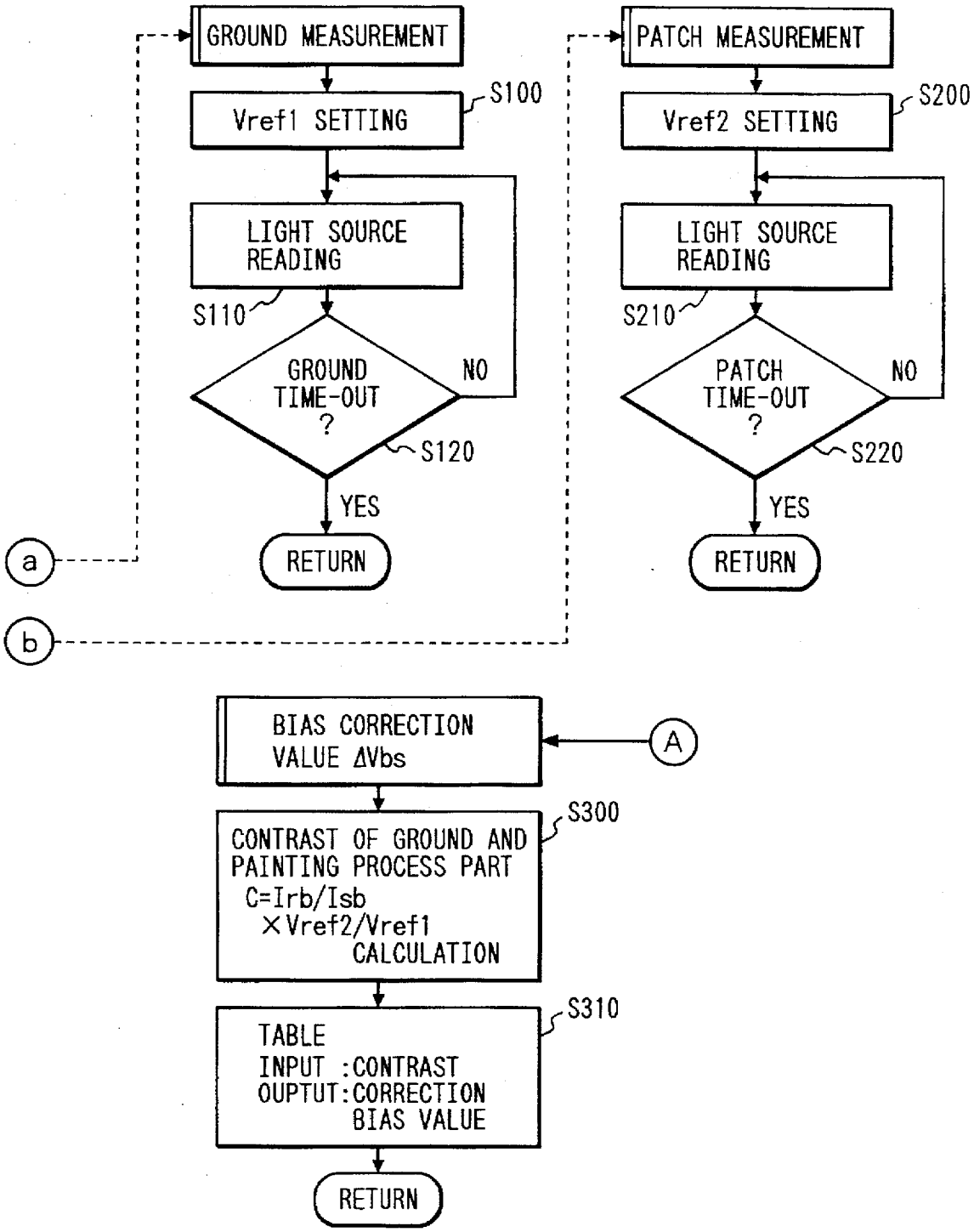

FIGS. 38A and 38B are flow charts showing the density control sequence of the 12th embodiment.

When the density control sequence is started, a color measuring parameter in case of a color process or a black measuring parameter in case of a black process is set in a register (steps S20, S25). The image recording apparatus sets the developing bias at a sampling value Vbs, and starts the recording sequence (step S30). In case of the use of black toner, there are arranged at first a background area without toner deposition and then a solid black area, along the rotating direction of the photosensitive drum. The density sensor 209 measures the background area by setting Vref1 as the background reference voltage (step S100). In this state, the detected value of the light quantity of the light source is elevated to Irb by multiplication by the reciprocal of the toner reflectance, by the aforementioned feedback function (step S110).

Then, when the solid black patch reaches the position of the density sensor 209, it sets a reference voltage Vref2 for a low reflectance (step S200) and similarly detects the light quantity Isb of the light source (step S210). If the density of the toner image, transferred onto the transfer drum 203, is read by the above-explained circuit, the input to the sensor causes a transient phenomenon, trying to reach the target reflected light quantity, because of the abrupt level change from the white area. As already known, the converging time for such transient phenomenon becomes longer as the discrepancy from the target value is larger. Consequently, in the present embodiment, rapid convergence to the target value is achieved by setting the target value of the reflected light quantity at such a value not causing a large change in the feedback output at the boundary from the background patch to the solid black patch or from the solid black patch to the background patch.

Figure 39:
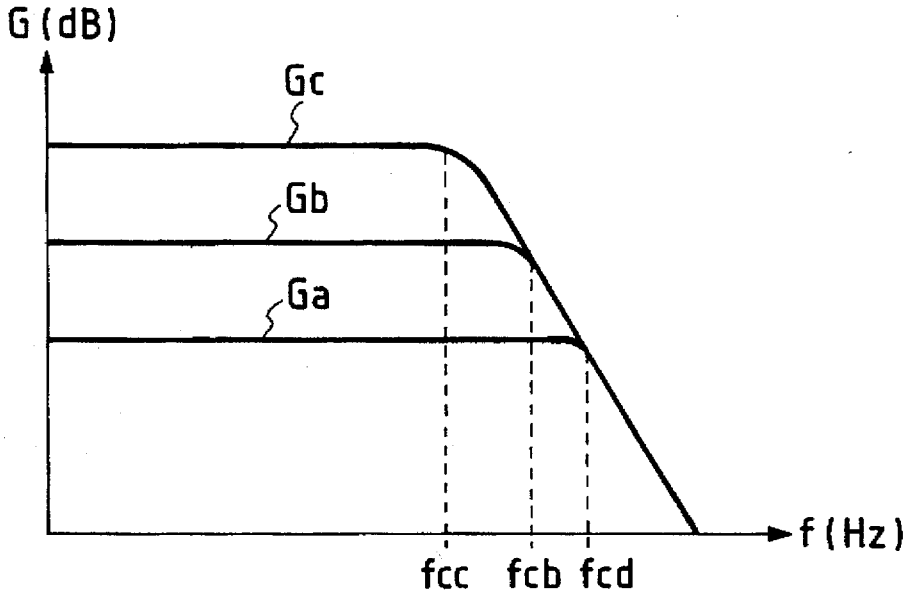
FIG. 39 is a chart showing the transmission characteristics of the circuit shown in FIG. 28.

This operation will be explained in more details with reference to FIG. 39, which shows the cycle transmission characteristics of the circuit shown in FIG. 28, wherein curves Ga–Gc respectively represent characteristics in detecting patches of different densities. The curves Ga and Gc respectively correspond to the patches of low and high densities.

As will be apparatus from the circuit shown in FIG. 28, the open loop gain of the circuit varies significantly in the measurement of a high density area and a low density area, because of the difference in reflectance, and, as a result, the frequency characteristics or the cut-off frequency becomes different in relation to the band gain product which is a linear circuit constant.

Figure 40:
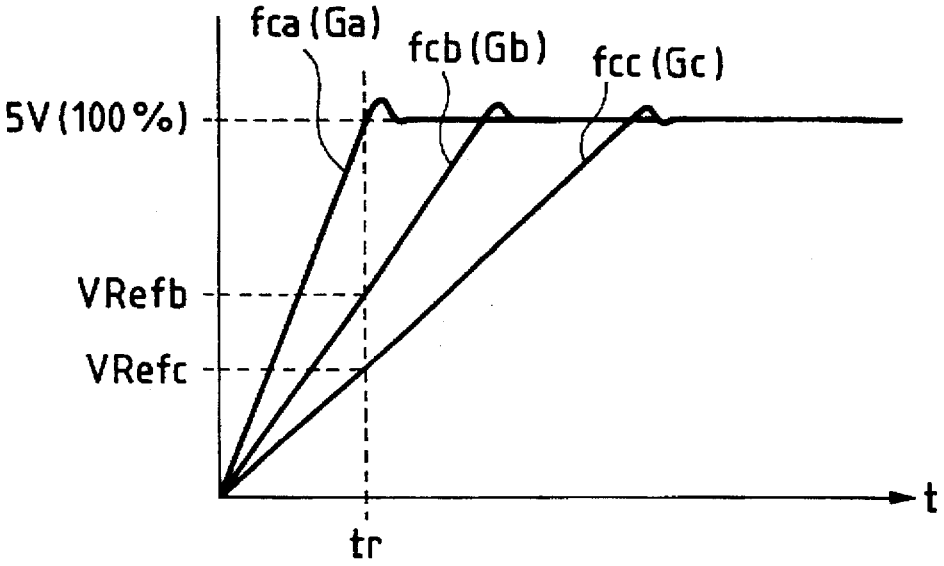
FIG. 40 is a chart showing variation in the cut-off frequency.

It is already known that, for pulse-shaped input information such as the light quantity information from the toner patch, the convergence of the transient period of the detected light quantity becomes slower or faster as the cut-off frequency becomes lower or higher (cf. FIG. 40). However, there may result an overflow of the measuring rang if the circuit shows a significant overshoot for example by the edge effect, which is a phenomenon of high density at the end of the patch pattern where the latent image potential varies steeply due to the charge distribution in the individual toner particles, specific to the electrophotographic process. Such phenomenon may deteriorate the linearity in the input-output characteristics of the circuit, and the convergence of the output data may require a long time.

For this reason, in the present embodiment, the target value for the reflected light quantity is determined in the following manner, for example in the case of black toner:

1) The gain-band product of the circuit is determined (in the above-explained circuit, the cut-off frequency is 1 kHz and the gain is 100, so that the GB product is 100,000); and 2) There is calculated, from the gain-band product and the absorbance of the toner, the gain required for the amplifier to provide a cycle loop gain: for example, for a density of 1.0, the convergence to the target value is started from a gain of 10 times or higher.

In this case, since GB product/G=1000←about 10 kHz, the convergence to the target value takes place with a race corresponding to Vspan/100 μs. Also in case of a density of 2.0, the convergence to the target value is started from a gain of 100 times or higher, and, since GB product/G=1000←about 1 kHz, the convergence takes place with a rate corresponding to Vspan/1 ms.

A step S45 in FIG. 38A effects a calculation substantially corresponding to each patch density, i.e. a calculation of dividing the gain-band product with the cut-off frequency and varying the threshold value, employed for the preceding patch, by a variation smaller than the result of said division, and the result of said calculation is set as the target value for the reflected light quantity, whereby the converging speed of the system can be maintained constant.

Further referring to FIG. 40, the control operation is to vary the target value of the reflected light quantity according to the converging rate, and the target value is determined for a detection voltage corresponding to the upshift time tr determined for example from the circuit response speed, patch size and filter characteristics to be explained later.

In practice, in reading the toner image transferred onto the transfer drum 203, there results the edge effect, or a phenomenon of higher density at the edge of the patch pattern, where the latent image potential varies steeply, due to the charges on the toner particles, and the density at such edge becomes higher than that in the center of the patch. Consequently it is not desirable to control the system by the reflected light quantity measured at such edge portion. Therefore the data obtained from such edge portion are invalidated, and the data obtained from the central portion of the patch are sampled and averaged to obtain more accurate density data.

In the present embodiment, in order to avoid data overshooting for a certain time in the density detection at the edge portion of the patch, or, more precisely, in a portion where the input density data vary, the density data from the density sensor are subjected to a second-order differential integration, and a maximum value detection is applied in combination with said integration to improve the accuracy of the data.

Figure 41:
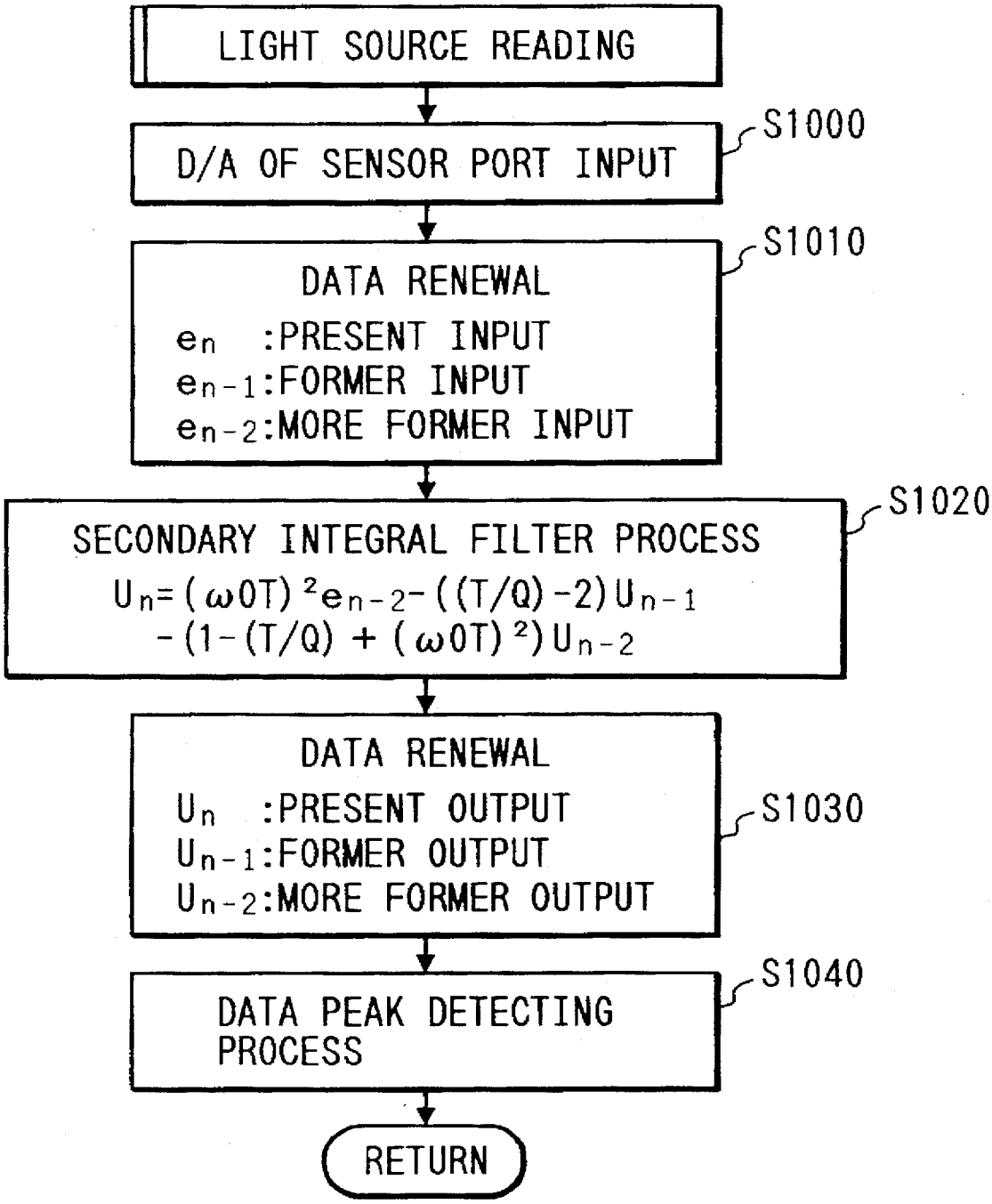
FIG. 41 is a flow chart showing a filtering process.
Figure 42:
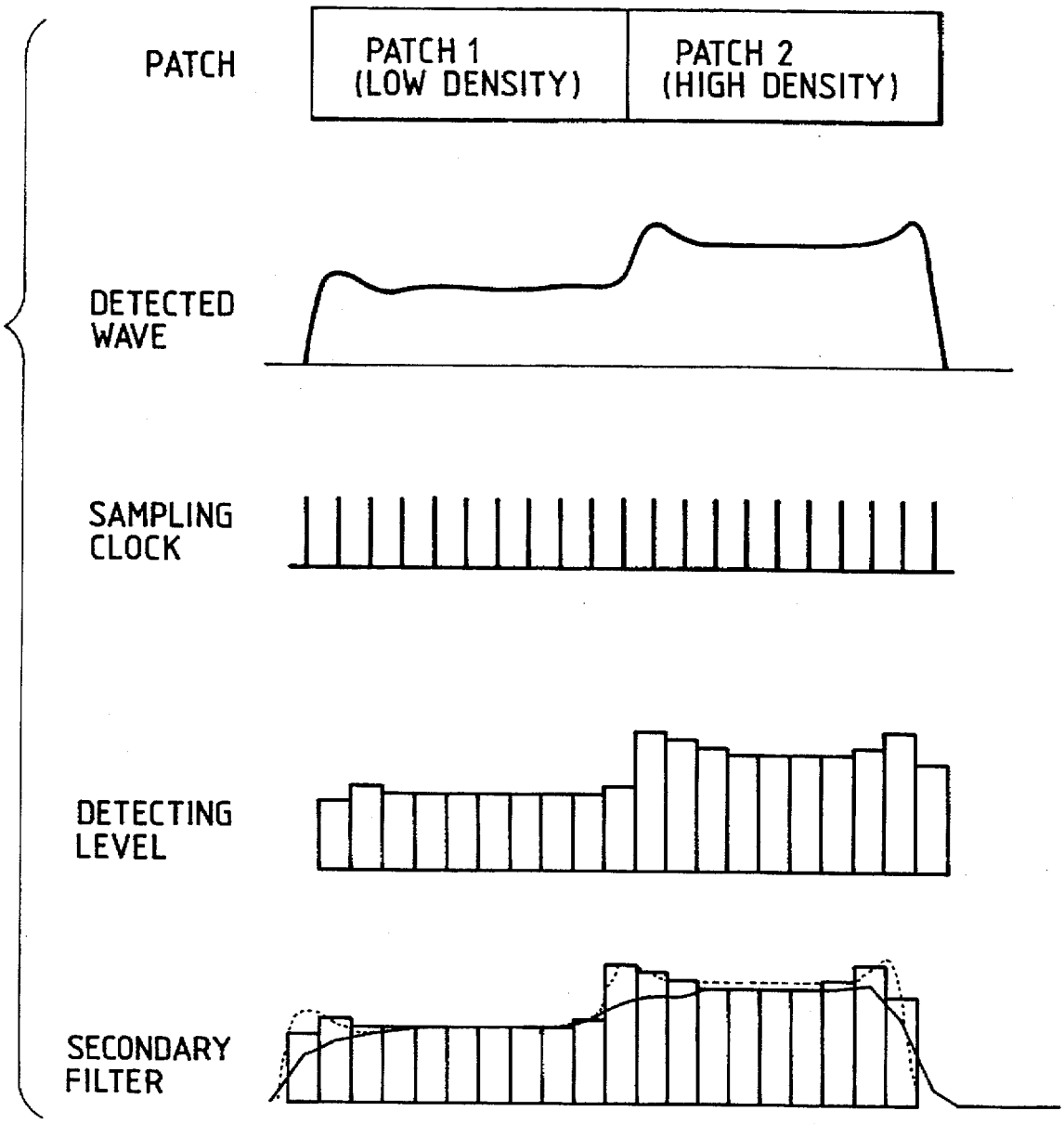
FIG. 42 is a view showing the filtering process.

The details of this process will be explained in the following. FIG. 42 shows the actual data, obtained by reading the patch and including the edge effect, and FIG. 41 is a flow chart showing the control sequence of the CPU for invalidating the edge effect in the input signal shown in FIG. 42.

Referring to FIG. 42, in reading the patches, the analog detection signal of the density sensor 209 shows a higher density at the edge portions of the patches, resulting in overshoots. Such overshoot is fetched in synchronization with sampling clock signals (step S1000). If density data $A_N$ of a number N are averaged as $\Sigma A_N/N$, such average contains a large error in comparison with the true value at the center of the patch, in case the number N of samples is small, because the detected data contain data higher than said true value. For reducing such error, in the present embodiment, the fetched data of the number N are subjected, for example, to Butterworth's second-order integration (step S1020). Such high-order integration in time allows to invalidate the high-level data detected in the edge portion of the patch, by the application of an integration constant matching the process speed of the electrophotographic process, thereby improving the accuracy of the data.

This process is conducted in the following manner. The reflected light quantity, detected by the density sensor, is amplified to an appropriate level by the sensor circuit explained in the foregoing, and is converted into digital data by the A/D converter in the CPU. The converted digital data are processed by a known Butterworth's second-order integration filter represented by:

$$T_{(s)}=(\omega_0)^2/(S^2+S(\omega_0/Q)+(\omega_0)^2) \tag{32}$$

which can be deformed as follows:

$$U_N=(\omega_0 T)^2 e_{n-2}/((T/Q)-2)U_{n-1}-(1-(T/Q)+(\omega_0 T))^2 U_{n-2} \tag{33}$$

wherein

T: time constant

Q: $\omega_0 \times C \times R$ $U_{n-1}$: last output $U_{n-2}$: output before last $e_{n-1}$: last input $e_{n-2}$: input before last The equation (33) effects time-sequential integration on the sampled data by a program process.

The integrated result can be obtained from the sampled data on real-time basis by applying the equation (33) to the sampled data, obtained by density measurement, in the order of data sampling and storing the processed data in a memory. Such configuration, integrating the data as they are acquired, allows to provide the result faster and to reduce the error in comparison with the conversion averaging process in which the average can only be calculated after all the data of a number N are stored in a memory.

Consequently the method of the present embodiment not only economizes the memory capacity but also enables optimum filtering process for eliminating the edge effect, by a suitable variation of the constant in the calculation equation.

The above-explained filtering process provides data faithfully representing the average of the detected wave form. Thus the exact measurement of the patch density is rendered possible by a cascade process of storing the maximum value of the averaged wave form in the memory (step S1040 in FIG. 41).

The above-explained method of controlling the image forming conditions of the printer by the contrast obtained by dividing the detection voltage, obtained by background measurement, with the detection signal obtained from the toner patch, and the configuration of the sensor for detecting the light quantity of the light source so as to obtain the predetermined flected light quantity provide the following advantages:

1) Even in case of a variation in the environmental conditions, there can be obtained optimum mixture of toner densities, enabling to provide color images in stable manner;

2) The use of the contrast value between the patch density and the background density allows to minimize the influence of smear on the sensor, light source etc.;

3) A sensor signal of a high S/N ratio can be obtained even from a high-density patch, since a feedback circuit is incorporated in the sensor and the detection is made by the light quantity of the light source in a state where the reflected light intensity is controlled to the value designated by the sequence controller;

4) The precision of detection is not affected by the long-term decrease of the efficiency of the light source, since a feedback circuit is incorporated in the sensor and the detection is made by the light quantity of the light source in a state where the reflected light intensity is controlled to the value designated by the sequence controller, whereby the system including the light source and the reflected light quantity detecting sensor is constructed as a closed loop of a gain of unity;

5) As the sensor system is constructed as a closed loop with a gain of unity, the light source need not be turned on in the stand-by state but can be turned on only when required, so that the service life of the light source can be extended;

6) At the boundary from the background patch to the solid toner patch or from the solid toner patch to the background patch, the target value of the reflected light quantity is so selected as not to cause a large change in the output of the feedback operation, so that a prompt convergence to the target value can be achieved and an improvement in the precision of measurement can be attained; and 7) An optimum patch density detecting device can be provided as an integration constant can be selected according to the process speed and the level of the edge effect, for avoiding the edge effect specific to the electrophotographic process.

What is claimed is:

1. An image forming apparatus provided with:

forming means for forming a patch image on a recording medium;

light emission means for irradiating the patch image, formed on the recording medium, with light;

detection means for detecting a quantity of light reflected by the patch image;

amplification means for amplifying a detection signal of said detection means;

conversion means for converting a signal from said amplification means into a digital signal; and control means for controlling image forming conditions based on the digital signal converted by said conversion means, comprising:

adjustment mode execution means for executing an adjustment mode prior to a control of the image forming conditions;

wherein said adjustment mode execution means is adapted to control the amplification gain of said amplification means or the quantity of light emitted by said light emission means in such a manner that the value of the digital signal from said conversion means, when the quantity of the light reflected from the image of a predetermined density is detected by said detection means, becomes equal to a predetermined value.

2. An apparatus according to claim 1, wherein the light reflected from the image of the predetermined density is a reflected light from ground of the recording medium.

3. An image forming apparatus comprising:

forming means for forming a patch image on a recording medium;

light emission means for irradiating the patch image, formed on the recording medium, with light;

first detection means for detecting a quantity of light reflected by the patch image;

second detection means for detecting a quantity of light emitted by said light emission means;

amplification means for amplifying a detection signal of said second detection means;

conversion means for converting a signal from said amplification means into a digital signal; and control means for controlling image forming conditions based on the digital signal from said conversion means when said light emission means emits light with such a quantity that a value of a detection signal from said first detection means becomes equal to a predetermined value, comprising:

adjustment mode execution means for executing an adjustment mode prior to a control of the image forming conditions;

wherein said adjustment mode execution means is adapted to control an amplification gain of said amplification means or a quantity of light emitted by said light emission means in such a manner that a value of the digital signal from said conversion means becomes equal to a predetermined value.

4. An image forming apparatus provided with:

forming means for forming a patch image on a recording medium;

light emission means for irradiating the patch image, formed on the recording medium, with light;

first detection means for detecting a quantity of light reflected by the patch image;

second detection means for detecting a quantity of light emitted by said light emission means;

first amplification means for amplifying a detection signal of said first detection means; and second amplification means for amplifying a detection signal of said second detection means; and adapted to control image forming conditions based on an output signal from said first amplification means or that from said second amplification means, comprising:

adjustment mode execution means for executing an adjustment mode prior to a control of the image forming conditions;

wherein said adjustment mode execution means is adapted to control the amplification gain of said first amplification means when the patch image is formed with black toner, and to control the amplification gain of said second amplification means when the patch image is formed with color toner.

5. A density control device comprising:

a light source for irradiating a toner image, formed on an image bearing member, with light;

adjustment means for adjusting a light emission intensity of the light source;

a first photosensor element for receiving light reflected from the toner image formed onto the image bearing member and for converting the light reflected from the toner image into a first electrical signal;

a second photosensor element for receiving the light emitted from the light source and for converting the light received from the light source into a second electrical signal;

predicted voltage setting means for setting, in advance, predicted voltage values for the first and second photosensor elements;

output switching means for selecting either an output signal of the photosensor element for the reflected light or the output signal of the photosensor element for the light from the light source, for output as a density measurement; and output control means for adjusting a signal level from the photosensor element selected by said output switching means in such a manner that the output of the photosensor element becomes equal to the voltage value set by said predicted voltage setting means;

wherein said adjustment means is adapted to drive said light source by amplifying, by a predetermined level, a signal not selected by said output switching means.

6. A device according to claim 5, adapted to output, as the density measurement, the output of the photosensor element for the light from the light source when the toner image is formed with black toner, or the output of the photosensor element for the reflected light when the toner image is formed with color toner.

7. A density control method for use in an image forming apparatus provided with:

forming means for forming a patch image on a recording medium;

light emission means for irradiating the patch image, formed on the recording medium, with light;

detection means for detecting a quantity of light reflected by the patch image;

amplification means for amplifying a detection signal from said detection means;

conversion means for converting a signal from said amplification means into a digital signal; and control means for controlling image forming conditions based on the digital signal converted by said conversion means, comprising a step of:

controlling the amplification gain of said amplification means or the quantity of light emitted by said light emission means, prior to a control of the image forming conditions, in such a manner that a value of the digital signal from said conversion means, when the quantity of the reflected light from the image of a predetermined density is detected by said detection means, becomes equal to a predetermined value.

8. A method according to claim 7, wherein the light reflected from the image of the predetermined density is a reflected light from ground of the recording medium.

9. A density control method adapted for use in an image forming apparatus provided with:

forming means for forming a patch image on a recording medium;

light emission means for irradiating the patch image, formed on the recording medium, with light;

first detection means for detecting a quantity of light reflected by the patch image;

second detection means for detecting a quantity of light emitted from said light emission means;

amplification means for amplifying a detection signal of said second detection means; conversion means for converting the signal from said amplification means into a digital signal; and control means for controlling image forming conditions, based on the digital signal from said conversion means when said light emission means emits light with such a quantity that a value of the detection signal of said first detection means becomes equal to a predetermined value, comprising a step of:

controlling the amplification gain of said amplification means or, the quantity of light emitted by said light emission means, prior to a control of the image forming conditions, in such a manner that the value of the digital signal from said conversion means becomes equal to a predetermined value.

10. A density control method adapted for use in an image forming apparatus provided with:

forming means for forming a patch image on a recording medium;

light emission means for irradiating the patch image, formed on the recording medium, with light;

first detection means for detecting a quantity of light reflected by the patch image;

second detection means for detecting a quantity of light emitted by said light emission means;

first amplification means for amplifying a detection signal of said first detection means; and second amplification means for amplifying a detection signal of said second detection means; and adapted to control image forming conditions based on an output signal from said first amplification means or that from said second amplification means, comprising a step of:

prior to a control of the image forming conditions, controlling the amplification gain of said first amplification means when the patch image is formed with black toner, and controlling the amplification gain of said second amplification means when the patch image is formed with color toner.

11. A density control method adapted for use in a density measuring device comprising a light source for irradiating a toner image, formed on an image bearing member, with light; a first photosensor element for receiving light reflected from the toner image formed onto the image bearing member and for converting the light reflected from the toner image into a first electrical signal; and a second photosensor element for receiving the light emitted from the light source and for converting the light received from the light source into a second electrical signal, said method comprising the steps of:

adjusting the light emission intensity of the light source and selecting the output signal of the photosensor element for the reflected light or that of the photosensor element for the light from the light source, for output as a density measurement;

adjusting a signal level of the selected photosensor element in such a manner that a voltage value of the signal selected becomes equal to a predetermined voltage value; and driving the light source by amplifying, by a predetermined level, the signal from the unselected photosensor element.

12. A method according to claim 11, for outputting, as the density measurement, the output of the photosensor element for the light from the light source when the toner image is formed with black toner, and the output of the photosensor element for the reflected light when the toner image is formed with color toner.

* * * * *

UNITED STATES PATENT AND TRADEMARK OFFICE

CERTIFICATE OF CORRECTION

PATENT NO. : 5,678,132

DATED : October 14, 1997

INVENTOR(S) : Hiroshi Shiba, et al.

It is certified that error appears in the above-identified patent and that said Letters Patent is hereby corrected as shown below:

COLUMN 2

Line 39, "Control" should read --control--.

COLUMN 3

Line 8, "Invention;" should read --invention;--.

COLUMN 8

Line 53, "AID" should read --A/D--.

COLUMN 12

Line 57, "unit 172" should read --unit 171--.

Signed and Sealed this

Twenty-sixth Day of May, 1998

Bruce Lehman

*Attest:*

BRUCE LEHMAN

*Attesting Officer*

*Commissioner of Patents and Trademarks*